US005638616A

United States Patent [19]

Kishi

[11] Patent Number: 5,638,616

[45] Date of Patent: Jun. 17, 1997

[54] OIL SUPPLY MECHANISM IN A DEEP EXCAVATOR

[75] Inventor: Mitsuhiro Kishi, Tokyo, Japan

[73] Assignee: Nikken Corporation, Tokyo, Japan

[21] Appl. No.: 575,275

[22] Filed: Dec. 20, 1995

[30] Foreign Application Priority Data

Dec. 21, 1994 [JP] Japan ..... 6-335640
Jun. 23, 1995 [JP] Japan ..... 7-180771

[51] Int. Cl.[6] ..... B66C 3/02

[52] U.S. Cl. ..... 37/186; 37/461; 414/718

[58] Field of Search ..... 37/186, 187, 461, 37/188, 184, 185; 414/725, 726, 727, 729, 722, 718, 719; 91/167, 168; 92/61

[56] References Cited

U.S. PATENT DOCUMENTS

| | | | |
|---|---|---|---|
| 3,809,248 | 5/1974 | Ohniwa et al. | 212/55 |
| 3,882,759 | 5/1975 | Formwalt et al. | 91/167 |
| 4,733,598 | 3/1988 | Innes et al. | 91/168 |
| 5,092,733 | 3/1992 | Kishi | 414/718 |
| 5,267,824 | 12/1993 | Kishi | 414/718 |
| 5,375,348 | 12/1994 | Kishi . | |
| 5,377,432 | 1/1995 | Kishi . | |
| 5,431,247 | 7/1995 | Kishi . | |
| 5,473,828 | 12/1995 | Kishi . | |

*Primary Examiner*—Terry Lee Melius
*Assistant Examiner*—Victor Batson
*Attorney, Agent, or Firm*—Flynn, Thiel, Boutell & Tanis, P.C.

[57] ABSTRACT

An oil supply mechanism in a deep excavator comprising a chassis, a turntable disposed on the chassis, a boom which is pivotally supported on the turntable and is vertically swingable, a stretchable arm arrangement which is stretchable in the longitudinal direction and comprises base, middle arm and top arms, and buckets which are attached to the top arm for excavating and holding earth or sand. The oil supply mechanism includes an oil supply unit provided in the middle arm, and first and second hollow oil supply pipes are airtightly slidable in the oil supply unit and move outwardly from the oil supply unit in opposite direction. The outer end of the first oil supply pipe is coupled with the base arm, and the outer ends of the second oil supply pipe is coupled with the top arm. An inner space of the first oil supply pipes is connected to a hydraulic generating source provided in the chassis, and an inner space of the second oil supply pipe is connected to a hydraulic driving mechanism for the buckets, whereby oil under pressure is supplied from the chassis to the first oil supply pipe, passes through the oil supply unit, then passes through the second oil supply pipe, and is finally supplied to the hydraulic driving mechanism for the buckets.

12 Claims, 29 Drawing Sheets

OIL SUPPLY MECHANISM IN A DEEP EXCAVATOR

FIELD OF THE INVENTION

The present invention relates to an oil supply mechanism in a deep excavator for deeply excavating the earth at a construction or building site, etc. to form a hole having a great depth, and particularly to an oil supply mechanism of an excavator capable of supplying oil under pressure between a plurality of telescopically assembled arms which can be simultaneously extended and contracted.

BACKGROUND OF THE INVENTION

There have been many cases at a construction or building site where the earth must be deeply excavated to form a hole having a depth which is too long relative to its diameter. For example, there have been cases for excavating the earth to form a hole in which an anchor supporting a steel tower is embedded, a hole in which a water purifier tank is embedded, a hole for ground making and a hole for well sinking. In such cases, the hole should generally have a depth which is too long, e.g. ranging from 15 m to 20 m, relative to its diameter, e.g. about 5 m.

In deep excavating work, there is conventionally employed a deep excavator having a telescopic mechanism comprising a stretchable arm arrangement wherein a clam-shell bucket (hereinafter referred to as a bucket) is coupled with the tip end of a top arm of the stretchable arm arrangement. In the conventional deep excavator, the stretchable arm arrangement is typically fixed to the tip end of the boom and has at least two stages of arms in which the bucket suspended from the top arm is hung to reach the bottom of the hole.

In the conventional stretchable mechanism for extending or contracting each arm, a wire or chain is entrained around or extended between each arm whereby each arm is extended and contracted synchronously with one another by such wire or chain. In such a mechanism, it is possible to smoothly extend or contract each arm of the stretchable arm arrangement but the wire or chain must be entrained around or extended to each arm, which makes the arrangement of the wire or chain complex. Furthermore, since the wire or chain for contraction of each arm as well as extension of each arm must be entrained around or extend to each arm, at least two wires or chains are required for one arm, which leads to a complex arrangement of the wires or chains. In such an arrangement, the wires or chains are liable to be exposed outside the stretchable arm arrangement which is not preferable in view of external appearance. There is a likelihood that earth or sand will become stuck to the wires or the chains, which causes abrasion or is troublesome to the mechanism.

Accordingly, there is proposed a mechanism for extending or contracting a stretchable arm arrangement using hydraulic power generated by a single hydraulic cylinder which is incorporated into the stretchable arm arrangement comprising a plurality of telescopic arms. However, in this mechanism, the amount of extension of the stretchable arm arrangement is limited and the speed of extension is not increased. To solve these problem, there is further proposed a mechanism having two stretchable arms each having a hydraulic cylinder wherein the hydraulic cylinders are simultaneously operated to thereby extend and contract the entire stretchable arm arrangement. However, if a plurality of hydraulic cylinders are accommodated in the stretchable arm, it is necessary to provide high pressure application hoses on each hydraulic cylinder coupled with each arm, which makes the mechanism complex. Even if a plurality of hydraulic cylinders are used, the stretchable arm arrangement cannot be extended and contracted at high speed.

To solve the problem, there has been proposed a mechanism, for example, as disclosed in Japanese Patent Application Nos. 4-130104 and 4-157331 (and corresponding U.S. Pat. No. 5,375,348) for simultaneously operating a plurality of stretchable arms using a working unit comprising two sets of hydraulic cylinders (two sets of hydraulic cylinder units) which are alternately assembled and arranged in parallel with each other and structured so that cylinder rods thereof are disposed to operate in the opposite direction.

In the working unit, the top and base arms can be extended or contacted by a pair of hydraulic cylinder units in the working unit, and the extending or contracting speeds can be faster. A hydraulic system, i.e. piping system for supplying oil under pressure to both hydraulic cylinder units are supplied from the upper end of the working unit, and oil is collected by a pipe connected to this cylinder rod. Accordingly, the hydraulic conduit connected to the hydraulic cylinder unit is not necessary to be loose inside the telescopic stretchable arm arrangement, which makes the mechanism very simple.

In this mechanism, a long hydraulic conduit is not necessary to be disposed for extending or contracting the stretchable arm arrangement, but an additional hydraulic conduit must be disposed for supplying the oil under pressure to various hydraulic apparatus and instruments such as a clam-shell bucket, a shedding machine and a cutting mechanism. If such hydraulic machines and implements are not operated, a holding operation of the earth or sand and shedding operation cannot be performed even if the stretchable arm arrangement can be extended or contracted, hence the intended working cannot be performed. To loosen the hydraulic conduit, the length of the hydraulic conduit is set to such a length in that the stretchable arm arrangement is extended to the maximum, and the hydraulic conduit must be bent between each arm in the stretchable arm arrangement. The hydraulic conduit (i.e. hose) is formed of flexible synthetic rubber and is arranged between each arm with looseness, whereby the hydraulic conduit can be driven following the extending or contracting operations of the stretchable arm arrangement.

If the long hydraulic conduit is arranged in the stretchable arm arrangement so as to operate the stretchable arm arrangement, the hydraulic conduit per se is bent and deteriorated when used for a long period of time, which causes leakage of the oil under pressure from the hydraulic conduit. Accordingly, it was necessary to inspect the hydraulic conduit periodically so as to maintain or prevent the damage of the hydraulic conduit per se. Since the hydraulic conduit is arranged in the stretchable arm arrangement with looseness, this causes an increase of the weight of the hydraulic conduit and also causes the increase of the overall weight of the stretchable arm arrangement.

As mentioned above, the aforementioned conventional deep excavator has such a drawback in that the hydraulic conduit was needed since the hydraulic machine and instrument such as the clam-shell bucket or the shedding machine are coupled with the top arm of the stretchable arm arrangement comprising a plurality of arms, and oil under pressure must be supplied from the chassis to the hydraulic machine and instrument, which makes the hydraulic conduit difficult to handle. Accordingly, it is desired to develop a deep excavator capable of supplying oil under pressure from the base arm to the top arm of the stretchable arm arrangement without using the hydraulic conduit, and also capable of preventing leakage of the oil under pressure from the stretchable arm arrangement even if the stretchable arm arrangement is extended or contracted.

SUMMARY OF THE INVENTION

In view of the drawbacks of the conventional oil supply mechanism in a deep excavator, it is an object of the invention to provide an oil supply mechanism in a deep excavator comprising a chassis, a turntable disposed on the chassis, a boom which is pivotally supported on the turntable and is vertically swingable, a stretchable arm arrangement which is stretchable in the longitudinal direction and comprises a base, a middle and a top arm, and buckets which are attached to the top arm for excavating and holding earth or sand, wherein the oil supply mechanism is further characterized by first and second oil supply units 31,32 provided in the middle arm, first and second oil supply pipes which are hollow and are airtightly slidable in the first and second oil supply units, the first and second oil supply pipes moving out from the first and second oil supply units 31, 32 in opposite directions, and wherein other ends of the first oil supply pipes of the first and second oil supply units are coupled with the base arm 16, and one ends of the second oil supply pipes of the first and second oil supply units are coupled with a tip end of the top arm, wherein inner spaces of the first oil supply pipes are connected to a hydraulic generating source provided in the chassis, and inner spaces of the second oil supply pipes are connected to a hydraulic driving mechanism of the buckets, wherein oil under pressure is supplied from the chassis inside the first oil supply pipe, passes through the first and second oil supply units, then passes through the second oil supply pipes, and is finally supplied to the hydraulic driving mechanism of the buckets.

It is another object of the invention to provide an oil supply mechanism in a deep excavator comprising a chassis, a turntable disposed on the chassis, a boom which is pivotally supported on the turntable and is vertically swingable, a stretchable arm arrangement which is stretchable in the longitudinal direction and comprises a base, a middle and a top arm, and buckets which are attached to the top arm for excavating and holding earth or sand, a stretchable unit accommodated in the stretchable arm arrangement for extending or contracting the stretchable arm arrangement, an oil supply unit accommodated in the stretchable arm arrangement for flowing oil under pressure from a rear end to a tip end of the stretchable arm arrangement, the oil supply mechanism further characterized by the stretchable unit comprising first and second cylinder units coupled with the middle arm and directed in opposite directions, each cylinder comprising a piston slidable therein, a first pipe-shaped cylinder rod which is coupled with the base arm and is inserted into the cylinder and has an end coupled with the first piston, a second pipe-shaped cylinder rod which is inserted into the second cylinder and has an end coupled with the second piston and the other end coupled with the top arm, an inner pipe which is inserted into the first cylinder rod and has an end coupled with the piston for communicating with a pressure chamber of the first cylinder and the other end coupled with the base arm, wherein pressure chambers of the first and second cylinder units communicate with each other, and discharge chambers of the first and second cylinder units communicate with each other, and wherein an inner portion of the first cylinder rod and the discharge chamber of the first cylinder unit communicate with each other, and an inner portion of the second cylinder rod and the discharge chamber of the second cylinder unit communicate with each other, the oil supply unit comprising first and second cylinder pipes, a first pipe-shaped sliding pipe which is slidably inserted into the first cylinder pipe and has another end coupled with the base arm, the first sliding pipe is opened at both ends thereof, and a second pipe-shaped sliding pipe which is slidably inserted into the second cylinder pipe and has another end coupled with the top arm, the second sliding pipe is opened at both ends thereof, the first and second cylinder pipes communicating with each other, wherein the other end of the cylinder rod and the other end of the inner pipe are connected to a hydraulic generating source, the other end of the cylinder rod and other end of the sliding pipe are connected to the hydraulic generating source, and the other end of the cylinder rod and the other end of the sliding pipe are connected to hydraulic driving mechanisms.

DETAILED DESCRIPTION

First Embodiment (FIGS. 1 to 15)

Figure 1:
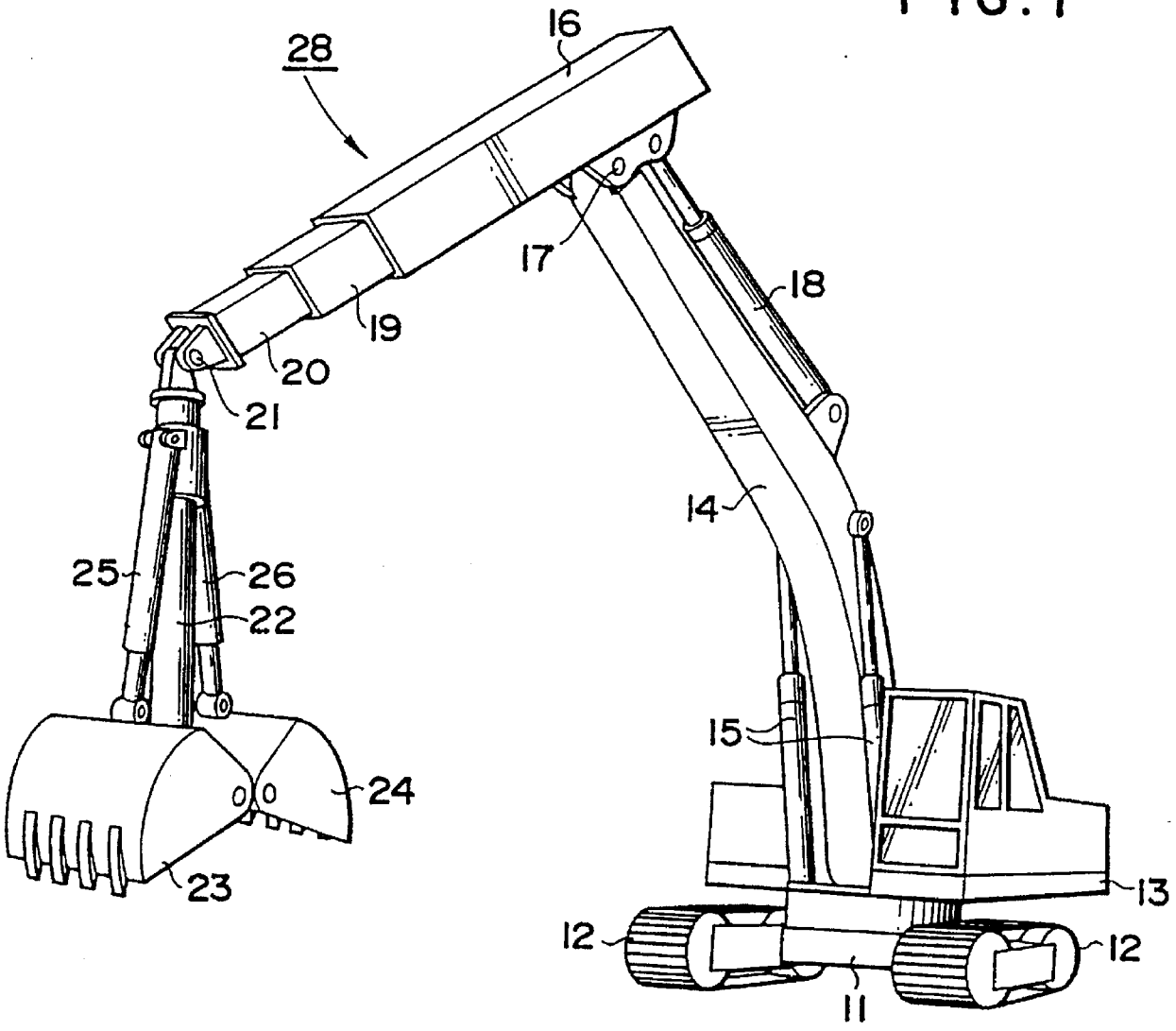
FIG. 1 is a perspective view showing an external appearance of a deep excavator according to a first embodiment of the invention.
Figure 2:
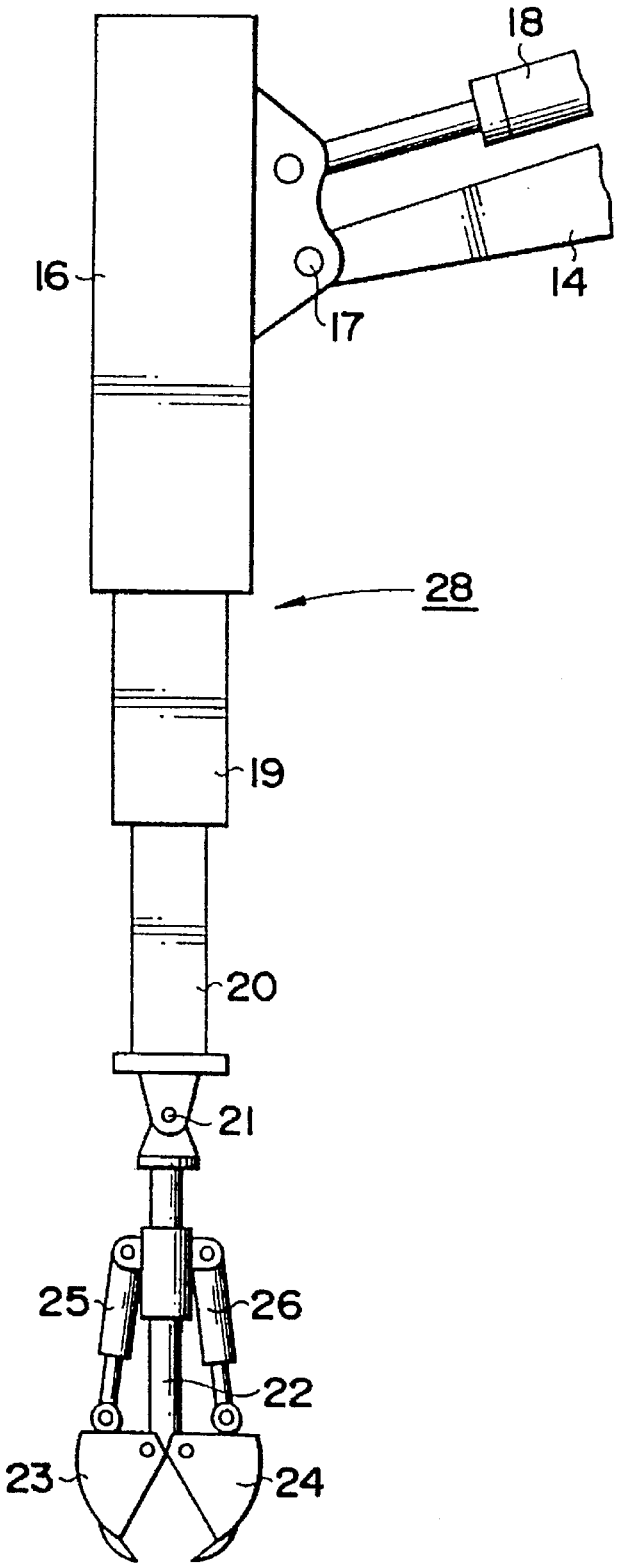
FIG. 2 is a side view of an entire external appearance of a stretchable arm arrangement according to the first embodiment of the invention.

An oil supply mechanism in a deep excavator will be now described with reference to FIGS. 1 to 15.

Crawlers 12 are provided at both sides of a chassis 11 of a deep excavator which is freely movable, i.e. right and left, forward and rearward by driving these crawlers 12. A turntable 13 is disposed over the upper surface of the chassis 11 so as to be turned 360 degrees horizontally. A lower end of substantially L-shaped boom 14 is pivotally mounted on an upper front surface of the turntable 13 so as to be swingable vertically. First hydraulic cylinder units 15 are interposed between the center of the boom 14 and the front surface of the turntable 13 for vertically turning the boom 14 relative to the turntable 13 at some angles. A long hollow base arm 16 having a square shape in cross section is coupled with the tip end of the boom 14 by a horizontal hinge pin 17 so as to be swingable vertically, and a second hydraulic cylinder 18 is interposed between the center of the rear surface of the boom 14 and the rear end of the base arm 16 to control swinging of the base arm 16.

The base arm 16 is formed by bending a thin steel plate and has a square shape in cross section and has a long hollow shape. The base arm 16 has a lower end opening through which a long hollow middle arm 19, which is formed by bending a thin steel plate and has a square shape in cross section, is slidably inserted. The middle arm 19 has a lower end opening through which a long hollow top arm 20, which is formed by bending a thin steel plate and has a square shape in cross section, is slidably inserted. These base arm 16, the middle arm 19 and the top arm 20 constitute a stretchable arm arrangement 28.

A cylindrical hanging shaft 22 is coupled with the tip end of the top arm 20 by a pin 21 so as to be always directed downward. A pair of buckets 23 and 24, which are closable to excavate the earth and hold the excavated earth and sand, are coupled with the lower end of the hanging shaft 22.

Hydraulic cylinder 25 is interposed between the center of the hanging shaft 22 and the back surface of the bucket 23 for operating the shell bucket 23. The hydraulic cylinder 26 is interposed between the center of the hanging shaft 22 and the back surface of the shell bucket 24 for operating the shell bucket 24. When both the hydraulic cylinders 25 and 26 are extended or contracted at the same time, the shell buckets 23 and 24 can be opened to the right and left or closed.

Figure 3:
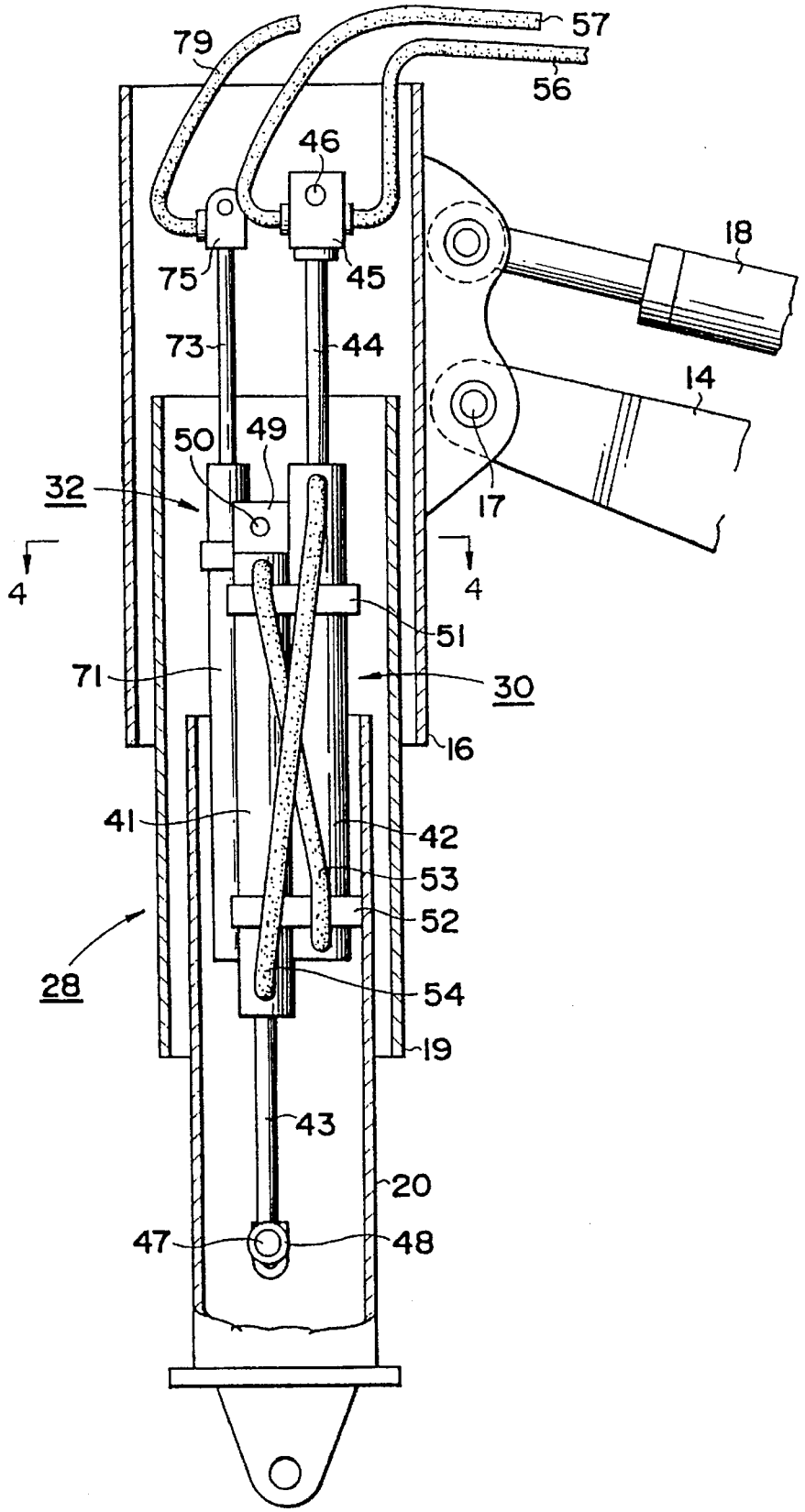
FIG. 3 is a side view of an internal arrangement of the stretchable arm arrangement used in the deep excavator according to the first embodiment of the invention.

In FIG. 3 which is a longitudinal cross-sectional view of the internal arrangement of the stretchable arm arrangement 28, the top arm 20 is inserted into the middle arm 19 and the middle arm 19 is inserted into the base arm 16 and these arms are assembled whereby the top and middle arms 20 and 19 slide in the middle and base arms 19 and 16 in the longitudinal directions thereof. A working unit 30 comprising a pair of hydraulic cylinders is disposed inside the stretchable arm arrangement 28. A longitudinal direction of the working unit 30 is in parallel with a longitudinal direction of the stretchable arm arrangement 28. First and second oil supply units 31 and 32 (FIGS. 3–5) each having a structure like a hydraulic cylinder are arranged inside the stretchable arm arrangement 28, wherein each longitudinal direction of the first and second oil supply units 31 and 32 is in parallel with a longitudinal direction of the stretchable arm arrangement 28. In FIG. 3, the second oil supply unit 32 is positioned at the back side of the working unit 30, and the first oil supply unit 31 is positioned in front of the working unit 30 but is not shown in FIG. 3.

The working unit 30 comprises a hydraulic cylinder unit 41 and a hydraulic cylinder unit 42. The hydraulic cylinder units 41 and 42 are positioned in parallel with each other in the axial directions thereof. Cylinder rods 43 and 44 of the hydraulic cylinder units 41 and 42 are coupled so as to be integrated with each other while their working directions are opposite to each other. The cylinder rod 43 of the hydraulic cylinder unit 41 is directed downward and the cylinder rod 44 of the hydraulic cylinder unit 42 is directed upward. Outer peripheries of the hydraulic cylinder units 41 and 42 are coupled to each other by joints 51 and 52 at the upper and lower portions thereof. A fixed block 49 having a block shape is fixed to the upper end of the hydraulic cylinder unit 41 and it is coupled with the middle arm 19 by a pin 50. Accordingly, the working unit 30 moves together with the middle arm 19. The cylinder rod 43 protrudes from the lower end of the hydraulic cylinder unit 41 and is directed downward so that the cylinder rod 43 can be extended from and contracted into the hydraulic cylinder unit 41. A rod ring 48 having an opening at the side surface thereof is coupled with the lower end of the cylinder rod 43. The top arm 20 and the cylinder rod 43 are coupled with each other by a pin 47 inserted into the rod ring 48. Further, the cylinder rod 44 protrudes from the upper end of the hydraulic cylinder unit 42 and is directed upward so that the cylinder rod 44 can be extended from and contracted into the hydraulic cylinder unit 42. A block-shaped rod head 45 is fixed to the upper end of the cylinder rod 44, and the rod head 45 is coupled with the base arm 16 by a pin 46.

Pressure chambers of the hydraulic cylinder units 41 and 42 communicate with each other by a synchronous pipe 53 which is exposed outside the working unit 30, while discharge chambers of the hydraulic cylinder units 41 and 42 communicate with each other by a synchronous pipe 54 exposed outside the working unit 30. As a result, the pressure and discharge chambers of the hydraulic cylinder units 41 and 42 communicate with one another by the synchronous pipes 53 and 54. Connecting conduits 56 and 57 for supplying and collecting the oil under pressure are connected to both sides of the rod head 45 and they extend from the turntable 13 when the oil under pressure is supplied to the hydraulic cylinder units 41 and 42 by way of connecting conduits 56 and 57, and the discharged oil under pressure is collected through the connecting conduits 56 and 57 so as to drive the working unit 30.

In FIG. 3, the oil supply unit 32 positioned at the back side of the working unit 30 is structured like a hydraulic cylinder, and comprises a pair of oil supply cylinder units 71 and 72 (the oil supply cylinder unit 72 does not appear in FIG. 3). An oil supply rod 73 protrudes from the upper end of the oil supply cylinder unit 71 and it is directed upward. A block-shaped rod head 75 is fixed to the upper end of the oil supply rod 73 and is coupled with the base arm 16 by way of a pin, not shown. The oil supply cylinder units 71 and 72 are respectively coupled with the middle arm 19, and the lower end of an oil supply rod 74 (FIG. 5) of the oil supply cylinder unit 72 is coupled with the top arm 20 by way of a pin, not shown. A supply hose 79, which extends from the turntable 13 for supplying and collecting the oil under pressure, is connected to the rod head 75.

Figure 4:
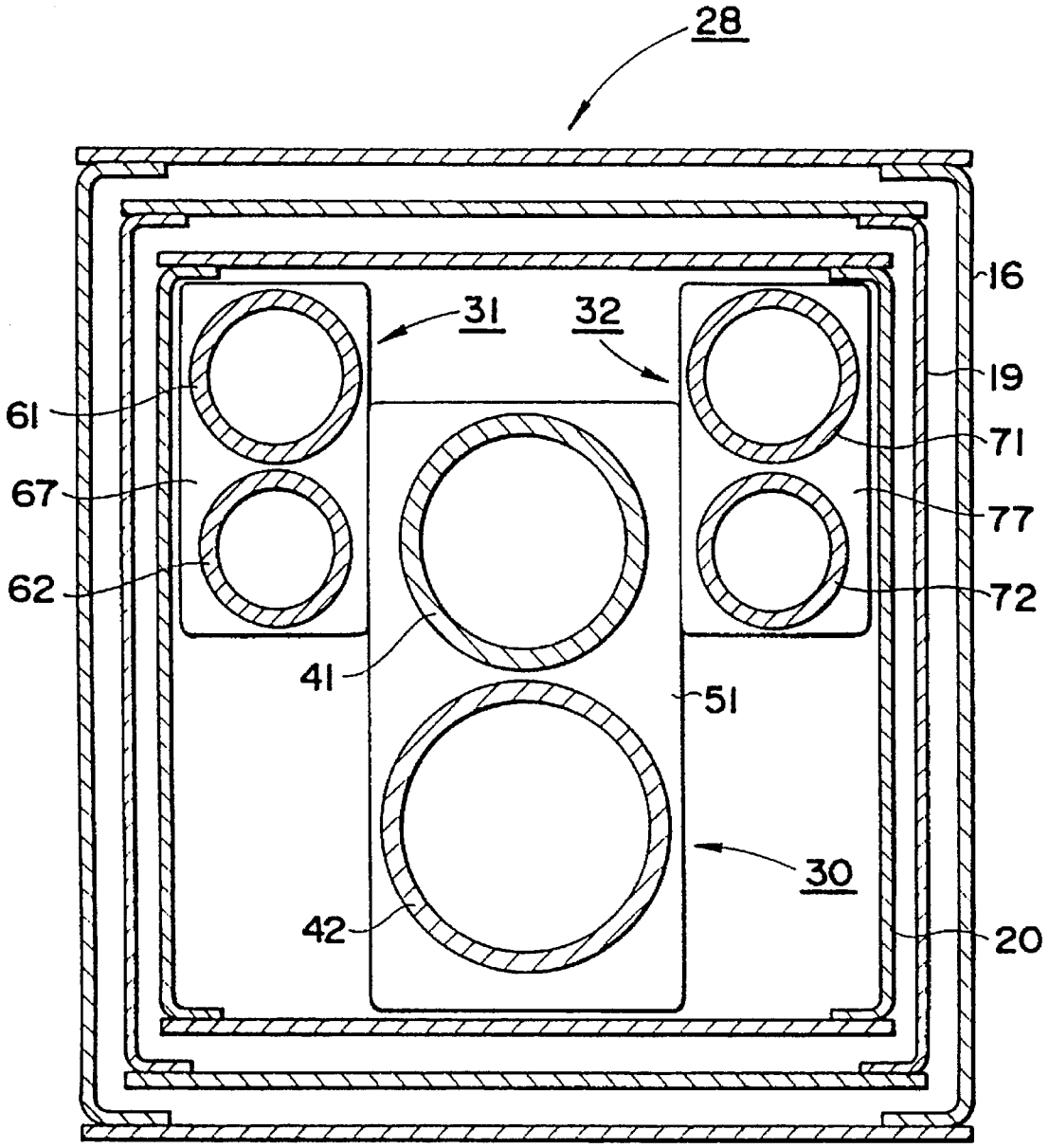
FIG. 4 is a cross-sectional view of the stretchable arm arrangement taken along line 4—4 in FIG. 3.

The arrangement and the internal structure of the stretchable arm arrangement 28 is illustrated in FIG. 4 in which the stretchable arm arrangement 28 comprises the base arm 16, the middle arm 19 and the top arm 20 which are assembled telescopically in three stages. The base arm 16, the middle arm 19 and the top arm 20 are respectively formed by welding thin steel plates and is assembled to form hollow square shapes in cross section. Side plates, which are bent at the upper and lower portions thereof, are arranged at the right and left of the base arm 16, and plane plates are respective welded to the side plates at the upper and lower portions thereof, whereby the base arm 16 forms the hollow square structure in cross section by the side plates and the plane plates. The middle arm 19 is structured in the same manner as the base arm 16, namely, side plates, which are bent at the upper and lower portions thereof, are arranged at the right and left of the middle arm 19, and plane plates are respective welded to the side plates at the upper and lower portions thereof, whereby the middle arm 19 forms the hollow square structure in cross section by the side plates and the plane plates. The outer width of the middle arm 19 is slightly less than the inner width of the base arm 16 in cross section, and the middle arm 19 is freely slidably inserted into the inner space of the base arm 16 in the longitudinal direction thereof. The top arm 20 is structured in the same manner as the middle arm 19, namely, side plates, which are bent at the upper and lower portions thereof, are arranged at the right and left of the top arm 20, and plate plates are respective welded to the side plates at the upper and lower portions thereof, whereby the top arm 20 forms the hollow square structure in cross section by the side plates and the plane plates. The outer diameter of the top arm 20 is slightly less than the inner diameter of the middle arm 19 in cross section, and the top arm 20 is freely slidably inserted into the inner space of the middle arm 19 in the longitudinal direction thereof.

The working unit 30 is disposed inside the top arm 20 and positioned slightly at the central lower portion in FIG. 4. The first oil supply unit 31 is disposed inside the top arm 20 and is positioned at the left upper portion thereof while the second oil supply unit 32 disposed inside the top arm 20 and is positioned at the right upper portion thereof. The middle arm 19 and the top arm 20 can be extended from or contracted into the base arm 16, and the middle arm 19 by the working unit 30. As a result, the entire stretchable arm arrangement 28 can be extended and contracted by the working unit 30. The oil under pressure can be supplied from the base arm 16 to the top arm 20 irrespective of the extending or contracting operations of the stretchable arm arrangement 28 by the first and second oil supply units 31 and 32, and is supplied from the turntable 13 to the hydraulic cylinders 25 and 26 attached to the tip end of the stretchable arm arrangement 28.

Figure 5:
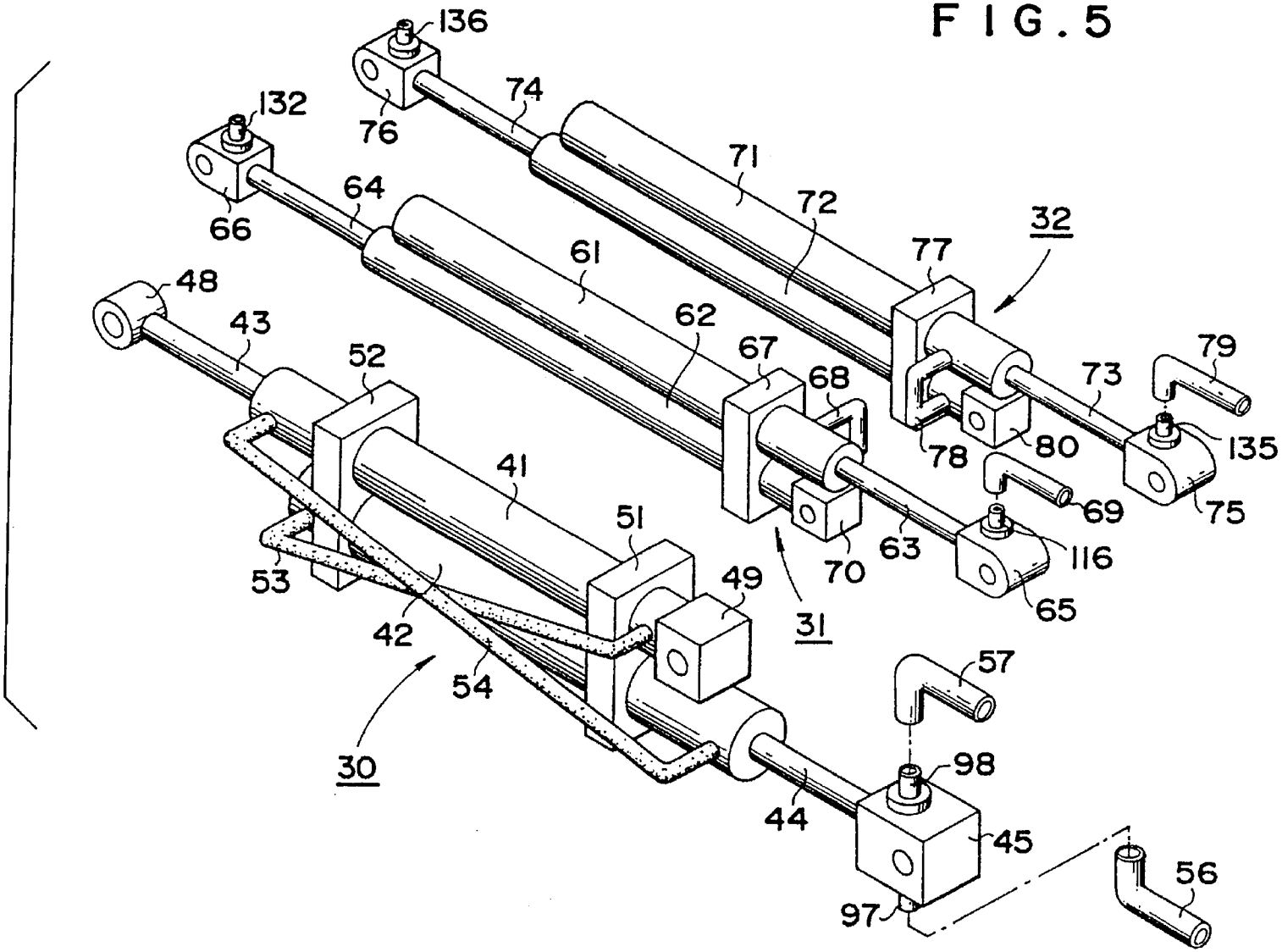
FIG. 5 is a perspective view showing the arrangement of a working unit and oil supply units accommodated in the stretchable arm arrangement of FIG. 2.

FIG. 5 is a perspective view showing each structure of the working unit 30, and the first and second oil supply units 31 and 32 which are taken out from the stretchable arm arrangement 28 and separated from one another and viewed from all angles. In FIG. 5, the right lower side is positioned at the upper portion of the stretchable arm arrangement 28 and the left upper side is positioned at the lower portion of the stretchable arm arrangement 28. The arrangement of the working unit 30, and the first and second oil supply units 31 and 32 are described more in detail.

The working unit 30 is positioned at the lower side in FIG. 5 and comprises mainly hydraulic cylinder units 41 and 42. Each of the hydraulic cylinder units 41 and 42 is like a conventional hydraulic cylinder. A hollow cylinder rod 43 extending from or contracting into the end portion (left front side in FIG. 5) of the hydraulic cylinder unit 41 is arranged in a direction opposite to a hollow cylinder rod 44 extending from or contracting into the end portion (right front side in FIG. 5) of the hydraulic cylinder unit 42. Both hydraulic cylinder units 41 and 42 are arranged in the manner that axial lines thereof are disposed up and down in parallel with each other. Block-shaped joints 51 and 52 are wound around the hydraulic cylinder units 41 and 42 at the front and rear end portions thereof. Both the hydraulic cylinder units 41 and 42 are firmly held by the joints 51 and 52 so as not to move relative to each other.

A block-shaped rod head 45 is fixed to the upper end (right front side in FIG. 5) of the cylinder rod 44, and it is coupled with the upper portion of the base arm 16. Ports 97 and 98 protrude from the upper and lower surfaces of the rod head 45. The connecting conduit 56 is connected to the port 97 and the connecting conduit 57 is connected to the port 98. The block 49 is fixed to the upper end (right front side in FIG. 5) of the hydraulic cylinder unit 41, and it is fixedly coupled with the middle arm 19. The rod ring 48 having a circular opening which extends at right angles with an axial line of the cylinder rod 43 is fixed to the lower end (left front side in FIG. 5) of the cylinder rod 43. The rod ring 48 is coupled with the lower portion of the top arm 20 by a pin.

The synchronous pipe 53 is connected between the upper side surface (right front side in FIG. 5) of the hydraulic cylinder unit 41 and the lower side surface (left front side in FIG. 5) of the hydraulic cylinder unit 42 for allowing the oil under pressure to communicate with each pressure chamber. The synchronous pipe 54 is connected between the lower side surface of the hydraulic cylinder unit 41 and the upper side surface of the hydraulic cylinder unit 42 for allowing the oil under pressure to communicate with each pressure chamber.

The first and second oil supply units 31 and 32 are positioned in parallel with the working unit 30. The first oil supply unit 31 mainly comprises oil supply units 61 and 62 which have similar structure as the hydraulic cylinder units 41 and 42. A hollow oil supply rod 63 which is extended from or contracted into an end portion (right front side in FIG. 5) of the oil supply unit 61 is arranged in a direction opposite to a hollow oil supply rod 64 extending from or contracting into the end portion (left front side in FIG. 5) of the supply unit 62. The oil supply units 61 and 62 are arranged to extend up and down and are close to each other in the manner that axial lines of the oil supply units 61 and 62 are in parallel with each other. A band-shaped coupling joint 67 is fixed to peripheries of the oil supply units 61 and 62 at upper portions (right front side in FIG. 5) thereof, so that the oil supply units 61 and 62 are firmly held so as not to move relative to each other.

A block-shaped rod head 65 is coupled to an upper end (right front side in FIG. 5) of the oil supply rod 63, and it is coupled with the base arm 16. A port 116 is defined in the side surface of the rod head 65. An oil supply conduit 69 is connected to the port 116 for supplying the oil under pressure therethrough. A block 70 is fixed to the upper end (right front side in FIG. 5) of the supply unit 62, and it is coupled with the middle arm 19 by a pin. A block-shaped rod head 66 is coupled with the lower end of the oil supply rod 64, and it is coupled with the top arm 20 by a pin. A port 132 protrudes from the side surface of the rod head 66 for allowing the oil under pressure to flow from the oil supply rod 64 to the hydraulic cylinder units 25 and 26. A connecting conduit 68 is interposed between the upper side surface of the oil supply unit 61 and the upper side surface of the supply unit 62 for allowing the oil under pressure to flow therebetween.

The second oil supply unit 32 has substantially the same structure as the first oil supply unit 31. The second oil supply unit 32 comprises mainly oil supply cylinder units 71 and 72 which have substantially the same structures as the hydraulic cylinder units 41 and 42. The hollow oil supply rod 73 which is extended from and contracted into the end portion (right innermost side in FIG. 5) of the oil supply cylinder unit 71 is arranged in a direction opposite to the hollow oil supply rod 74 which is extended from and contracted into the end portion (left innermost side in FIG. 5 of unit 72). The oil supply cylinder units 71 and 72 are arranged up and down and are close to each other in the manner that axial lines of the oil supply units 71 and 72 are in parallel with each other. A band-shaped coupling joint 77 is fixed to peripheries of the oil supply units 71 and 72 at upper portions (right front side in FIG. 5) thereof, so that the oil supply units 71 and 72 are firmly held so as not to move relative to each other.

A block-shaped rod head 75 is connected to an upper end (right front side in FIG. 5) of the oil supply rod 73, and it is coupled with the base arm 16. A port 135 is defined in the side surface of the rod head 75. An oil supply conduit 79 is connected to the port 135 for supplying the oil under pressure therethrough. A block 80 is fixed to the upper end (right front side in FIG. 5) of the supply unit 72, and it is coupled with the middle arm 19 by a pin. A block-shaped rod head 76 is coupled with the lower end of the oil supply rod 74, and it is coupled with the top arm 20 by a pin. A port 136 protrudes from the side surface of the rod head 76 for allowing the oil under pressure to flow from the oil supply rod 74 to the hydraulic cylinder units 25 and 26. A connecting conduit 78 is interposed between the upper side surface of the oil supply unit 71 and the upper side surface of the supply unit 72 for allowing the oil under pressure to flow therebetween.

The hydraulic cylinders 41 and 42, the oil supply units 61 and 62 and the oil supply cylinder units 71 and 72 are respectively mounted in a manner that the axial lines thereof are all in parallel with one another. In a contracted state the working unit 30 and the first and second oil supply units 31 and 32 are all disposed substantially inside the top arm 20.

Figure 6:
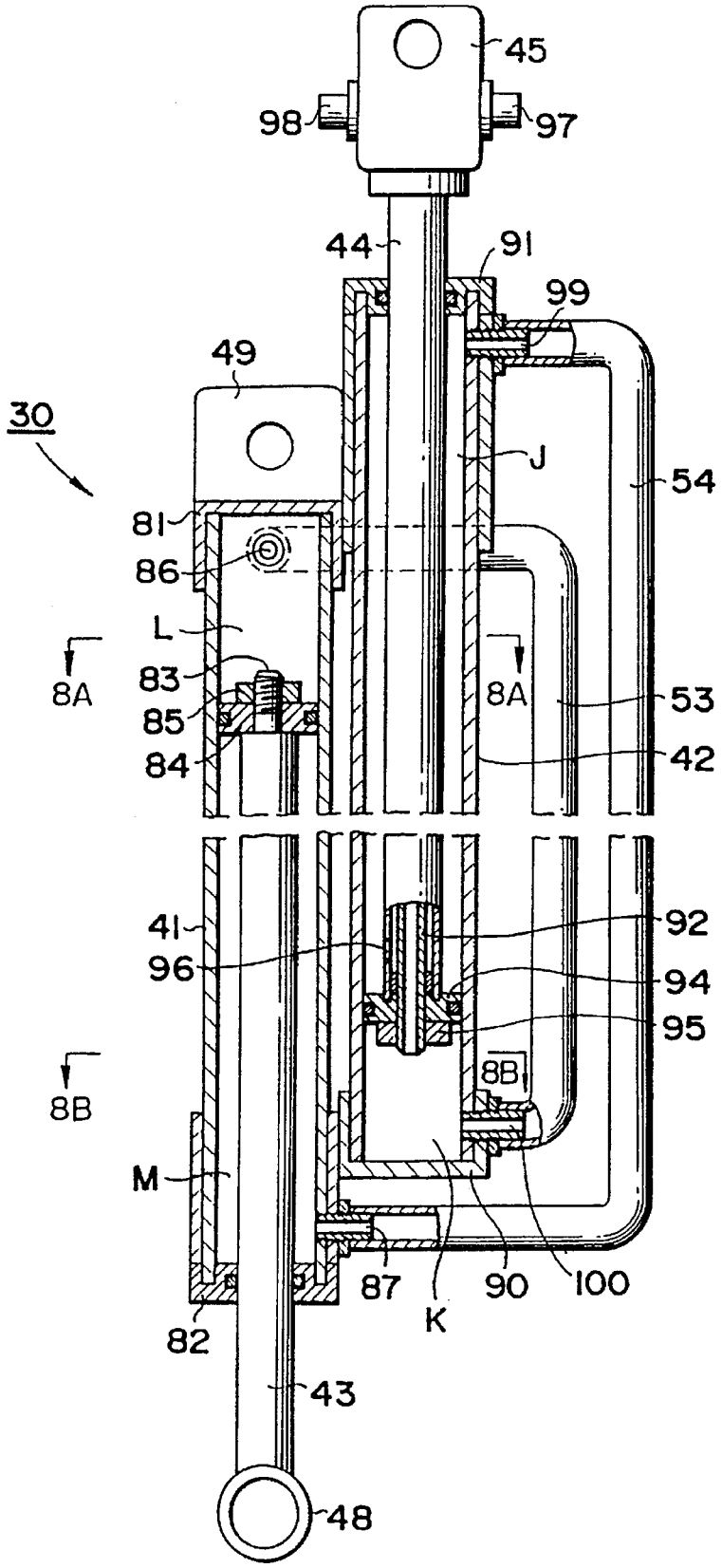
FIG. 6 is a partly cut away longitudinal cross-sectional view of the internal structure of the working unit of FIG. 5.
Figure 7:
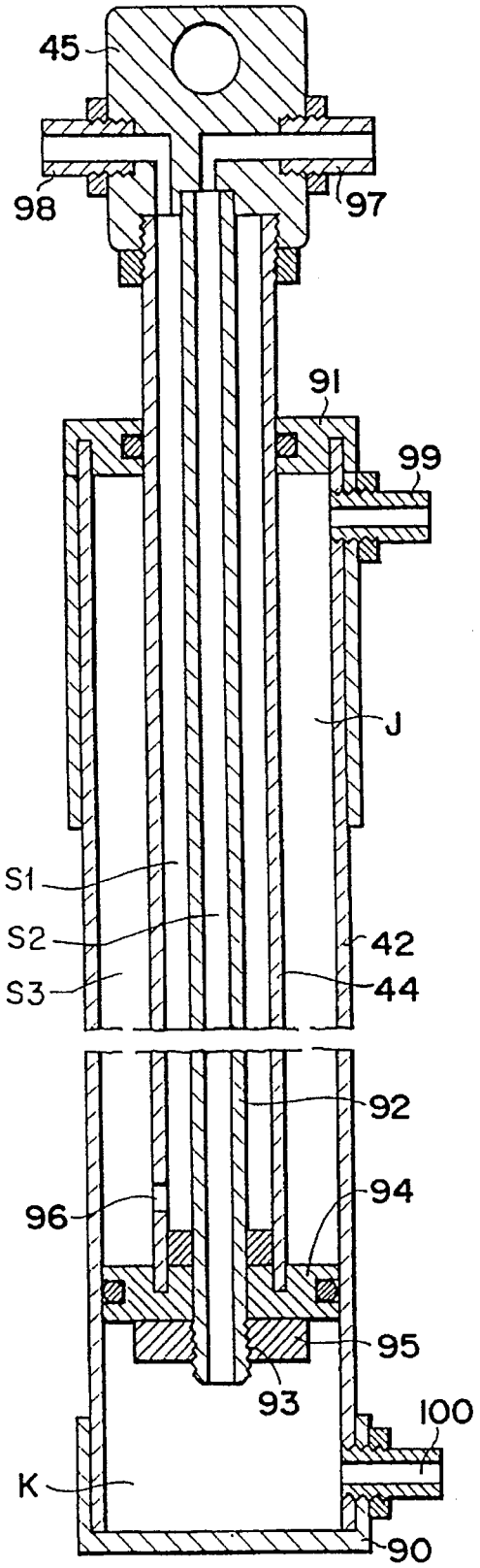
FIG. 7 is a longitudinal cross-sectional view showing an internal structure of the hydraulic cylinder unit used in the working unit of FIG. 5.

FIG. 6 shows an internal structure of the working unit 30 in which the hydraulic cylinder unit 41 and hydraulic cylinder unit 42 are cut in their longitudinal directions, and it shows a state where a part of the cylinder rod 44 is broken. The vertical direction of the working unit 30 in FIG. 6 is arranged to be the same as the vertical direction of the working unit 30 in FIG. 3. FIG. 7 is a cross-sectional view showing an inner portion of the one hydraulic cylinder unit 42 constituting the working unit 30. The structure of the working unit 30 will be now described with reference to FIGS. 6 and 7.

A main body of the hydraulic cylinder unit 41 is hollow and is circular pipe-shaped, and is opened at the upper and lower ends thereof. A closing cap 81 is engaged in the upper end opening of the hydraulic cylinder unit 41 so as to close the hydraulic cylinder unit 41 airtightly. A cap 82 having a sliding hole at the center thereof is engaged in the lower end opening of the hydraulic cylinder unit 41, and the cylinder rod 43 is airtightly inserted into the sliding hole of the sliding cap 82. The cylinder rod 43 is pipe-shaped, and a fixed bolt 83 having a screw at the outer periphery thereof is fixed to the upper end of the cylinder rod 43. A piston 84 airtightly slides along the inner peripheral surface of the hydraulic cylinder unit 41 and has a central opening through which the fixed bolt 83 is inserted. The fixed bolt 83 is threaded into a nut 85 from the upper surface of the piston 84, whereby the piston 84 is fixed to the upper end of the cylinder rod 43 by the nut 85. As mentioned above, the inner space of the hydraulic cylinder unit 41 is airtightly vertically divided into two chambers in which an upper part constitutes a pressure chamber L and a lower part constitutes a discharge chamber M.

A port 86 communicating with the pressure chamber L of the hydraulic cylinder unit 41 is defined in the upper side surface of the hydraulic cylinder unit 41. A port 87 communicating with the discharge chamber M of the hydraulic cylinder unit 41 is defined in the lower side surface of the hydraulic cylinder unit 41. One end of the synchronous pipe 53 is connected to the port 86, while one end of the synchronous pipe 54 is connected with the port 87.

A main body of the hydraulic cylinder unit 42 is hollow and is circular pipe-shaped and is opened at the upper and lower ends thereof like the hydraulic cylinder unit 41. A closing cap 90 is engaged in the lower end of the hydraulic cylinder unit 42, so as to close the hydraulic cylinder unit 42 airtightly. A cap 91 having a sliding hole at the center thereof is engaged in the upper end opening of the hydraulic cylinder unit 42. The cylinder rod 44 is airtightly slidably inserted into the sliding hole of the sliding cap 91. The cylinder rod 44 is pipe-shaped, and a middle pipe 92 having an outer diameter which is less than the inner diameter of the cylinder rod 44 is inserted into the cylinder rod 44. A screw portion 93 (i.e. a male screw) is defined at the lower end outer periphery of the middle pipe 92 (see FIG. 7). A piston 94 airtightly contacts and slides along the inner peripheral surface of the hydraulic cylinder unit 42. The screw portion 93 of the middle pipe 92 is inserted into an opening defined in the center of the piston 94, wherein the lower end of the cylinder rod 44 is brought into contact with the upper surface of the piston 94. Thereafter, a nut 95 is threaded on the screw portion 93 to fix the piston 94 to the middle pipe 92.

When the piston 94 is slidably inserted into the hydraulic cylinder unit 42, the inner space of the hydraulic cylinder unit 42 is vertically divided into two chambers, in which a lower part constitutes a pressure chamber K and an upper part constitutes a discharge chamber J. Further, there are defined three kinds of concentric spaces, namely a first space S1 defined within the inner peripheral surface of the cylinder rod 44, a second space S2 defined within the inner peripheral surface of the middle pipe 92, and a third space S3 defined within the inner peripheral surface of the body 42, which spaces are defined above the piston 94. A port 96 is defined in the lower portion of the cylinder rod 44 for allowing the spaces S1 and S3 to communicates with each other, so that the oil under pressure can flow between the discharge chamber J and the inner space S1.

The rod head 45 is airtightly coupled with the upper end of the cylinder rod 44, and at the same time the upper end of the middle pipe 92 is airtightly coupled with the rod head 45. Accordingly, the cylinder rod 44 and the upper end of the middle pipe 92 are concentrically fixed to the lower surface of the rod head 45, wherein the inner space S2 of the middle pipe 92 and the space S1 of the cylinder rod 44 are airtightly closed. The ports 97 and 98 protrude from both sides of the rod head 45. A shown in FIG. 7, the port 97 communicates with the inner space S2 of the middle pipe 92 by way of an oil passage, while the port 98 communicates with the ring-shaped space S1 defined between the inner peripheral surface of the cylinder rod 44 and an outer peripheral surface of the middle pipe 92. As shown in FIG. 5, the ports 97 is connected to the connecting conduit 56 while the port 98 is connected to the connecting conduit 57.

A port 99 protrudes from the upper side surface of the hydraulic cylinder unit 42 for communicating with the discharge chamber J, while a port 100 protrudes from the lower side surface of the hydraulic cylinder unit 42 for communicating with the pressure chamber K. The other end of the synchronous pipe 53 is connected with the port 100 so that the pressure chamber K of unit 42 and the pressure chamber L of the hydraulic cylinder unit 41 are allowed to communicate with each other. The other end of the synchronous pipe 54 is connected with the port 99 so that the discharge chamber J of unit 42 and the discharge chamber M of the hydraulic cylinder unit 41 are allowed to communicate with each other.

In such a manner, the working unit 30 is assembled. Inner and outer diameters of the hydraulic cylinders 41 and 42 constituting the working unit 30 are set as follows.

Figure 8A:
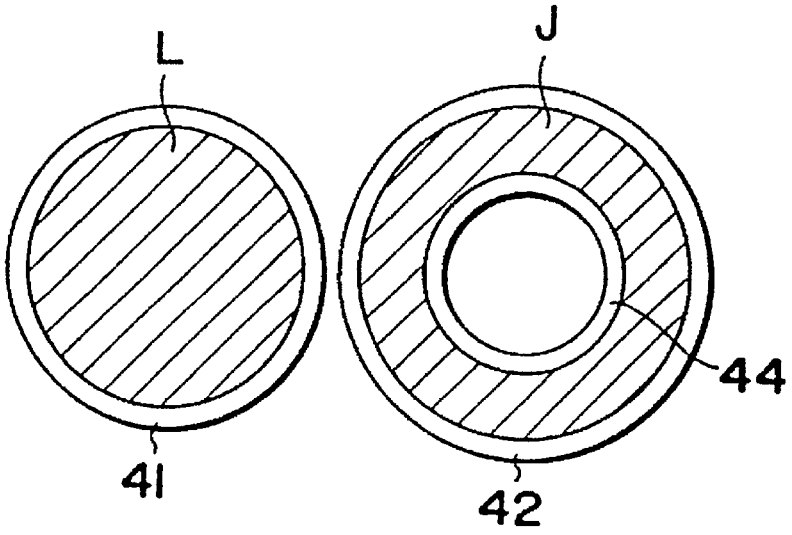
FIGS. 8A and 8B are side cross-sectional views of pressure application cross-sectional areas of the working unit as respectively taken along lines 8A—8A and 8B—8B in FIG. 6.
Figure 8B:
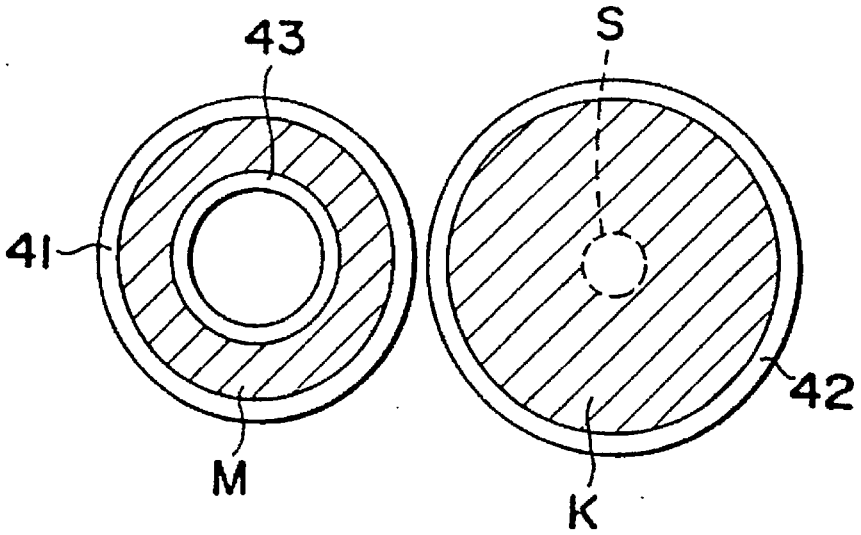

In FIG. 8A, the cross-sectional area of the pressure chamber L in the hydraulic cylinder unit 41 and that of the discharge chamber J in the hydraulic cylinder unit 42 are respectively represented by hatch lines. In FIG. 8B, the cross-sectional area of the discharge chamber M in the hydraulic cylinder unit 41 and that of the pressure chamber K in the hydraulic cylinder unit 42 are respectively represented by hatch lines. A cross-sectional area S of an inner periphery of the middle pipe 92 is represented by the broken line at the center of the cross-sectional area of the pressure chamber K in FIG. 8B. In such arrangement, the following expression is established between each cross-sectional area:

Discharge chamber area M + Discharge chamber area J = Pressure chamber area K − Cross-sectional area S = Pressure chamber area L The inner and outer diameters of the hydraulic cylinder units 41 and 42, the cylinder rods 43 and 44, and middle pipe 92 are preferably respectively set to establish the aforementioned expression. The reason for setting the inner and outer diameters having such a relation is that if these cross-sectional areas have such a relation, the cylinder rods 43 and 44 extended from and contracted into the hydraulic cylinder units 41 and 42 cannot slide in synchronization with each other at the same speed.

Figure 9:
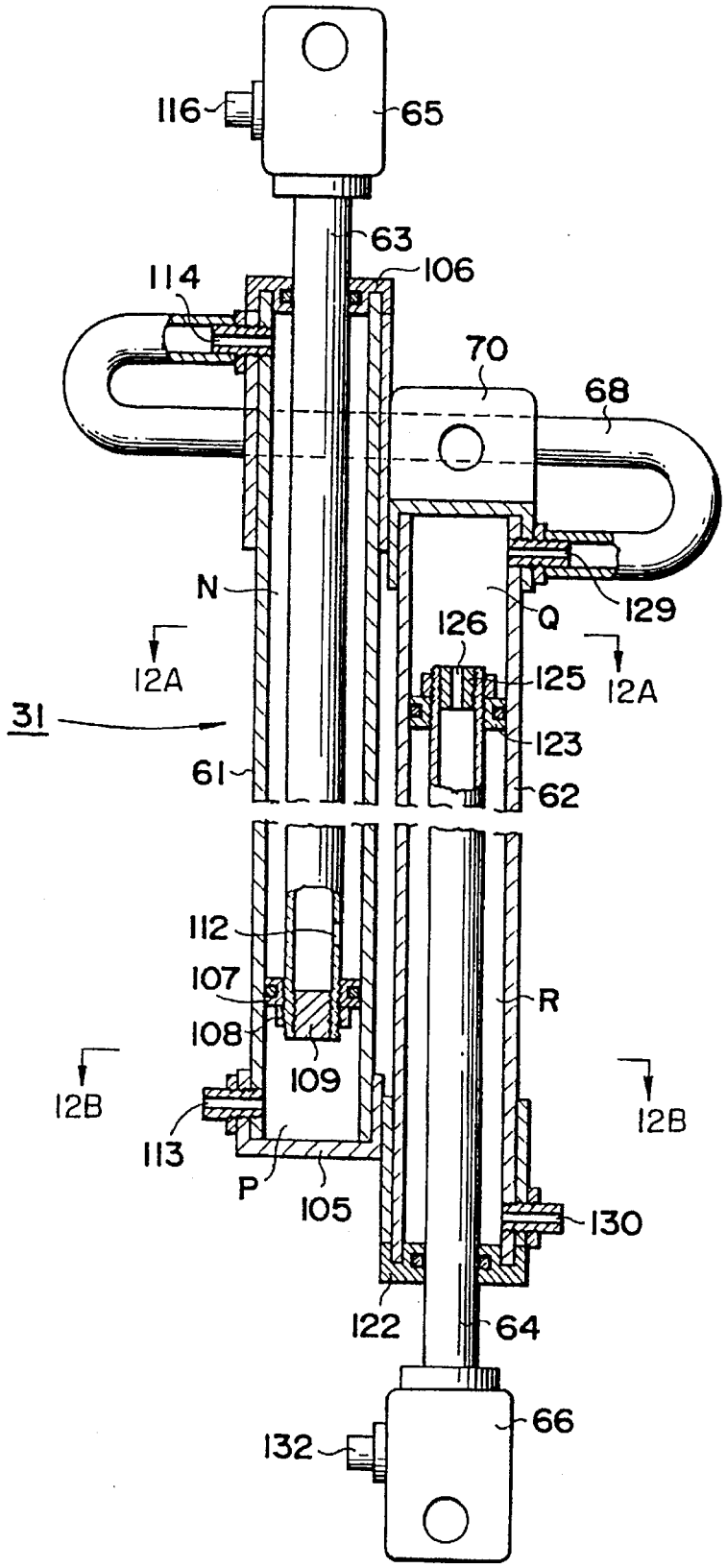
FIG. 9 is a partly cut away longitudinal cross-sectional view of the internal structure of one of the oil supply units in FIG. 5.
Figure 10:
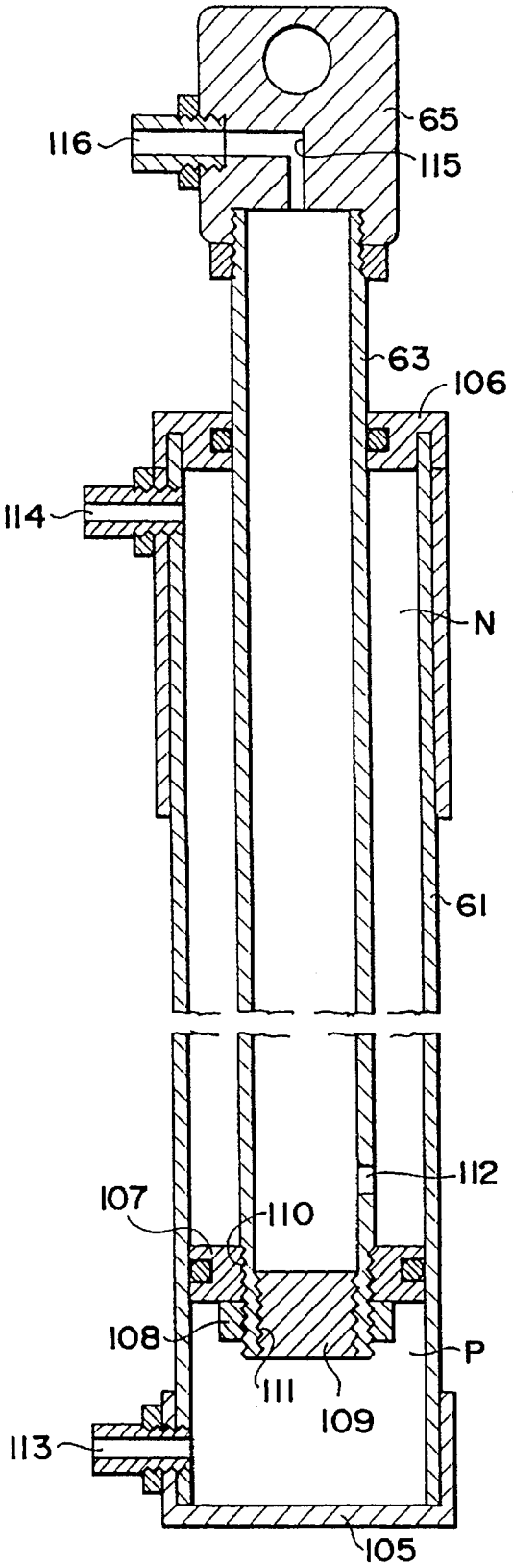
FIG. 10 is a longitudinal cross-sectional view showing an internal structure of one oil supply cylinder unit of the oil supply unit of FIG. 9.
Figure 11:
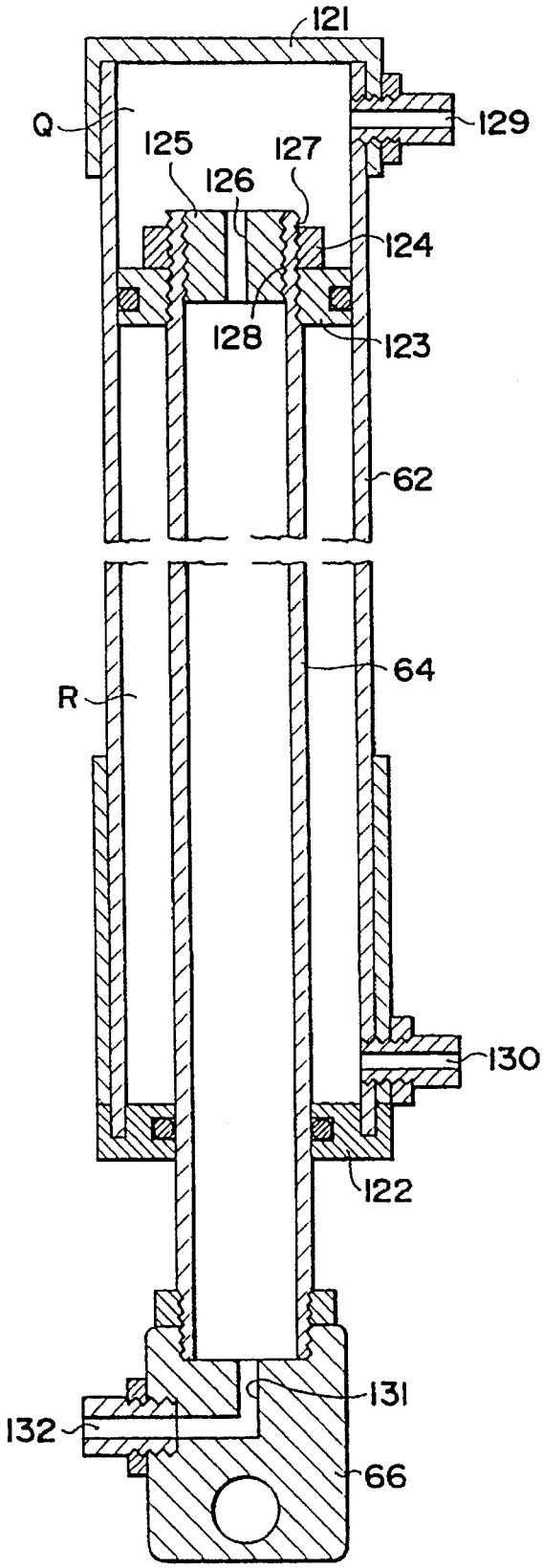
FIG. 11 is a longitudinal cross-sectional view showing an internal structure of the other oil supply cylinder unit of the oil supply unit of FIG. 9.

An arrangement of the first oil supply unit 31 will be now described with reference to FIGS. 9–12. In FIG. 9, the oil supply units 61 and 62 in the first oil supply unit 31 are cut vertical to show the inner portion thereof, wherein the lower portion of the oil supply rod 63 is partly broken and a part of the oil supply rod 64 is also broken. Since the arrangement of the second oil supply unit 32 is substantially the same as that of the first oil supply unit 31, a detailed explanation thereof is omitted. FIG. 10 is a cross-sectional view showing the oil supply unit 61 cut vertically. FIG. 11 is a cross-sectional view showing the oil supply unit 62 cut vertically. The first oil supply unit 31 can be well understood by alternately viewing FIGS. 9 through 11.

The oil supply unit 61 will be now described together with reference to FIG. 10. A main body of the hydraulic cylinder unit 61 is hollow and is circular pipe-shaped and is opened at the upper and lower ends thereof. A closing cap 105 airtightly closes the lower end of the hydraulic cylinder unit 61. A cap 106 having a sliding hole at the center thereof is engaged in the upper end opening of the hydraulic cylinder unit 61. The oil supply rod 63 is pipe-shaped, and has an outer screw portion 110 and an inner peripheral screw portion 111 at the lower end thereof. A piston 107 airtightly slides along the inner peripheral surface of the oil supply cylinder unit 61. The lower end of the oil supply rod 63 is inserted into the central opening of the piston 107. A nut 108 is threaded into the outer screw portion 110 to connect the piston 107 to the lower end of the oil supply rod 63.

A stopper 109 is threaded into the screw portion 111 to airtightly close the lower end of the oil supply rod 63. A port 112 is defined in the lower side surface of the oil supply rod 63 to allow the interior of the oil supply rod 63 to communicate with the chamber N. The piston 107 divides the inner space of the oil supply unit 61 into two airtight chambers, namely a discharge chamber N disposed outside the oil supply rod 63 over the piston 107 and a pressure chamber P under the piston 107. A port 113 protrudes from the lower side surface of the oil supply unit 61 for communicating with the pressure chamber P, and a port 114 protrudes from the upper side surface of the oil supply unit 61 for communicating with the discharge chamber N.

A block-shaped rod head 65 is fixed to the upper end of the oil supply rod 63, and the upper end of the oil supply rod 63 is airtightly closed by the rod head 65. The rod head 65 is coupled with the base arm 16 by a pin, and an oil passage 115 is defined in the rod head 65 for communicating with the interior of the oil supply rod 63. A distal end of the oil passage 115 communicates with port 116.

The arrangement of the supply unit 62 will be now described with reference to FIG. 11.

A main body of the hydraulic cylinder unit 62 is hollow and is circular pipe-shaped, and is opened at the upper and lower ends thereof. A closing cap 121 airtightly closes the upper end opening of the hydraulic cylinder unit 62. A cap 122 having a sliding hole at the center thereof is engaged in the lower end opening of the hydraulic cylinder unit 62, and the oil supply rod 64 is airtightly inserted into the sliding hole of the sliding cap 122. The cylinder rod 64 is pipe-shaped, and has an outer screw portion 127 and an inner screw portion 128 at the upper end thereof. A piston 123 airtightly slides along the inner peripheral surface of the hydraulic cylinder unit 62 and has a central opening through which the upper end of the rod head 65 is inserted. The outer screw portion 127 is threaded into a nut 124, whereby the piston 123 is fixed to the upper end of the cylinder rod 64.

A stopper 125 is threaded into the inner screw portion 128 provided at the upper end of the oil supply rod 64. A guide hole 126 vertically penetrates the center of the stopper 125. When the piston is inserted into the supply unit 62, the inner space of the supply unit 62 is divided into two airtight chambers, i.e. a pressure chamber Q disposed over the piston 123 and a discharge chamber R provided under the piston 123 and outside the supply rod 64. However, the pressure chamber Q and the interior of the supply rod 64 communicate with each other through the communication port 126 so that oil under pressure can flow therebetween. A port 129 protrudes from the upper side surface of the oil supply cylinder unit 62 for communicating with the pressure chamber Q, and a port 130 protrudes from the lower side surface of the oil supply cylinder unit 62 for communicating with the discharge chamber R.

A block-shaped rod head 66 is fixed to and airtightly closes the lower end of the oil supply rod 64. The rod head 66 is coupled with the top arm 20 by a pin, and an oil passage 131 is defined in the rod head 66 for communicating with the inner space of the oil supply rod 64. A distal end of the oil passage 131 communicates with a port 132 protruding from the side surface of the rod head 66.

The first oil supply unit 31 is assembled so that, as shown in FIG. 5, the oil supply units 61 and 62 are arranged close to each other such that the axial directions thereof are in parallel with each other, and the outer peripheries thereof are connected to each other by the coupling joint 67. One end of the connecting conduit 68 is connected to the port 114, and the other end is connected to the port 129, whereby the oil under pressure flows between the discharge chamber N and pressure chamber Q.

Figure 12A:
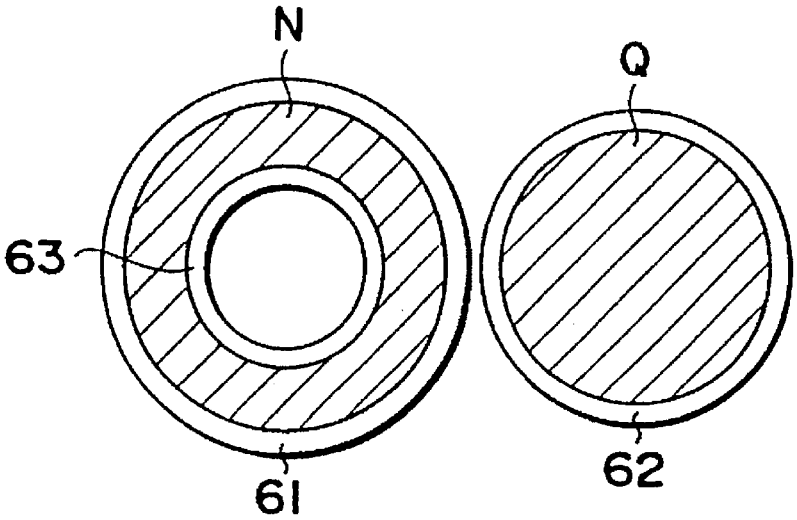
FIGS. 12A and 12B are side cross-sectional views showing pressure application cross-sectional areas of the oil supply unit as respectively taken along lines 12A—12A and 12B—12B in FIG. 9.

The inner and outer diameters of the oil supply units 61 and 62 constituting the first oil supply unit 31 will be now described with reference to FIGS. 12A and 12B.

Figure 12B:
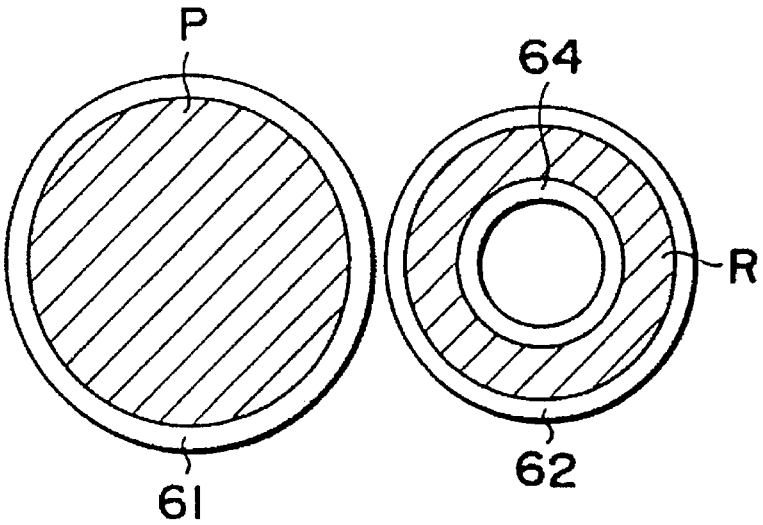

In FIG. 12B, the cross-sectional areas of the pressure chamber P in unit 61 and the discharge chamber R in unit 62 are hatched. In FIG. 12A, the cross-sectional areas of the discharge chamber N in unit 61 and the pressure chamber Q in unit 62 are hatched. In such arrangement the following expression is established between each cross-sectional area:

Discharge chamber area N = Pressure chamber area Q

Discharge chamber area R = Pressure chamber area P × (½)

That is, the inner and outer diameters of the oil supply units 61 and 62, and the oil supply rods 63 and 64, are set to meet the expression as set forth above, namely, they are set in the manner that the area of discharge chamber N is equal to the area of pressure chamber Q, and the area of discharge chamber R is one-half as large as the area of pressure chamber P. If the inner and outer diameters have no such or similar relation, load is not applied to the oil supply rods 63 and 64 which are extended from or contracted into the oil supply units 61 and 62, and the oil supply rods 63 and 64 cannot slide along the oil supply units 61 and 62.

Figure 13:
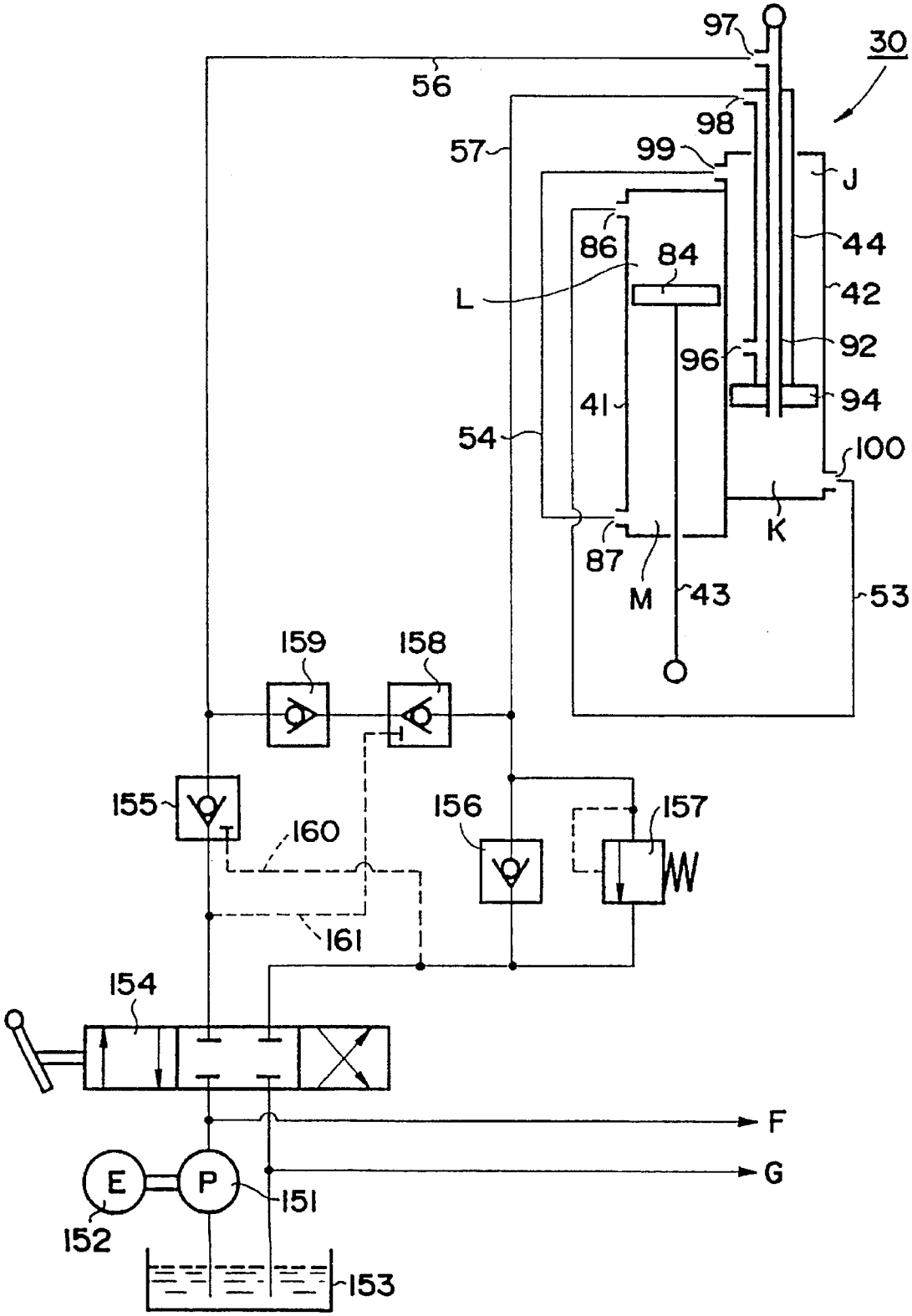
FIG. 13 is a diagrammatic view of a hydraulic system for supplying oil under pressure to the working unit of FIG. 3 according to the first embodiment of the invention.
Figure 14:
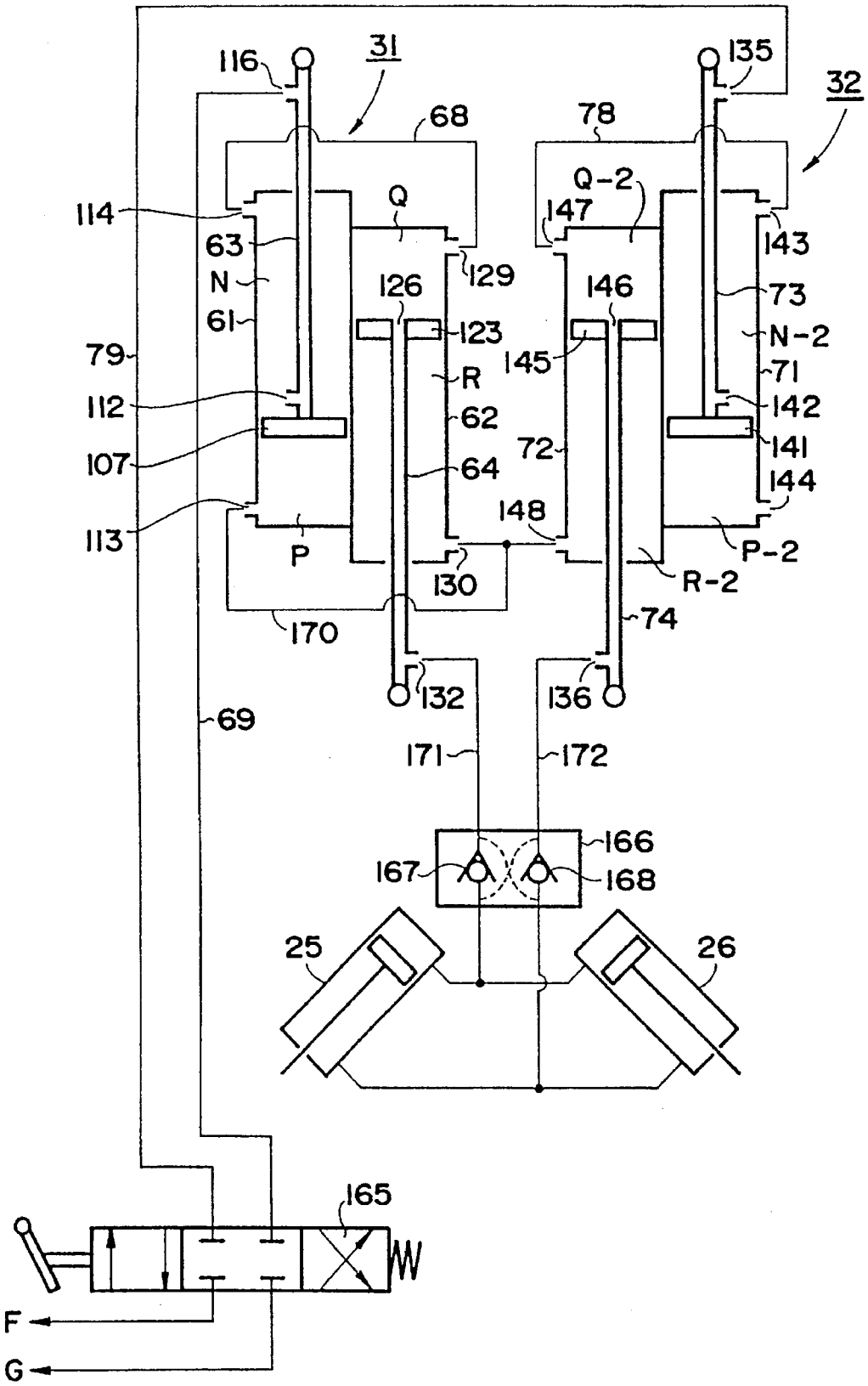
FIG. 14 is a diagrammatic view of a hydraulic system for supplying oil under pressure to the oil supply units of FIG. 3 according to the first embodiment of the invention.

FIG. 13 shows a circuit for supplying the oil under pressure to the working unit 30, and FIG. 14 shows a circuit for supplying the oil under pressure to the first and second oil supply units 31 and 32. The oil under pressure is supplied from the same pressure generating source in FIGS. 13 and 14.

The hydraulic circuit (FIG. 13) for supplying oil under pressure to the working unit 30 is first described. An engine 152 is accommodated in the turntable 13, and a hydraulic pump 151 is driven by the engine 152. A suction side of the hydraulic pump 151 communicates with an oil sump 153, and a discharge side thereof is connected to directional control valve 154. The directional control valve 154 can be switched to three stages or positions, namely, "neutral position", "normal position", and "reverse position", so as to freely control the supply of the oil under pressure. A discharge side of the directional control valve 154 is connected to the oil sump 153 so that the oil under pressure returns to the oil sump 153. A pilot check valve 155 is connected to one output side of the directional control valve 154, and an inline check valve 156 and a relief valve 157 are arranged in parallel with each other and connected to the other output side of the directional control valve 154. The ports 97 and 98 of the cylinder rod 44 are connected to the pilot check valve 155 by way of the connecting conduit 56, while the inline check valve 156 and relief valve 157 are arranged in parallel with each other and connected to the port 98 by way of the connecting conduit 57.

A pilot check valve 158 and an inline check valve 159 are arranged in series and connected between the connecting conduit 56 and 57, and they are arranged in a manner that the pressure control directions thereof are opposed to each other. Accordingly, even if the oil under pressure is supplied to the connecting conduit 56 or the connecting conduit 58 under normal pressure, the oil under pressure is set not to flow into the pilot check valve 158 and inline check valve 159 which are arranged in series. A pressure passage 160 connecting to the other output side of the directional control valve 154 is connected to a control port of the pilot check valve 155, and a pressure passage 161 connecting to one output side of the directional control valve 154 is connected to a control port of the pilot check valve 158.

In the connection of the components of the hydraulic circuit in the first oil supply unit 31, the port 87 of the hydraulic cylinder unit 41 is connected to the port 99 of the hydraulic cylinder unit 42 by the synchronous pipe 54 so that the oil under pressure can communicate between the ports 87 and 99. The port 86 of the hydraulic cylinder unit 41 and the port 100 of the hydraulic cylinder unit 42 are connected by the synchronous pipe 53 so that the oil under pressure can communicate between the ports 86 and 100. In FIG. 13, an oil passage as denoted by arrow F is connected to the discharge side of the hydraulic pump 151 so as to continue to the hydraulic circuit in FIG. 14, while an oil passage as denoted by arrow G is connected to the discharge side of the directional control valve 154 so as to continue to the hydraulic circuit in FIG. 14.

The hydraulic circuit for supplying the oil under pressure from the hydraulic pump 151 to the hydraulic cylinders 25 and 26 by the first and second oil supply units 31 and 32 will be now described with reference to FIG. 14. In FIG. 14, the arrows F and G are continued from those in FIG. 13, so that the oil under pressure can flow between the same arrows.

The arrows F and G continued from FIG. 13 are respectively connected to a directional control valve 165. The directional control valve 165 can be switched to three stages or positions, namely, "neutral position", "normal position," and "reverse position", so as to freely control the supply of the oil under pressure. The oil supply conduit 79 is connected to one output side of the directional control valve 165, and it is also connected to the port 135 of the oil supply rod 73. The oil supply conduit 69 is connected to the other output side of the directional control valve 165, and it is also connected to the port 116 of the oil supply rod 63. The ports 114 and 129 are connected to each other by the connecting conduit 68 so as to allow the oil under pressure therebetween. The ports 113 and 130 are connected to each other by a connecting conduit 170 so as to allow the oil under pressure to flow therebetween.

In the oil supply unit 32, a port 143 of the oil supply cylinder unit 71 and a port 147 of the oil supply cylinder unit 72 are connected to each other by the oil supply conduit 78 so as to allow the oil under pressure to flow therebetween. The connecting conduit 170 is connected to a port 148 so that the oil under pressure can commonly flow between the ports 113, 130 and 148. The port 144 of the oil supply cylinder unit 71 is opened to the atmosphere so that air can flow inside pressure chamber P-2.

One end of a connecting conduit 171 is connected to the port 132 of the oil supply rod 64, and the other end of the connecting conduit 171 is connected to the pressure chambers of the hydraulic cylinders 25 and 26 by way of a check valve 167 of a safety valve 166. One end of a connecting conduit 172 is connected to the port 136 of the oil supply rod 74, and the other end of the connecting conduit 172 is connected to the discharge chambers of the hydraulic cylinders 25 and 26 by way of a check valve 168 of the safety valve 166. The safety valve 166 is a double pilot check valve and comprises the pair of check valves 167 and 168 which are directed opposite to their passages. Pilot oil under pressure is alternatively connected to the check valves 1676 and 168 from another oil passage so that the oil under pressure supplied once to the hydraulic cylinders 25 and 26 are not returned therefrom.

Figure 15:
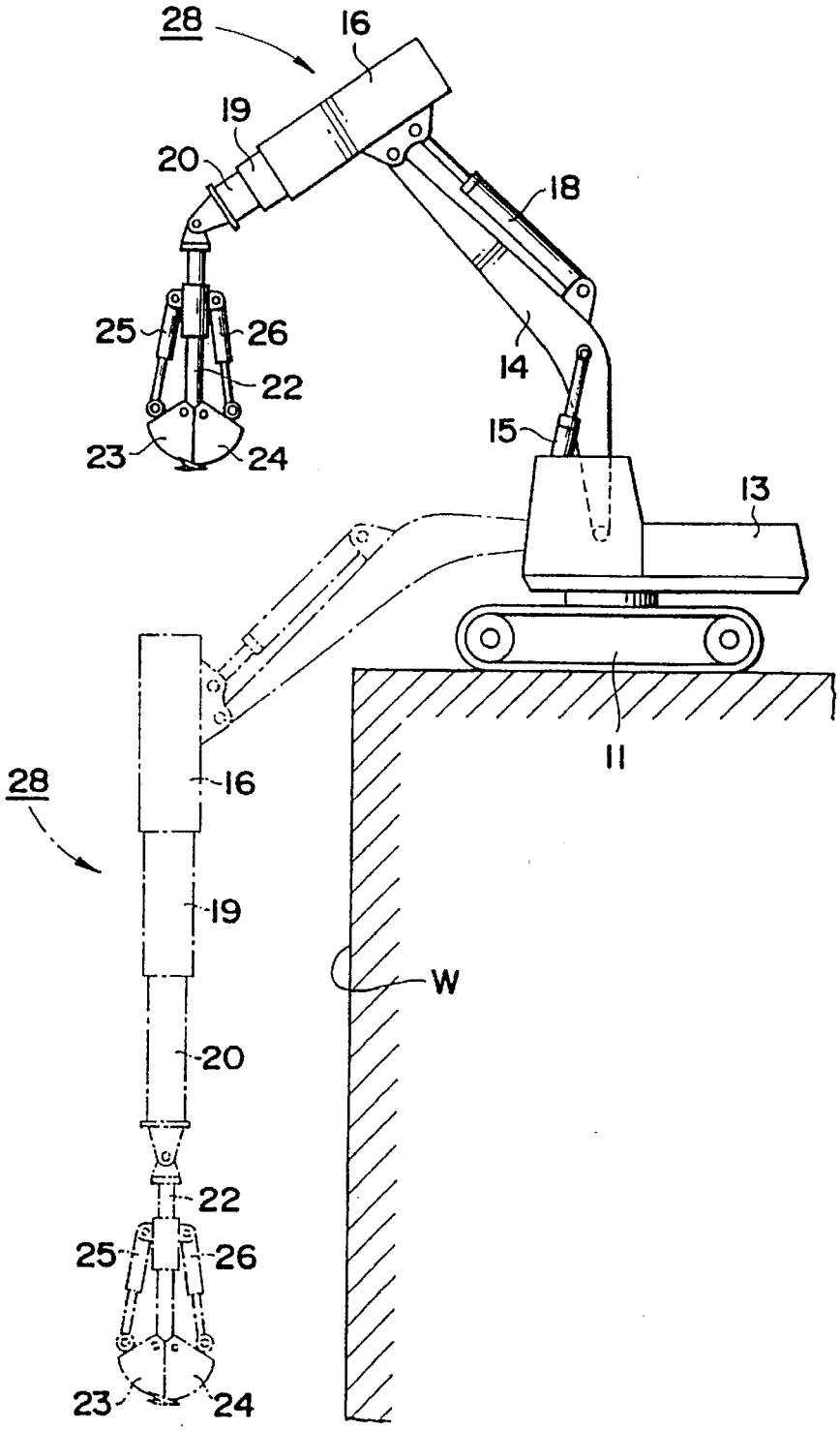
FIG. 15 is a view showing an operation of the deep excavator according to the first embodiment of the invention.

The operation of the first embodiment will now be described. As shown in FIG. 15, the excavating operation of the deep excavator for excavating the earth for forming the hole having a depth which is too long relative to its diameter will now be described.

The oil under pressure which is a driving source must be supplied to each mechanism for operating the deep excavator to perform its function. The engine 152 accommodated in the turntable 13 is actuated to drive the hydraulic pump 151 so as to suck the oil stored in the oil sump 153 by way of the hydraulic pump 151, then the oil is pressurized under appropriate pressure, and thereafter the oil under pressure is supplied to each mechanism of the deep excavator. The oil pressurized by the hydraulic pump 151 is simultaneously supplied to the hydraulic cylinder units and the hydraulic motor provided on the chassis 11 and the turntable 13. A circuit arrangement for the hydraulic units which are not directly connected to the present invention has been omitted in FIGS. 13 and 14.

The oil under pressure generated by the hydraulic pump 151 is controlled by an operating mechanism provided on the turntable 13. The oil under pressure is appropriately supplied to the hydraulic cylinder units 15 and 18 to change the inclination angle between the boom 14 and the stretchable arm arrangement 28. That is, the angle between the boom 14 with respect to the ground is changed by inclining the boom 14 relative to the turntable 13 when the hydraulic cylinder units 15 and 18 are extended and contracted. The base arm 16 is turned about the pin 17 to thereby incline the base arm 16 forward and backward so that the angle between the base arm 16 and the ground can be changed. Angular position of the stretchable arm arrangement 28 relative to the stretchable arm arrangement 28 and the height of the stretchable arm arrangement 28 from the ground can be respectively controlled by appropriately operating the hydraulic cylinder units 15 and 18. A state where the stretchable arm arrangement 28 is inclined to a higher position from the ground as shown in solid line in FIG. 15 is changed to a state where the stretchable arm arrangement 28 is hung downward perpendicularly to the ground and is inserted into the deep hole W as shown in broken line in FIG. 15. The changes of inclination angle and the position of the stretchable arm arrangement 28 relative to the ground are performed by an operating procedure which is conventionally employed.

In the deep excavator shown in solid lines in FIGS. 1 and 15, the length of the stretchable arm arrangement 28 is contracted to the minimum length. First, the thus contracted stretchable arm arrangement 28 is inserted into the deep hole W, then the stretchable arm arrangement 28 is extended in the deep hole W, and successively the shell buckets 23 and 24 are lowered downward. Thereafter, the shell buckets 23 and 24 are pushed downward until they reach bottom of the deep hole W so as to hold the earth and sand in the bottom of the deep hole W. The extending operation of the stretchable arm arrangement 28 can be operated by the working unit 30, namely, by pushing the middle arm 19 downward from the boom 14 and pushing the top arm 20 out from the middle arm 19.

In the extending operation, the directional control valve 154 is switched to the "normal position" for allowing the oil under pressure discharged from the hydraulic pump 151 to flow in the direction of the pilot check valve 155. Since the control direction of the pilot check valve 155 is set to the "normal position", the oil under pressure passes through the pilot check valve 155 as it is, then enters from port 97 into the middle pipe 92 by way of the connecting conduit 56, and flows through the middle pipe 92 into the pressure chamber K of the hydraulic cylinder unit 42. The oil under pressure entering the pressure chamber K brings about an operating force for pushing the piston 94 upward in FIGS. 6 and 13. At the same time when the piston 94 slides inside the hydraulic cylinder unit 42 and is pushed upward, the cylinder rod 44 coupled with the piston 94 is also pushed upward so that the cylinder rod 44 is pushed out from the sliding hole of the cap 91 engaged with the upper end of the hydraulic cylinder unit 42. Since the hydraulic cylinder unit 42 is coupled with the middle arm 19 and the cylinder rod 44 is fixed to the base arm 16, the sliding operation of the piston 94 extends the cylinder rod 44 which causes the base arm 16 to be pushed out from the middle arm 19.

A part of the oil under pressure entering the pressure chamber K from the lower end of the middle pipe 92 also flows into the synchronous pipe 53 from the port 100 then passes through the synchronous pipe 53, and it is successively introduced into the pressure chamber L of the hydraulic cylinder unit 41 from the port 86. The oil under pressure introduced into the pressure chamber L imposes an operating force for pushing the piston 84 downward in FIGS. 6 and 13. At the same time when the piston 84 slides downwardly inside the hydraulic cylinder unit 41, the cylinder rod 43 is also pushed downward, so that the cylinder rod 43 is pushed out from the cap 82 engaged in the lower end opening of the hydraulic cylinder unit 41. Since the hydraulic cylinder unit 41 is coupled with the middle arm 19 and the cylinder rod 43 is fixed to the top arm 20, when the oil under pressure is expanded in the pressure chamber L to slide the piston 84, the cylinder rod 43 is extended so that the middle arm 19 is pushed out from top arm 20.

With such a series of operation, the cylinder rods 44 and 43 are extended at the same time in opposite directions by the oil under pressure which enters the port 97 from the connecting conduit 56. The middle arm 19 is pulled out from the base arm 16 and the top arm 20 is pulled out from the middle arm 19 in synchronism with one another due to extensions of the cylinder rods 44 and 43, so that extending speed of the middle arm 19 and top arm 20 becomes the same. This is caused by the fact that the effective pressure application cross-sectional area (K–S) which is obtained by subtracting the inner diameter cross-sectional area S of the middle pipe 92 from the pressure chamber K in the hydraulic cylinder unit 42 is the same as the inner diameter cross-sectional area L of the hydraulic cylinder unit 41. The effective pressure application cross-sectional area (K–S) operates to push the piston 94 upward, and the cross-sectional area L operates the piston 84 downward. Since the pressures applied to the pistons 94 and 84 are the same. The sliding speed of the pistons 94 and 84 become the same if the value of the products obtains is multiplied by the cross-sectional area by the hydraulic pressure.

When the piston 94 slides upward in the hydraulic cylinder unit 42 in FIGS. 6 and 13, the oil under pressure remaining inside the discharge chamber J positioned over the piston 94 is compressed. However, if the oil under pressure is not escaped, the piston 94 cannot be moved. Since the port 96 is defined relative to the discharge chamber J, when the piston 94 is moved upwardly inside the hydraulic cylinder unit 42, the oil under pressure passes through the port 96 and enters the cylinder rod 44. Thereafter, the oil under pressure rises along the ring-shaped passage defined between the inner periphery of the cylinder rod 44 and the outer periphery of the middle pipe 92, then it is introduced into the connecting conduit 57 from the port 98, thereafter passes through the relief valve 157 and the directional control valve 154, and finally it returns the oil sump 153.

Since the piston 84 slides downward inside the hydraulic cylinder unit 41 in synchronism with the operation of the piston 94, the oil under pressure remaining inside the discharge chamber M positioned under the piston 84 is compressed. However, the oil remaining inside the discharge chamber M is discharged from the port 87 and enters the synchronous pipe 54. The oil under pressure passes through the synchronous pipe 54 and then it is introduced into the discharge chamber J of the hydraulic cylinder unit 42 through the port 99. In the discharge chamber J, the oil under pressure remaining therein is mixed with the oil from the discharge chamber M, then the mixed oil under pressure passes through the port 96, and also passes through the cylinder rod 44, the port 98, the connecting conduit 57, the relief valve 157 and the directional control valve 154, and finally is collected by the oil sump 153.

When the oil under pressure flows in the aforementioned passage, the oil under pressure is supplied to the pressure chambers K and L, and the cylinder rod 43 is pushed downward from the hydraulic cylinder unit 41 synchronously when the cylinder rod 44 is pushed upward from the hydraulic cylinder unit 42. At the same time, the oil under pressure remaining in the discharge chambers J and M flows outside the working unit 30, and is collected by the oil sump 153, so that oil, equal to the amount that is supplied to the pressure chambers K and L, is returned to the oil sump 153.

When the oil under pressure is supplied from the directional control valve 154 to the working unit 30, the cylinder rod 44 is pushed out from the hydraulic cylinder unit 42 so as to increase the distance between the base arm 16 and the middle arm 19, while the cylinder rod 43 is pushed out from the hydraulic cylinder unit 41 so as to increase the distance between the middle arm 19 and the top arm 20. The oil supply units 61 and 62 in the first oil supply unit 31 are coupled with the middle arm 19, and the rod head 65 provided at the tip end of the oil supply rod 63 is coupled with the base arm 16, and the rod head 66 provided at the tip end of the supply rod 64 is coupled with the top arm 20. The oil supply cylinder units 71 and 72 in the second oil supply unit 32 are coupled with the middle arm 19, and the rod head 75 provided at the tip end of the oil supply rod 73 is coupled with the base arm 16, and the rod head 76 provided at the tip end of the oil supply rod 74 is coupled with the top arm 20. Accordingly, when the working unit 30 starts the extending operation, the oil supply rod 63 is pulled out from the oil supply cylinder unit 61 due to the extending operation of the middle arm 19, and the oil supply rod 73 is pulled out from the oil supply cylinder unit 71. At the same time, the supply rod 64 is pulled out from the oil supply cylinder unit 62, and the oil supply rod 74 is pulled out from the oil supply cylinder unit 72 due to the extending operation of the top arm 20.

FIG. 14 explains the flow of the oil under pressure in the oil supply cylinder units 61 and 62 and the oil supply cylinder units 71 and 72, when the oil supply rods 63 and 64 and oil supply rods 73 and 74, are pulled out. In this explanation, the directional control valve 165 is in the "neutral position" so that the oil under press is not supplied to the first and second oil supply units 31 and 32. Even if the working unit 30 performs its extending operation when receiving the oil under pressure, the oil under pressure can be allowed to flow inside the first and second oil supply units 31 and 32 by controlling the directional control valve 165 at the same time, but this first embodiment omits such simultaneous operations.

When the oil supply rod 63 slides upwardly inside the oil supply cylinder unit 61, the piston 107 moved upward in FIG. 14, whereby the oil under pressure stored in the discharge chamber N enters the connecting conduit 68 through the port 114, and then moves inside the pressure chamber Q through the port 129. At this time, since the port 112 is open but the directional control valve 165 is closed in the "neutral position", the oil under pressure does not enter the oil supply rod 63 through the port 112. Viewed from the pressure application cross-sectional areas of the discharge chamber N and the pressure chamber Q, the cross-sectional areas N and Q are the same as each other, and the capacity of the oil under pressure flowing from the port 114 to the port 129, and the sliding speed of the piston 107 inside the oil supply cylinder unit 61 is the same as that of piston 123 in the oil supply cylinder unit 62. Accordingly, the drawing speed, pushing speed of the oil supply rod 63 out from the oil supply cylinder unit 61 is synchronous with the pushing speed of the supply rod 64 from the oil supply cylinder unit 62. At the result the pushing speed of the cylinder rod 43 out from the hydraulic cylinder unit 41 in the working unit 30 is synchronous with the pushing speed of the cylinder rod 44 out from the hydraulic cylinder unit 42.

When the oil supply rod 73 slides inside the oil supply cylinder unit 71, the piston 141 of unit 71 moves upward in FIG. 14, whereby the oil under pressure stored in a discharge chamber N-2 enters the connecting conduit 78, then enters the pressure chamber Q-2 through the port 147. At this time, since port 142 is opened but the directional control valve 165 is closed in the "neutral position", the oil under pressure does not enter the oil supply rod 73 through the port 142. Viewed from the relationship between the cross-sectional area of the discharge chamber N-2 and that of the pressure chamber Q-2, since the cross-sectional area N-2 is the same as the cross-sectional area Q-2 (the cross-sectional area N is the same as the cross-sectional area N-2, and the cross-sectional area Q is the same as the cross-sectional area Q-2, since the first oil supply unit 31 is the same as the second oil supply unit 32 in structure and shape), and the capacity of the oil under pressure flowing from the port 143 to the port 147, the sliding speed of the piston 141 inside the oil supply cylinder unit 71 is the same as that of the piston 145 inside the oil supply cylinder unit 72. Accordingly, the pushing speed of the oil supply rod 73 out from the oil supply cylinder unit 71 is allowed to be synchronous with pushing speed of the oil supply rod 74 out from the oil supply cylinder unit 72, so that the pushing speed of the cylinder rod 43 out from the hydraulic cylinder unit 41 is allowed to be synchronous with the pushing speed of the cylinder rod 44 out from the hydraulic cylinder unit 42.

Next, when the supply rod 64 slides downward in the oil supply cylinder unit 62 in FIG. 14, the oil under pressure in the discharge chamber R flows into the connecting conduit 170 from the port 130. At the same time, when the oil supply rod 74 slides downward in the oil supply cylinder unit 72 in FIG. 14, the oil under pressure in the discharge chamber R-2 flows into the connecting conduit 170 through port 148. Accordingly, the oil under pressure allowed to flow from the discharge chambers R and R-2 are merged into each other in the connecting conduit 170, and the merged oil under pressure enters the oil supply cylinder unit 61 through the port 113, and it is expanded in the pressure chamber P. The relation between the pressure application cross-sectional areas of the pressure chamber P, the discharge chamber R and the discharge chamber R-2 is shown in FIGS. 12A and 12B, in which the cross-sectional area of the discharge chamber R is half the cross-sectional area P of the pressure chamber P, and the cross-sectional area of the discharge chamber R-2 is half the cross-sectional area of the pressure chamber P (although the cross-sectional area R-2 is not shown in FIG. 12, the cross-sectional area R-2 is the same as the cross-sectional area R since the first oil supply unit 31 is the same as the second oil supply unit 32 in structure and shape). That is, the total of the cross-sectional area R and the cross-sectional area R-2 is equal to the cross-sectional area P so that the total of oil under pressure allowed to flow from the discharge chambers R and R-2 flows into the pressure chamber P. As a result, the pushing speed of the supply rod 64 out from the oil supply cylinder unit 62, the pushing speed of the oil supply rod 74 out from the oil supply cylinder unit 72, and the pushing speed of the oil supply rod 63 out from the oil supply cylinder unit 61 are all the same so that these speed are synchronous with each other. Even if the piston 141 slides upward in the pressure supply cylinder unit 71 in FIG. 14, the fresh air enters the pressure chamber P-2 through the port 144 without any resistance since the port 144 communicates with the atmosphere. As a result, no problem occurs even if the piston 141 moves.

With such a series of flow of the oil under pressure, the pushing speed of the oil supply rod 63 out from the oil supply cylinder unit 61 in the first oil supply unit 31 is synchronous with the pushing speed of the supply rod 64 out from the oil supply cylinder unit 62. The pushing speed of the oil supply rod 73 out from the oil supply cylinder unit 71 in the second oil supply unit 32 is synchronous with the pushing speed of the supply rod 74 out from the oil supply cylinder unit 72. As a result, the pushing speed of the supply rod 64 out from the oil supply cylinder unit 62 is synchronous with that of the oil supply rod 74 out from the oil supply cylinder unit 72, so that the pushing speed of the oil supply rods 63 and 64, and that of the oil supply rods 73 and 74 in the first and second oil supply units 31 and 32 are synchronous with one another.

When the oil under pressure is supplied from the directional control valve 154 to the working unit 30, the stretchable arm arrangement 28 is extended so that the middle arm 19 is pulled out from the base arm 16 and the top arm 20 is pulled out from the middle arm 19, and hence the entire length of the stretchable arm arrangement 28 is elongated. As shown by the chain lines in FIG. 15, if the shell buckets 23 and 24 coupled with the tip end of the top arm 20 reach the bottom of the deep hole W, the extending operation of the stretchable arm arrangement 28 must be stopped. Accordingly, the directional control valve 154 is returned or switched from the "normal position" to the "neutral position" so as to stop the supply of the oil under pressure from the hydraulic pump 151 to the connecting conduit 56. Since the oil under pressure which is already supplied is prevented from being allowed to flow back by the pilot check valve 155 and the inline check valve 156, it does not return to the directional control valve 154. As a result, the cylinder rods 43 and 44 in the working unit 30 are stopped while they are extended from the hydraulic cylinder units 41 and 42, and the stretchable arm arrangement 28 is stopped while it is extended.

When the shell buckets 23 and 24 reach the bottom of the deep hole W, the hydraulic cylinders 25 and 26 are contracted to thereby open or release the shell buckets 23 and 24 so that they hold the earth or sand therein.

In order to open or release the shell buckets 23 and 24 by contracting the hydraulic cylinders 25 and 26, the directional control valve 165 must be operated to be switched to the "normal position". When the directional control valve 165 is switched to the "normal position", the oil under pressure supplied from the arrow F extending from the hydraulic pump 151 flows into the oil supply conduit 79 and enters the oil supply rod 73 through the port 135. The oil under pressure flows through the oil supply rod 73, and enters the discharge chamber N-2 through the port 142. The thus entered oil under pressure is discharged from the port 143 without lowering the piston 141. Thereafter, the oil under pressure passes through the connecting conduit 78, then enters the pressure chamber Q-2 through the port 147, wherein the thus entered oil under pressure enters the oil supply rod 74 through the communication port 146. The oil under pressure inside the oil supply rod 74 flows out through the port 136 and enters the connecting conduit 172. Thereafter the oil under pressure pushes open the check valve 168, and then enters the discharge chambers of the hydraulic cylinders 25 and 26 so as to push the cylinder rods of the hydraulic cylinders 25 and 26 upwardly into the hydraulic cylinders 25 and 26. As a result, the shell buckets 23 and 24 as coupled to the cylinder rods of the hydraulic cylinders 25 and 26 are mutually turned to open the lower portions thereof, so that they can take the earth or sand therein from the bottom of the deep hole W through the lower end openings thereof.

When the hydraulic cylinders 25 and 26 are contracted, the oil under pressure is discharged from the upper pressure chambers of the hydraulic cylinders 25 and 26 and is directed toward the check valve 167. Since the check valve 167 is opened by checking pressure, i.e., oil under pressure prevented by the check valve 168 from being allowed to flow, the oil under pressure allowed to flow out from the hydraulic cylinders 25 and 26 is merged, and the thus merged oil under pressure passes through the check valve 167 and flows into the connecting conduit 171, and then enters the supply rod 64 through the port 132. The oil under pressure which enters the supply rod 64 further enters the pressure chamber Q of the oil supply cylinder unit 62 through the communication port 126, which however does not push the piston 123 downward but the oil flows out from the port 129, then flows into the connecting conduit 68 and finally enters the discharge chamber N of the oil supply cylinder unit 61 through the port 114. The oil under pressure which enters the discharge chamber N does not push the piston 107 downward in FIG. 14 but flows into the oil supply rod 63 through the port 112, then flows through the oil supply rod 63, and finally is discharged outside through the port 116. The oil under pressure flows out from the port 116 into the oil supply conduit 69, then passes through the directional control valve 165, and successively flows through passage G for return to the oil sump 153.

If the hydraulic cylinders 25 and 26 are contracted by switching the directional control valve 165 to the "normal position" for a given time so as to open or release the shell buckets 23 and 24 to the maximum angular interval therebetween, the operations of the hydraulic cylinders 25 and 26 must be stopped. Accordingly, the directional control valve 165 is returned or switched to the "neutral position" so as to stop the supply of oil under pressure from the hydraulic pump 151 to the port 135. When the supply of the oil under pressure is stopped, the check valves 167 and 168 are closed because of loss of the checking pressure, so that the oil under pressure once supplied does not flow back and is sealed inside the hydraulic cylinders 25 and 26. Accordingly, even if the supply of the oil under pressure from the hydraulic pump 151 is stopped, the hydraulic cylinders 25 and 26 remain contracted so that the shell buckets 23 and 24 remain open.

With a series of flow of the oil under pressure, the hydraulic cylinders 25 and 26 are contracted to open the lower portions of the shell buckets 23 and 24 so that they can take the earth or sand in the inner space thereof. However, a large quantity of earth or sand cannot be taken in the inner space of the shell buckets 23 and 24 by merely opening or releasing the shell buckets 23 and 24. Accordingly, the shell buckets 23 and 24 must be pushed downward toward the bottom of the deep hole W so as to take a large quantity of earth or sand therein.

In the pushing operation, the hydraulic cylinder units 15 and the hydraulic cylinder units 18 are operated while the shell buckets 23 and 24 remain opened, then the boom 14 is turned downward while the stretchable arm arrangement 28 remains extended downward as shown by broken lines in FIG. 15. As a result, the pushing force is applied to the stretchable arm arrangement 28. However, since the flow of the oil under pressure is prevented by the pilot check valve 155 and the inline check valve 156 in the hydraulic circuit in FIG. 13, the cylinder rods 43 and 44 in the working unit 30 remain extended without being pushed back by the hydraulic cylinder units 41 and 42. As a result, the turning force of the boom 14 becomes the pushing force of the stretchable arm arrangement 28 so as to press the shell buckets 23 and 24 against the bottom of the deep hole W. Accordingly, the shell buckets 23 and 24 which remain opened bite into the bottom of the deep hole W so that they can take a large quantity of earth or sand thereinto.

After the hydraulic cylinder units 15 and 16 are operated to lower the boom 14 downward, the supply of the oil under pressure to the hydraulic cylinder units 15 and 16 is stopped so as to complete the biting of the shell buckets 23 and 24. In a state where the shell buckets 23 and 24 remain biting into the bottom of the deep hole W, the next operation of the shell buckets 23 and 24 for taking the earth and sand into the shell buckets 23 and 24 is started.

When the directional control valve 165 is switched from the "neutral position" to the "reverse position", the oil under pressure supplied along the arrow or passage F from the hydraulic pump 151 flows into the oil supply conduit 69, and then enters the oil supply rod 63 through the port 116. The oil under pressure flows through the oil supply rod 63 and enters the discharge chamber N through the port 112. The thus entered oil under pressure is discharged out from the port 114 without lowering the piston 107. Then the oil under pressure passes through the connecting conduit 68, and enters the pressure chamber Q through the port 129 without lowering the piston 123, and thereafter the oil enters the supply rod 64 through the port 126. The oil under pressure, which flows through the supply rod 64, is discharged outside through the port 132 defined in the lower end of the supply rod 64, then flows into the connecting conduit 171, and successively opens the check valve 167. The oil under pressure then enters the upper pressure chambers of the hydraulic cylinder 25 and 26 so as to push out the cylinder rods of the hydraulic cylinder 25 and 26. Accordingly, the shell buckets 23 and 24 coupled with the cylinder rods of the hydraulic cylinders 25 and 26 are mutually turned in the closing direction to engage with each other at the tip ends thereof, and hence the opening defined by the shell buckets 23 and 24 is closed so that the earth or sand can be held by the shell buckets 23 and 24 at the bottom of the deep hole W.

When the cylinder rods of the hydraulic cylinders 25 and 26 are extended, the oil under pressure is discharged from the lower discharge chambers of the hydraulic cylinders 25 and 26, and it is directed toward the check valve 168. Since the check valve 168 is opened by the checking pressure from the connecting conduit 171, the oil under pressure is allowed to flow out from the hydraulic cylinders 25 and 26 and is merged, and the merged oil under pressure passes through the check valve 168, then enters the connecting conduit 172, and successively enters the oil supply rod 74 through the port 136. The oil under pressure, which enters the oil supply rod 74, enters the pressure chamber Q-2 of the oil supply cylinder unit 72 through the port 146 without lowering the piston 145 downward in FIG. 14, then flows out from the port 147, thereafter flows into the connecting conduit 78, and successively enters the discharge chamber N-2 of the pressure supply cylinder unit 71 through the port 143. However, the oil under pressure which enters the discharge chamber N-2 then flows into the oil supply rod 73 through the port 142 without lowering the piston 141 downward in FIG. 14, then flows into the oil supply rod 73, and thereafter is discharged out from the port 135. The oil under pressure, which flows out from the port 135, flows into the oil supply conduit 79, then flows in the direction denoted by the arrow G in FIG. 14 after passing the directional control valve 165, and it is finally returned to the oil sump 153, so that the oil under pressure, the amount of which is equal to that supplied from the oil pump 151, is collected by the oil sump 153.

After the directional control valve 165 is switched to the "reverse position" for a given time so that the hydraulic cylinders 25 and 26 perform extending operation to close the lower opening defined by the shell buckets 23 and 24, the operation of the hydraulic cylinders 25 and 26 must be stopped. In order to stop the operation of the hydraulic cylinders 25 and 26, the directional control valve 165 is returned to, i.e., positioned in the "neutral position" so as to stop the supply of the oil under pressure from the hydraulic pump 151 to the port 116. When the supply of the oil under pressure is stopped, the check valves 167 an 168 are respectively closed because of the loss of checking pressure, the oil under pressure once supplied does not flow back and it is sealed inside the hydraulic cylinders 25 and 26. Accordingly, even if the supply of the oil under pressure from the hydraulic pump 151 is stopped, the hydraulic cylinders 25 and 26 remain extended so that the shell buckets 23 and 24 engage with each other at the close thereof, and remain holding the earth and sand from the deep hole W.

In order to vertically pull out the shell buckets. 23 and 24 upward from the bottom of the deep hole W as shown in broken lines in FIG. 15, the stretchable arm arrangement 28 must be contracted. The working unit 30 is operated so as to contract the middle arm 19 inside the base arm 16 and to also contract the top arm 20 inside the middle arm 19.

To start the contracting operation, the directional control valve 154 in FIG. 13 is switched from the "neutral position" to the "reverse position" so that the oil under pressure discharged from the hydraulic pump 151 is allowed to flow toward the inline check-valve 156. Since the directional control of the inline check valve 156 is positioned in the "normal position", the oil under pressure passes through the inline check valve 156, and then enters the cylinder rod 44 from the port 98 through the connecting conduit 57, and then flows in the space defined between the outside of the middle pipe 92 and the inside of the cylinder rod 44, thereafter flows into the discharge chamber J of the hydraulic cylinder unit 42 through the port 96. The oil under pressure, which enters the discharge chamber J of the hydraulic cylinder unit 42, is expanded inside the discharge chamber J so as to bring about an operating force to push the piston 94 downward in FIGS. 6 and 13. At the same time when the piston 94 slides downwardly inside the hydraulic cylinder units 42, the cylinder rod 44 is also pushed downwardly into the hydraulic cylinder unit 42. Since the hydraulic cylinder unit 42 is coupled with the middle arm 19 and the cylinder rod 44 is fixed to the base arm 16, when the oil under pressure is expanded in the discharge chamber J, the sliding operation of the piston 94 narrows a distance between the hydraulic cylinder unit 42 and the cylinder rod 44, whereby the middle arm 19 is pulled into the base arm 16.

At the same time, a part of the oil under pressure, which enters from the lower end of the middle pipe 92 to the discharge chamber J, flows into the synchronous pipe 54 through the port 99, then enters the discharge chamber M of the hydraulic cylinder unit 41 through the port 87. Since the oil entering the discharge chamber M is expanded, this creates an operating force for pushing the piston 84 upward in FIGS. 6 and 13. At the same time the cylinder rod 43 is contracted into the hydraulic cylinder unit 41. Since the hydraulic cylinder unit 41 is coupled with the middle arm 19, and the cylinder rod 43 is fixed to the top arm 20, the upward sliding of the piston 84 narrows the interval between the hydraulic cylinder unit 41 and the cylinder rod 43, whereby the top arm 20 is pulled into the middle arm 19.

With such series of operation, the cylinder rods 44 and 43 are contracted at the same time in opposite directions by the oil under pressure which enters from the connecting conduit 57 through the port 98. The middle arm 19 is pulled into the base arm 16, and the top arm 20 is pulled into the middle arm 19 with the operations of the cylinder rods 44 and 43, and the contracting speed of both the cylinder rods 44 and 43 is the same. This is caused by the fact that the ring-shaped cross-sectional area J defined between the inner side of the hydraulic cylinder unit 42 and the outside of the cylinder rod 44 is the same as the cross-sectional area M defined between the inner side of the hydraulic cylinder unit 41 and the outside of the cylinder rod 43. The cross-sectional area J pushes the piston 94 downward and the cross-sectional area M pushes the piston 84 upward so that pressure applied to the pistons 94 and 84 is the same, and hence the sliding speed of the pistons 94 and 84 becomes the same.

When the piston 94 slides downward in the hydraulic cylinder unit 42 in FIGS. 6 and 13, the oil under pressure remaining inside the pressure chamber K positioned under the piston 94 is compressed. However, since the lower end of the middle pipe 92 is opened relative to the pressure chamber K when the piston 94 slides downwardly inside the hydraulic cylinder unit 42, the oil under pressure flows through the middle pipe 92 and moves upwardly, and then enters the connecting conduit 56 through the port 97. Thereafter the oil under pressure passes through the connecting conduit 57 and the pilot check valve 155, and is returned to the oil sump 153.

Since the piston 84 slides upward inside the hydraulic cylinder unit 41 in synchronism with the operation of the piston 94, the oil under pressure remaining inside the pressure chamber L positioned over the piston 84 is compressed, and the remaining oil under pressure is discharged through the port 86 and enters the synchronous pipe 53. The oil then enters the pressure chamber K of the hydraulic cylinder unit 42 through the port 100. In the pressure chamber K, the previously remained oil under pressure is mixed with the oil under pressure which enters from the pressure chamber L, and the mixed oil under pressure passes through middle pipe 92 and through the port 97 into the connecting conduit 56, then through the pilot check valve 155 and the directional control valve 154 and is returned to the oil sump 153.

When the oil under pressure flows as mentioned above, the oil under pressure is supplied to the discharge chamber J and the discharge chamber M so that the cylinder rod 43 is pushed into the hydraulic cylinder unit 41 in synchronism with the pushing operation of the cylinder rod 44 into the hydraulic cylinder unit 42. At the same time, the oil under pressure which remains in the pressure chambers L and K, flows outside the working unit 30 and is collected by the oil sump 153, and the amount of oil which is supplied to the discharge chambers J and M is the same as the amount returned to the oil sump 153 from the pressure chambers K and L.

When the oil under pressure is supplied from the directional control valve 154 to the working unit 30, the cylinder rod 44 is pushed into the hydraulic cylinder unit 42 so as to reduce the distance between the base arm 16 and middle arm 19, and the cylinder rod 43 is pushed into the hydraulic cylinder unit 41 so as to reduce the distance between the middle arm 19 and the top arm 20. Whereupon, the oil supply cylinder units 61 and 62 in the first oil supply unit 31 are coupled with the middle arm 19, and the rod head 65 provided at the tip end of the oil supply rod 63 is coupled with the base arm 16, and the rod head 66 provided at the tip end of the supply rod 64 is coupled with the top arm 20. Further, the oil supply cylinder units 71 and 72 in the second oil supply unit 32 are coupled with the middle arm 19, and the rod head 75 provided at the tip end of the oil supply rod 73 is coupled with the base arm 16, and the rod head 76 provided at the tip end of the oil supply rod 74 is coupled with the top arm 20. Accordingly, when the working unit 30 starts the contacting operation, the oil supply rod 63 is pushed into the oil supply cylinder unit 61 by the contracting operation of the middle arm 19 and the oil supply rod 73 is also pushed into the pressure supply cylinder unit 71. At the same time, the supply rod 64 is pushed into the oil supply cylinder unit 62 by the contracting operation of the top arm 20 and the oil supply rod 74 is pushed into the oil supply cylinder unit 72.

The flow of the oil under pressure in the oil supply cylinder units 61 and 62 and the oil supply cylinder units 71 and 72, when the oil supply rods 63 and 64, and 73 and 74, are pushed into the respective oil supply cylinder units, will be now explained with reference to FIG. 14. In this explanation, the directional control valve 165 remains positioned in the "neutral position", and hence oil under pressure is not supplied from the hydraulic pump 151 to the first and second oil supply units 31 and 32 in order to maintain the state where the shell buckets 23 and 24 are closed so as to hold the earth and sand therein.

When the oil supply rod 63 slides inside the cylinder unit 61, the piston 107 moves downward in FIG. 14 so that the oil under pressure stored in the pressure chamber P flows through port 113 into the connecting conduit 170, and is then through the ports 130 and 148 into the discharge chambers R and R-2, where it is expanded. As to the relationship between the cross-sectional area of the pressure chamber P, the discharge chamber R and the discharge chamber R-2 as shown in FIGS. 12A and 12B, namely the cross-sectional area of the discharge chambers R and R-2 each is half of the cross-sectional area of the pressure chamber P. That is, since the total of the cross-sectional area R and R-2 is equal to the cross-sectional area P, the pushing speed of the supply rod 64 into the oil supply cylinder unit 62 and the pushing speed of the oil supply rod 74 into the oil supply cylinder unit 72, and the pushing speed of the oil supply rod 63 into the oil supply cylinder unit 61 are the same, so that these speeds are synchronous with one another.

When the supply rod 64 slides inside the oil supply cylinder unit 62, the piston 123 moves upward in FIG. 14, the oil under pressure stored in the pressure chamber Q enters the connecting conduit 68 through the port 129, and moves inside the discharge chamber N of the oil supply cylinder unit 61 through the port 114. Accordingly, the oil under pressure in the pressure chamber Q enters the discharge chamber N and is expanded therein. At this time, since the port 112 is opened but the directional control valve 165 is closed while positioned in the "neutral position", the oil under pressure does not enter the oil supply rod 63 through the port 112. When the pressure in the pressure chamber Q is increased, the oil under pressure is likely to tend to flow toward the supply rod 64 through the port 126, but it cannot flow in this direction since the check valve 167 is arranged directed toward the "reverse position".

Viewing the relation between the pressure chamber Q and discharge chamber N, since the cross-sectional areas of discharge chamber N and Q are the same, and the capacity of the oil under pressure flowing from the port 129 to the port 114 is the same, the sliding speed of the piston 123 in the oil supply cylinder unit 62 is the same as that of the piston 107 in the oil supply cylinder unit 61. Accordingly, the pushing speed of the supply rod 64 into the oil supply cylinder unit 62 is synchronous with that of the oil supply rod 63 into the oil supply cylinder unit 61 so that the pushing speed of the cylinder rod 43 into the hydraulic cylinder unit 41 in the working unit 30 is synchronous with that of the cylinder rod 44 into the hydraulic cylinder unit 42.

Further, when the oil supply rod 74 slides inside the oil supply cylinder unit 72, the piston 145 moves upward in FIG. 14, the oil under pressure stored in the pressure chamber Q-2 enters the connecting conduit 78 through the port 147, then moves to the discharge chamber N-2 where it is expanded. At this time, since the port 142 is opened but the directional control valve 165 is closed in the "neutral position", the oil under pressure does not enter the oil supply rod 73 through the port 142. When the pressure in the pressure chamber Q-2 is increased, the oil under pressure is likely to tend to flow toward the oil supply rod 74 through the port 146, but is cannot flow through the oil supply rod 74 since the check valve 168 is directed toward the "reverse position".

Viewing the relationship between the cross-sectional area of the discharge chamber N-2 and that of the pressure chamber Q-2, since the cross-sectional area N-2 is the same as the cross-sectional area Q-2 and the capacity of the oil under pressure flowing from the port 143 to the port 147 is the same, the sliding speed of the piston 141 inside the pressure supply cylinder unit 71 is the same as that of the piston 145 into the oil supply cylinder unit 72. Accordingly, the pushing speed of the oil supply rod 73 out from the pressure supply cylinder unit 71 is allowed to be synchronous with that of the oil supply rod 74 out from the oil supply cylinder unit 72. As a result, the pushing speed of the cylinder rod 43 out from the hydraulic cylinder unit 41 in the working unit 30 is allowed to be synchronous with that of the cylinder rod 44 out from the hydraulic cylinder unit 42.

Even if the piston 141 slides downward inside the pressure supply cylinder unit 71 in FIG. 14, there is no problem since the air remaining in the pressure chamber P-2 flows out to the atmosphere without any resistance because the port 144 communicates with the atmosphere.

With such a series of flow of the oil under pressure, the pushing speed of the oil supply rod 63 into the oil supply cylinder unit 61 in the first oil supply unit 31 is synchronous with that of the Supply rod 64 into the oil supply cylinder unit 62. Further, the pushing speed of the oil supply rod 73 into the oil supply cylinder unit 71 in the second oil supply unit 32 is synchronous with that of the supply rod 74 into the oil supply cylinder unit 72. Still further, the pushing speed of the supply rod 64 into the oil supply cylinder unit 62 is synchronous with that of the oil supply rod 74 into the oil supply cylinder unit 72. Accordingly, the speeds of the oil supply rods 63 and 64 in the first oil supply unit 31 are synchronous with those of the oil supply rods 73 and 74 in the second oil supply unit 32.

When the directional control valve 154 is switched to the "reverse position" so as to supply the oil under pressure to the working unit 30, the stretchable arm arrangement 28 is contracted so that the middle arm 19 is pulled into the base arm 16 and the top arm 20 is pulled into the middle arm 19, so that the entire length of the stretchable arm arrangement 28 is contracted. When the stretchable arm arrangement 28 is changed from a state where it is extended as shown by chain lines in FIG. 15 to a state where it is contracted to the minimum length as shown by solid lines in FIGS. 1 and 15, the stretchable arm arrangement 28 must stop its contracting operation. The directional control valve 154 is returned to or switched to the "neutral position" from the "reverse position" to supply the oil under pressure from the hydraulic pump 151 to the relief valve 157 for stopping the contracting operation of the stretchable arm arrangement 28. Since the oil under pressure which has been already supplied to the working unit 30 is prevented from flowing back by the pilot check valve 155 and the inline check valve 156, it does not return toward the directional control valve 154, so that the cylinder rods 43 and 44 in the working unit 30 are accommodated and contracted into the hydraulic cylinder units 41 and 42.

When the stretchable arm arrangement 28 is contracted to its minimum length, the stretchable arm arrangement 28 is raised from the deep hole W, and the shell buckets 23 and 24 must be pulled out from the deep hole W to the ground because the earth or sand held by the shell buckets 23 and 24 in the deep hole W must be discharged and transferred to a bed of a truck which is near the construction site. This operation can be performed when the operating mechanism on the turntable 13 controls the oil under pressure so as to supply the oil under pressure to the hydraulic cylinder units 15 and 18. That is, when the oil under pressure is supplied to the hydraulic cylinder units 15 and 18 to thereby extend or contract thereof, the angular interval between the boom 14 and the stretchable arm arrangement 28 is varied so as to pull up the stretchable arm arrangement 28 vertically from the deep hole W while the stretchable arm arrangement 28 does not contact the inner wall of the deep hole W, then the shell buckets 23 and 24 can be pulled out outside the deep hole W. This state is shown by the solid lines in FIG. 15. The operation to pull out the stretchable arm arrangement 28 can be performed by the conventional operating procedure.

If the shell buckets 23 and 24 are pulled out over the ground as shown by the solid lines in FIG. 15, the turntable 13 is turned about the chassis 11 so as to swing the hydraulic cylinder units 18 and the stretchable arm arrangement 28, then the shell buckets 23 and 24 are moved over the bed of the truck or the like. Thereafter, the lower portions of the shell buckets 23 and 24 are opened to discharge the earth or sand on the bed of the truck or the like.

In order to perform such a discharging operation, a procedure which is reverse to the procedure for closing the shell buckets 23 and 24 is taken. That is, when the directional control valve 165 is switched to the "normal position", the shell buckets 23 and 24 are turned to open the lower portions thereof. When the lower portions of the shell buckets 23 and 24 are opened, the earth or sand accommodated in the shell buckets 23 and 24 drops due to its weight and is accumulated on the bed of the truck or the like. With such a series of operations, it is possible to withdraw the earth or sand from the hole W having a depth which is too long relative to its diameter, and possible to excavate the ground downward much deeper.

Second Embodiment (FIGS. 16 to 29)

Figure 16:
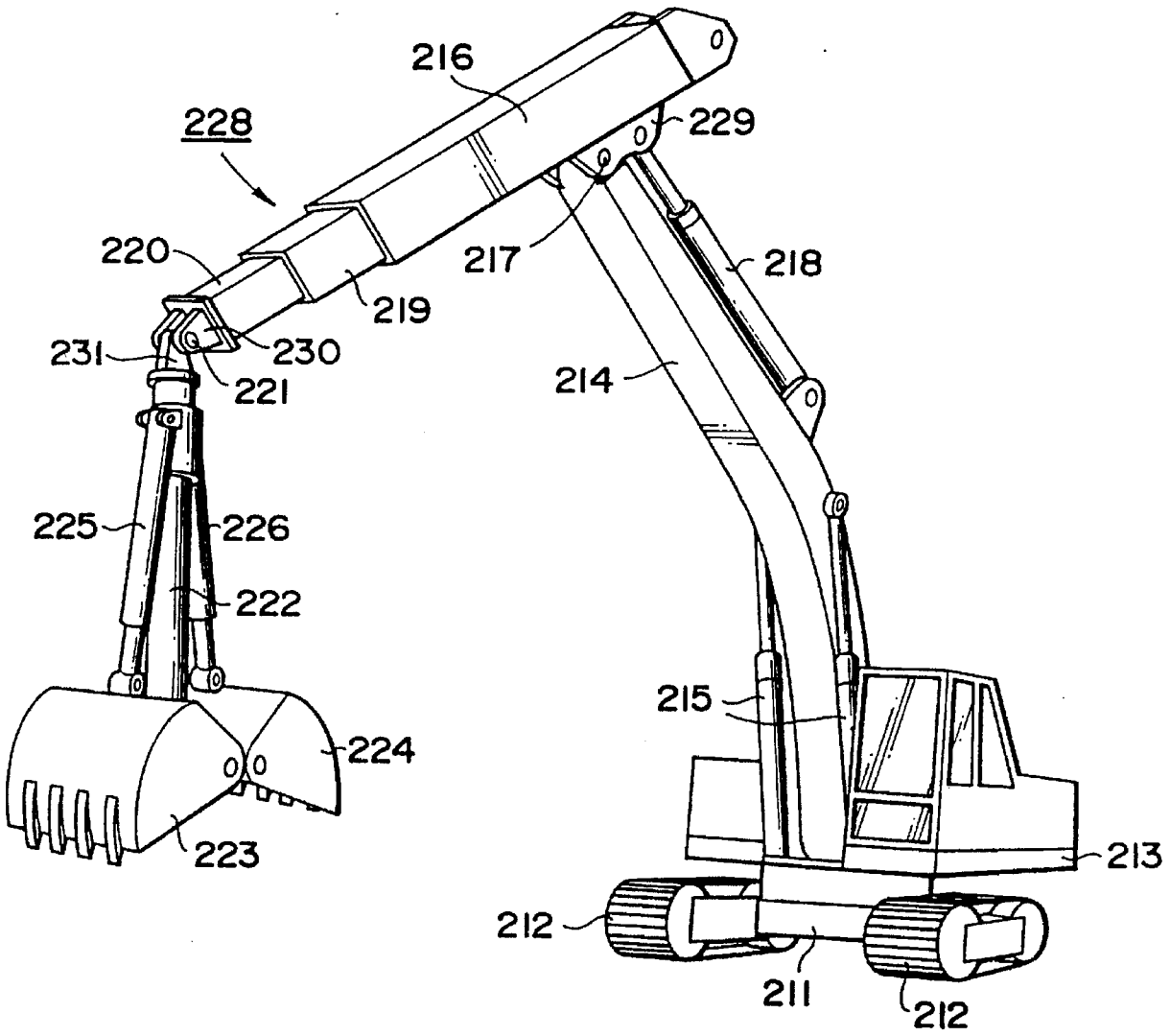
FIG. 16 is a perspective view showing an external appearance of a deep excavator according to a second embodiment of the invention.
Figure 17:
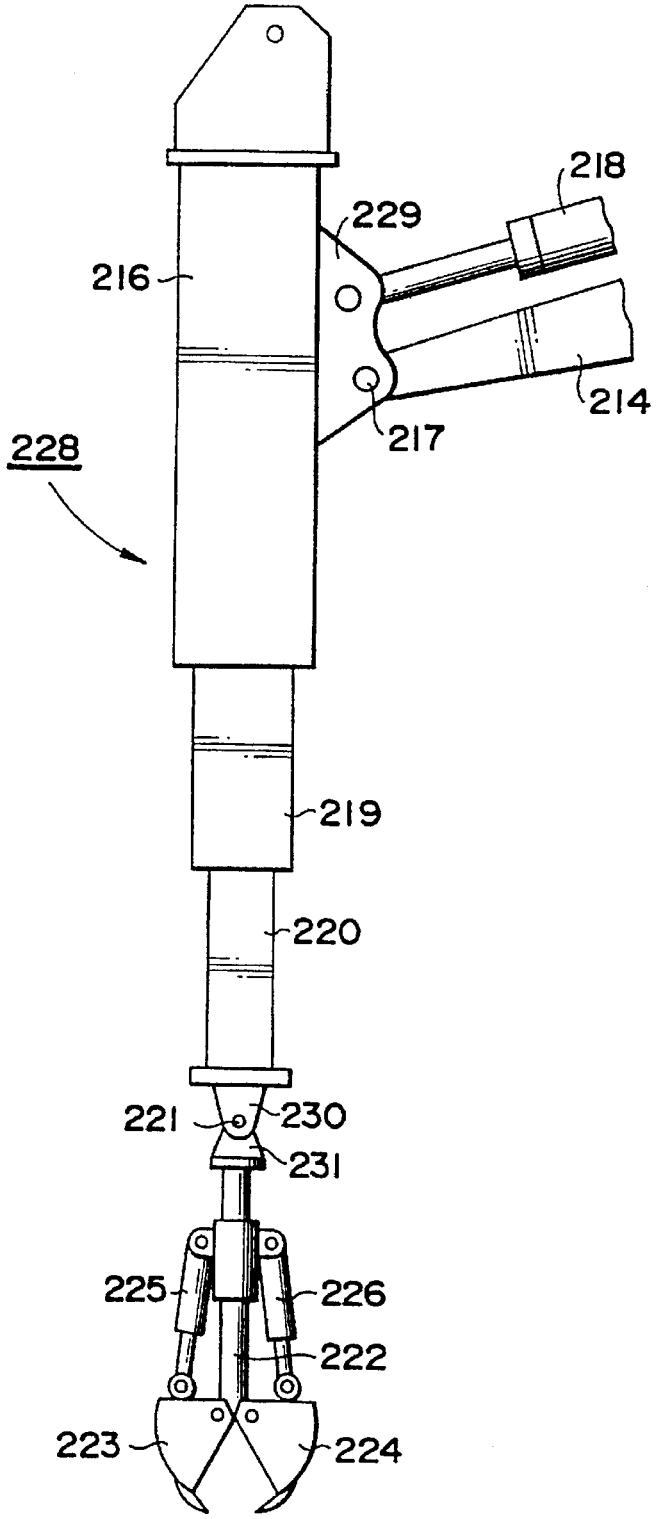
FIG. 17 is a side view of an entire external appearance of a stretchable arm arrangement according to the second embodiment of the invention.

An oil supply mechanism in a deep excavator according to a second embodiment of the invention will be now described with reference to FIGS. 16 to 29. The external appearance of the deep excavator of the second embodiment as illustrated in FIGS. 16 and 17 is substantially the same as that of the first embodiment illustrated in FIGS. 1 and 2, and hence the explanation thereof is omitted. However, the oil supply mechanism of the second embodiment as illustrated in FIGS. 18 to 28 will be described hereinafter.

Figure 18:
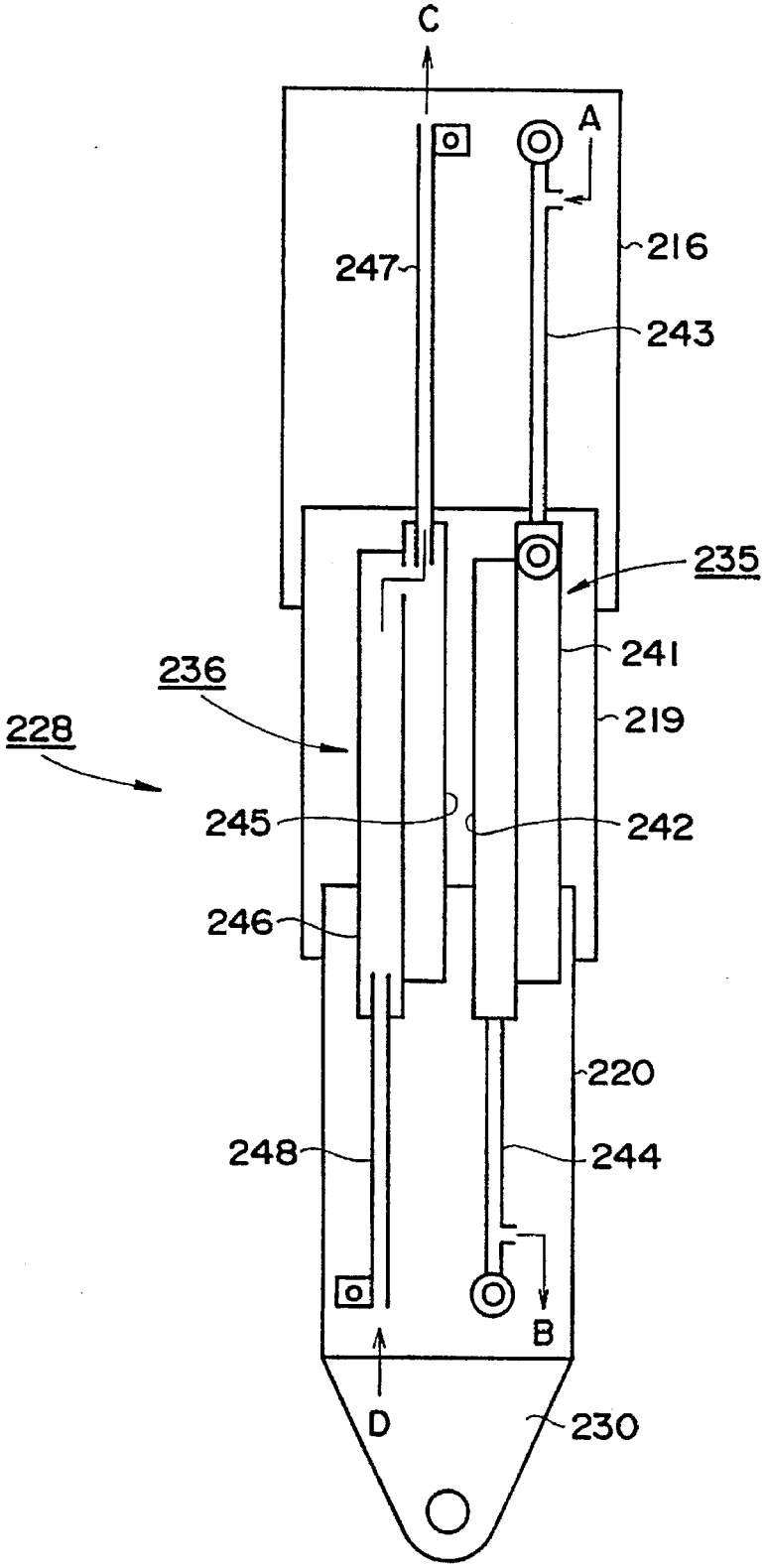
FIG. 18 is a view showing an internal arrangement of the stretchable arm arrangement in FIG. 17.

FIG. 18 shows a typical oil passage through which the oil under pressure passes according to the second embodiment.

The base arm 216, the middle arm 219 and the top arm 220 are assembled so as to extend or contract, thereby defining the stretchable arm arrangement 228. The stretchable arm arrangement 228 is hollow and has a stretchable unit 235 for extending or contracting the middle arm 219 and the top arm 220 relative to the base arm 216. An oil supply unit 236 is provided inside the stretchable arm arrangement 228 for allowing passage of oil under pressure from the upper end of the base arm 216 to the tip end of the top arm 220 without leaking irrespective of the length of the stretchable arm arrangement 228 when it is extended or contracted. The longitudinal directions of the stretchable unit 235 and the oil supply unit 236 are arranged in parallel with that of the stretchable arm arrangement 228.

The stretchable unit 235 comprises a pair of cylinders 241 and 242 which are like hydraulic cylinders, and cylinder rods 243 and 244 are respectively inserted into the cylinders 241 and 242 and movable in opposite directions. The cylinders 241 and 242 are coupled with and integrated with each other at the center of the stretchable unit 235. Axial lines of the cylinders 241 and 242 are arranged to be parallel with each other. The upper portion of the cylinder 241 is coupled with the upper portion of the middle arm 219 by a pin. The cylinder rod 243 is inserted into an upper end opening of the cylinder 241 so as to be movable in the longitudinal direction thereof, and the upper end of the cylinder rod 243 is coupled with the upper end of the base arm 216 by a pin. The cylinder rod 244 is inserted into a lower end opening of the cylinder 242 so as to be movable in the longitudinal direction thereof, and the lower end of the cylinder rod 244 is coupled with the lower end of the top arm 220 by a pin.

The oil supply unit 236 comprises a pair of cylinder members 245 and 246 which are also like hydraulic cylinders, and slidable cylinder rods 247 and 248 are inserted into the cylinder members and movable in opposite directions, wherein the cylinder rods can extend from or contract into the cylinder members, but no hydraulic operating force is generated, which is different from ordinary hydraulic cylinders. The cylinders 245 and 246 are arranged so as to be parallel with each other, and the upper portion of the cylinder 245 is coupled with the upper portion of the middle arm 219 by a pin, and the cylinders 245 and 246 are fixed together and are held by the middle arm 219. The sliding rod or pipe 247 is inserted into the upper end opening of the cylinder 245 so as to be extended and contracted in the longitudinal direction thereof. The sliding rod or pipe 248 is inserted into the lower end opening of the cylinder 246 so as to be extended and contracted in the longitudinal direction thereof. The lower end of the sliding pipe 248 is coupled with the lower end of the top arm 220 by a pin, and the upper end of pipe 247 is coupled to the upper end of the base arm 216 by a pin. The cylinders 245 and 246 are hollow and do not contain sliding members such as pistons therein, and they have openings at the confronted surfaces thereof so as to communicate with each other.

With such an arrangement, when the oil under pressure is supplied to the stretchable unit 235, the cylinder rod 243 is extended from the cylinder 241 while the cylinder rod 244 is extended from the cylinder 242. Since the cylinders 241 and 242 are coupled with the middle arm 219, the cylinder rod 243 is coupled with the base arm 216, and the cylinder rod 244 is coupled with the top arm 220, the middle arm 219 is pulled out from the base arm 216 and the top arm 220 is pulled out from the middle arm 219 as the cylinder rods 243 and 244 are pushed out from the cylinders 241 and 242. The oil under pressure is supplied from the upper end of the cylinder rod 243 for extending and contracting the cylinders 241 and 242, and it can flow from the upper end of the cylinder rod 243 for extending and contracting the cylinders 241 and 242, and it can flow from the upper end of the cylinder rod 243 into the lower end of the cylinder rod 244 by way of an oil passage, not shown in FIG. 18. That is, when the cylinder rods 243 and 244 are not extended from or contracted into the cylinders 241 and 242, (this condition is necessary), the oil under pressure supplied to the upper end of the cylinder rod 243 in the direction of arrow A is allowed to flow from the lower end of the cylinder rod 244 in the direction of arrow B. That is, the oil under pressure supplied at A in FIG. 18 passes through the cylinders 241 and 242 and flows toward the lower opening B of the cylinder rod 244. The reason why the oil under pressure can flow is (not illustrated in FIG. 18) that there is formed, in addition to an ordinary hydraulic cylinder flow passage, another flow passage inside the cylinders 241 and 242, and the cylinder rods 243 and 244.

Although the oil supply unit 236 per se cannot bring about the generation of an extending or contracting force, the sliding pipe 247 is pushed out from the cylinder pipe 245 as the middle arm 219 is pulled out from the base arm 216, and the sliding pipe 248 is pushed out from the cylinder pipe 246 as the top arm 220 is pulled out from the middle arm 219. That is, the sliding pipes 247 and 248 can freely slide in the longitudinal direction thereof relative to the cylinders 245 and 246 and no resistance is generated during the sliding operations of the sliding pipes 247 and 248. The sliding pipe 247 can airtightly slide inside the cylinder 245 and the sliding pipe 248 can airtightly slide inside the cylinder 246 without leaking oil outside. The entire length of the oil supply unit 236 can be changed as the arm arrangement 228 is extended or contracted when the sliding pipes 247 and 248 are pushed out from or pushed into the cylinders 245 and 246 without leaking oil. Since the cylinders 245 and 246 and the sliding pipes 247 and 248 are respectively hollow, the oil under pressure can be allowed to flow into the inner spaces thereof. Accordingly, the oil under pressure supplied from the lower end of the sliding pipe 248 in the direction of arrow D flows inside the sliding pipe 247, passes through the cylinders 245 and 246, then flows into the inner space of the sliding pipe 248, and finally flows out in the direction of arrow C. In such a manner, the oil under pressure flows airtightly through the inner oil passage formed by the oil supply unit 236, and then it is allowed to flow from D to C without leaking outside, even if the middle arm 219 and the top arm 220 are changed in their lengths as they are extended or contracted.

The arrangement of the arm arrangement 228 will now be described with reference to FIGS. 19, 20 and 21.

Figure 19:
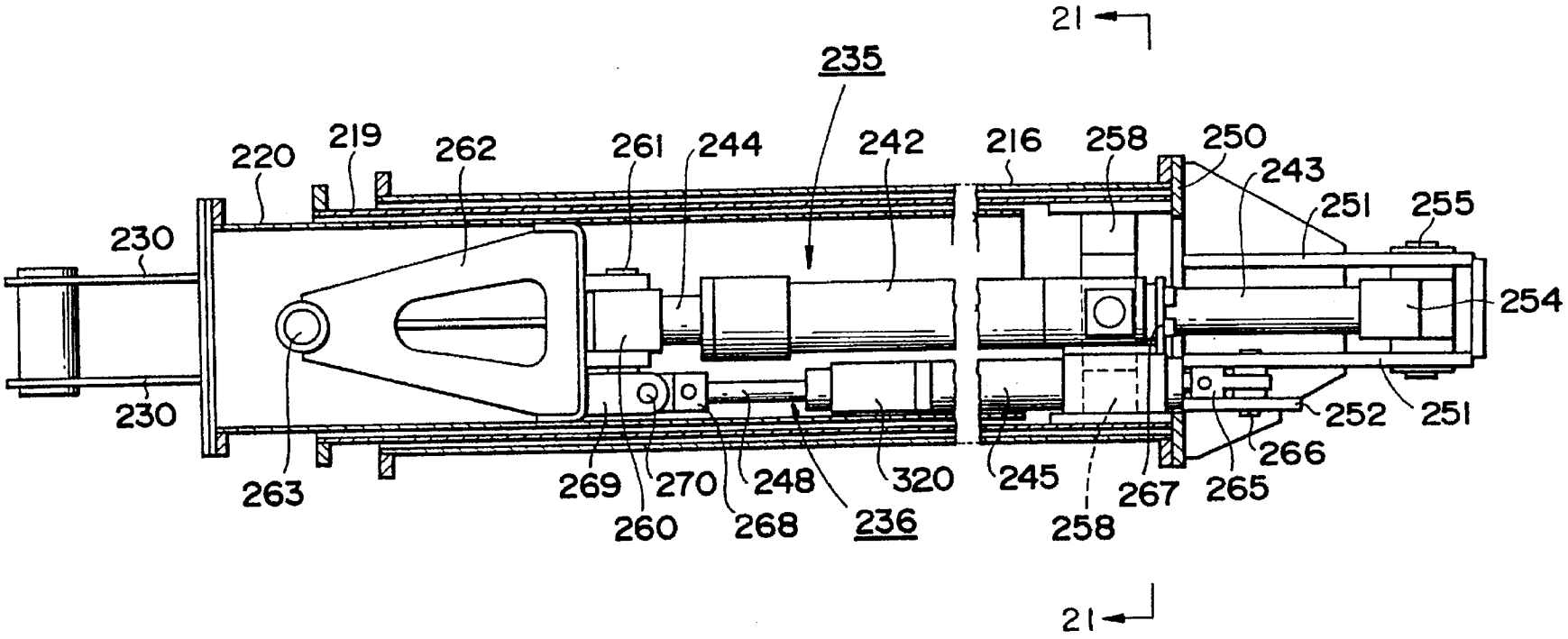
FIG. 19 is a longitudinal cross-sectional view of the stretchable arm arrangement of FIG. 18 as taken along line 19—19 in FIG. 21.
Figure 20:
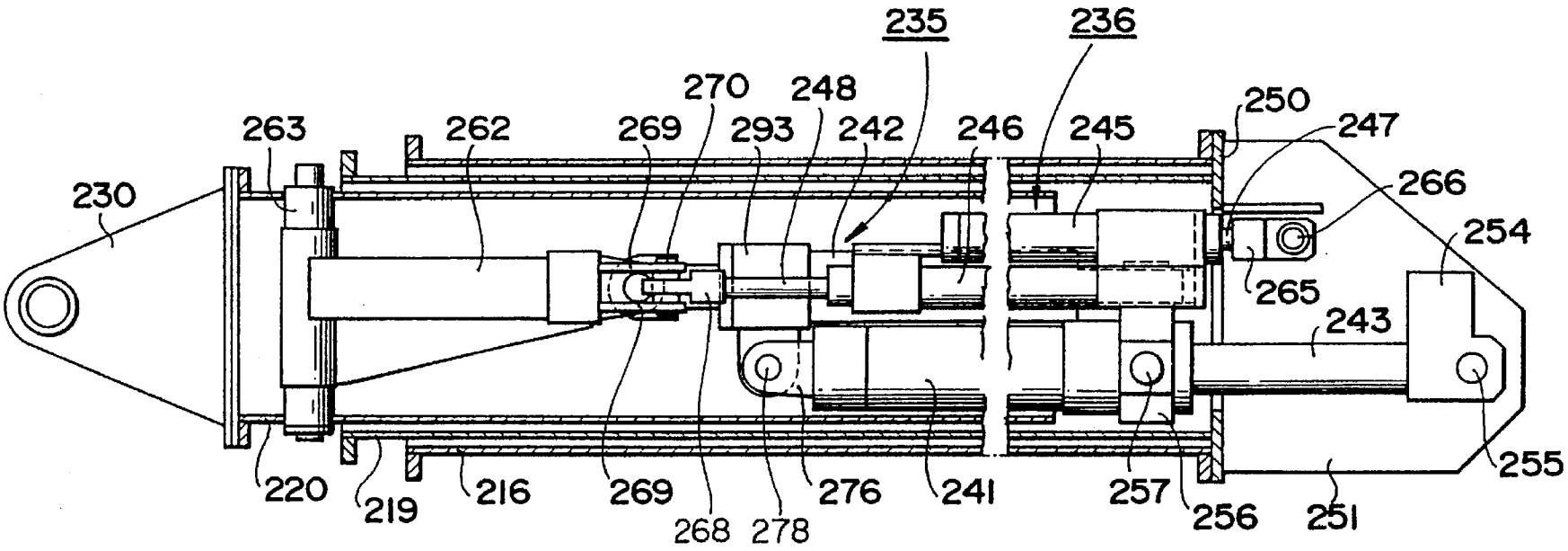
FIG. 20 is a longitudinal cross-sectional view of the stretchable arm arrangement of FIG. 18 as taken along line 20—20 in FIG. 21.

In FIGS. 19 and 20, various units such as the stretchable unit 235 and the oil supply unit 236 are arranged in the arm arrangement 228 wherein the stretchable unit 235 and the oil supply unit 236 are coupled with the base arm 216, the middle arm 219 and the top arm 220. In FIGS. 19 and 20, left-hand side is directed downward and the right-hand side is directed upward, which is a state where the arrangement of the flow passage in FIG. 18 is turned 90°.

The arm arrangement 228 comprises and is assembled telescopically by the base arm 216, the middle arm 219 and the top arm 220, wherein the middle arm 219 and the top arm 220 can slide relative to the base arm 216 in the longitudinal direction thereof. The stretchable unit 235 is disposed at the inner space center of the arm arrangement 228 and its longitudinal direction is arranged to be parallel with that of the arm arrangement 228. Although the oil supply unit 236 is also accommodated in the inner space of the arm arrangement 228, the oil supply unit 236 is slightly smaller than the stretchable unit 235 in shape and it is accommodated inside the arm arrangement 228 adjacent the side surface of the stretchable unit 235. That is, the oil supply unit 236 is positioned in a corner inside the arm arrangement 228 as shown in FIG. 21. The longitudinal direction of the oil supply unit 236 is also arranged parallel with the longitudinal direction of the arm arrangement 228. (In FIG. 19, the cylinder 241 is concealed by the cylinder 242. In FIG. 20, most of the cylinder 242 is concealed by the oil supply unit 236).

A closing plate 250, which has a flat flange shape and a square opening at the center thereof, is fixed to the upper end (right terminal end in FIGS. 19 and 20) of the base arm 216, and the upper end opening of the base arm 216 is formed to have a flat frame shape engaged by the closing plate 250. A pair of rib plates 251 and 251 are fixed to the upper surface of the closing plate 250 (right surface in FIGS. 19 and 20) so as to project at right angles. The rib plates 251 and 251 are spaced from and parallel with each other. Likewise, a small rib plate 252 is fixed to the upper surface of the closing. plate 250 at the outside of the rib plates 251 and 251 (lower side in FIG. 19) so as to project at a right angle from the closing plate 250. The rib plates 251 and 252 are spaced from and parallel with each other. A substantially rectangular spacer 262 is inserted into the inner lower portion of the top arm 220 (left side in FIGS. 19 and 20) and it is formed to be of light weight. Viewing the spacer 262 from the side surface, it is isosceles triangular having long oblique sides and its apex of an acute angle is directed downward and its short side forms a base directed upward. The apex of the acute angle of the spacer 262 and the lower portion of the top arm 220 is directed upward. The apex of the acute angle of the spacer 262 and the lower portion of the top arm 220 are coupled with each other by a pin 263, and both sides of the base of the spacer 262 contact the inner wall of the top arm 220. The spacer 262 per se is held by the top arm 220 without generating jolt or play therebetween. A substantially rectangular coupling unit 230 is fixed to the lower end of the top arm 220 (left side in FIGS. 19 and 20).

Holding bearings 258 and 258 are inserted and fixed to both inner surfaces of the upper portion (right side in FIG. 19) of the middle arm 219. Each of the holding bearings 258 and 258 has a cylindrical shape and also has a flange at its one end. Pin holes 259 and 259 are defined at opposite side surfaces of the flange. Each of the holding bearings 258 and 258 is fixed to the middle arm 219 in the manner that the cylindrical small-diameter portion of the holding bearing 258 is inserted into the opening hole (not shown) defined in the upper side surface of the middle arm 219 and the flange portion is brought into contact with the outer wall of the middle arm 219. The pin holes 259 and 259 of the holding bearings 258 and 258 are opposing with each other as shown in FIG. 21 and axial lines of the pin holes 259 and 259 are arranged to be positioned on the same straight line.

The stretchable unit 235 mainly comprises the pair of cylinders 241 and 242. Axial lines of the cylinders 241 and 242 are arranged to be parallel with each other. The cylinder rod 243 of the cylinder 241 and the cylinder rod 244 of the cylinder 242 are oppositely directed in their extending and contracting directions. A connection block 256 is fixed to the upper periphery of the cylinder 241 and it can be coupled with the upper portion of the cylinder 242. A cylinder top 293 is fixed to the lower periphery of the cylinder 242 and a coupling hinge 276 protrudes from the lower end of the cylinder 241, wherein the cylinder top 293 and the coupling hinge 276 are coupled with each other by a pin 278. In such a manner, the cylinders 241 and 242 are coupled with each other at the upper and lower portions thereof and are fixed so as to be integrated with each other for forming the stretchable unit 235.

Figure 21:
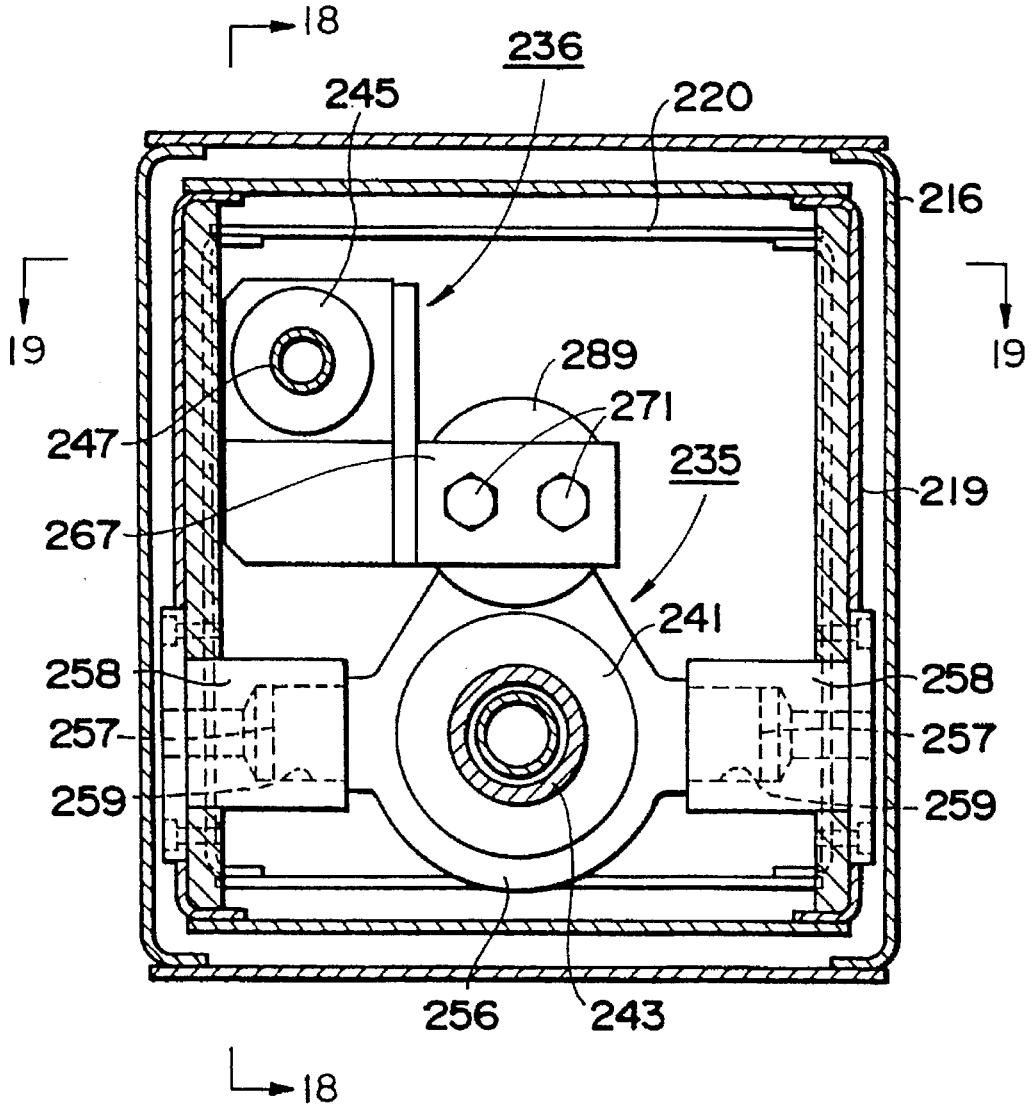
FIG. 21 is a longitudinal cross-sectional view of the stretchable arm arrangement of FIG. 18 as taken along line 21—21 in FIG. 19.

The connection block 256 is formed by cutting solid metal, and it has a semicircular shape in its plan view at its lower surface as shown in FIG. 21 and a ridge-shaped protruding shape at its upper surface. A pair of pin shafts 257 and 257 protrude from the left and right sides of the connection block 256. Axial lines of the pin shafts 257 and 257 are arranged to form a straight line and they are inserted into the pin holes 259 and 259 defined in the holding bearings 258 and 258. Accordingly, the connection block 256 is held by the holding bearings 258 and 258 by way of the pin shafts 257 and 257 and the pin holes 259 and 259, and consequently, the cylinder 241 is coupled with the middle arm 219. Accordingly, the cylinder 241 (and the cylinder 242) moves together with the middle arm 219, but it turns about the pin shafts 257 and 257, the pin holes 259 and 259, and hence excessive force is not necessary to be applied to the middle arm 219 even if the cylinder 241 is swung by jolt or play.

The cylinder rod 243 slidably protrudes from the upper end of the cylinder 241 and extends upward from the opening of the closing plate 250 between the pair of rib plates 251 and 251. A rectangular parallelepiped terminal end block 254 is fixed to the upper end of the cylinder rod 243 (right side in FIGS. 19 and 20) and is positioned between the rib plates 251 and 251, and it is coupled with both rib plates 251 and 251 by a pin 255. The terminal end block 254 has a substantially cubic shape viewing from the side thereof and also has a port defined therein for permitting the oil under pressure to flow from the outside into the inner space of the cylinder 241.

The cylinder rod 244 stretchably protrudes from the lower end of the cylinder 242 and the lower end of the cylinder rod 244 extends to the lower portion of the top arm 220. A rectangular parallelepiped terminal end block 260 is fixed to the lower end (left side in FIGS. 19 and 20) of the cylinder rod 244. The terminal end block 260 is coupled with the spacer 262 by a pin 261 so that the cylinder rod 244 is coupled with the top arm 220 by way of the terminal end block 260 and the spacer 262. The terminal end block 260 is cubic and has a port at the side surface thereof for allowing the oil under pressure to flow into the inner space of the cylinder 242 from the outside.

A fixed channel 267 protrudes from the side surface of the upper portion (left side in FIGS. 19 and 20) of the cylinder pipe 245 constituting the oil supply unit 236 so as to cross at right angles with the cylinder pipe 245. The fixed channel 267 is fixed to a cylinder end 289 provided on the upper end (right side in FIGS. 19 and 20) by screws 271. The oil supply unit 236 is integrally coupled with the stretchable unit 235 by way of the fixed channel 267. Since the oil supply unit 236 is coupled with the stretchable unit 235, the oil supply unit 236 is movable together with the stretchable unit 235 (i.e, together with the middle arm 219) in the longitudinal direction thereof. The sliding pipe 247 protrude from the upper end of cylinder 245 into the outside. The sliding pipe 248 stretchably protrudes from the lower end (left side in FIGS. 19 and 20) of the cylinder 246, which cylinder 246 is integrally coupled with the cylinder 245 and opens in opposite direction. A cubic terminal block 268 is fixed to the lower end of the sliding pipe 248. The sliding pipe 248 is inserted into a pair of coupling hinge plates 269 and 269 which protrude from the upper surface (right side in FIGS. 19 and 20) of the spacer 262 and are spaced from each other. The terminal block 268 and the pair of coupling hinge plates 269 and 269 are coupled with each other by a pin 270. The terminal block 268 has a port defined at the side surface thereof for allowing the oil under pressure to flow from the outside into the inner space of the sliding pipe 248.

Figure 22:
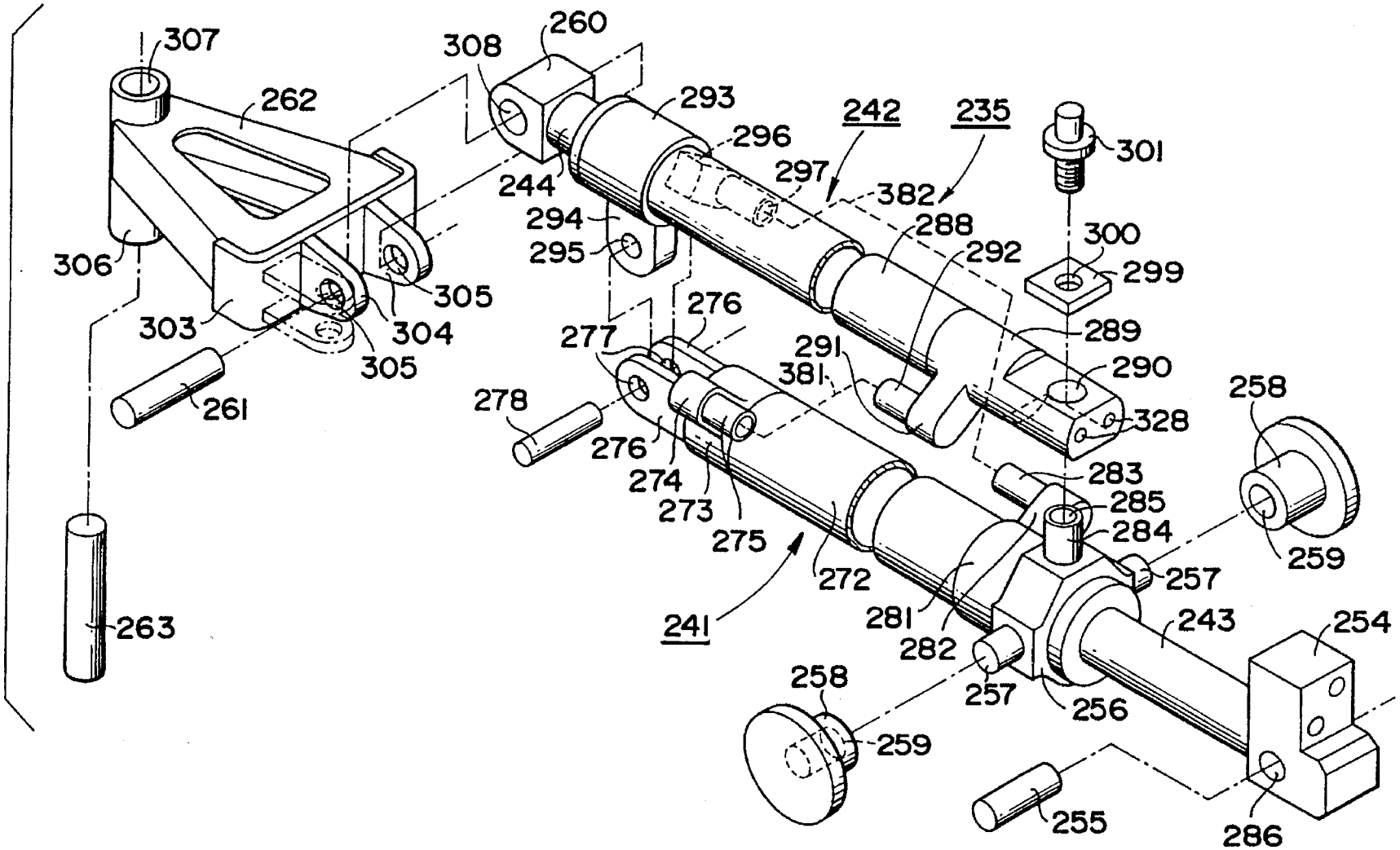
FIG. 22 is an exploded perspective view showing a stretchable unit used in the deep excavator according to the second embodiment of the invention wherein first and second cylinders constituting the stretchable unit are separated up and down.

FIG. 22 is an exploded perspective view showing members constituting the stretchable unit 235, and also showing a process for assembling the stretchable unit 235.

As mentioned above, the stretchable unit 235 is structured by combining two hydraulic cylinder units 241 and 242. One hydraulic cylinder unit 241 comprises a first cylinder body 272 which is pipe-shaped and is hollow at the center thereof. A first cylinder end 273 is fixed to a lower end of the cylinder body 272 (left side in FIG. 22) for closing the lower end opening of the cylinder body 272. The first cylinder end 273 is formed of single-piece by casting, and is circular at a periphery thereof. The first cylinder end 273 has an oil passage projection 274 at a part of the side surface thereof which protrudes at right angles with the side surface thereof. An L-shaped port 275 protrudes from the side surface of the oil passage projection 274 and an opening of the port 275 is directed upward (right side in FIG. 22). A pair of coupling hinge plates 276 and 276 are spaced in a given interval and arranged in parallel with each other at the lower end of the first cylinder end 273, and have pin holes 277 and 277 defined therein. A pin 278 can be inserted into the pin holes 277 and 277. A first cylinder top 281 is coupled with an upper end of the cylinder body 272 (right side in FIG. 22), and it is formed as a single-piece by casting. The cylinder top 281 has an oil passage projection 282 at a part of the side surface thereof which protrudes at right angles with the side surface thereof. An L-shaped port 283 protrudes from the side surface of the oil passage projection 282, and an opening of the port 283 is directed downward.

The connection block 256 is engaged in an outer periphery of the cylinder top 281. The cylinder top 281 is formed by casting and has three plane side surfaces and an opening defined by cutting it at the center of the upper periphery, thereby fixing the connection block 256 to the cylinder top 281 like a surrounding belt. Pin shafts 257 and 257 protrude from both side surfaces of the connection block 256 and axial lines thereof are positioned on the same straight line. The pin shafts 257 and 257 are rotatably inserted into pin holes 259 and 259 of holding bearings 258 and 258 fixed to the middle arm 219. A cylindrical coupling shaft 284 protrudes from the side plane surface of the connection block 256 and is positioned at right angles with the pin shafts 257 and 257. A screw hole 285 is defined at the tip end of the cylindrical coupling shaft 284. The cylinder rod 243 is inserted from the upper end of the cylinder top 281 into an inner portion of the cylinder body 272, and a terminal end block 254 having an L-shape viewing from the side thereof is fixed to the upper end (right side in FIG. 22) of the cylinder rod 243. The terminal end block 254 has a pin hole 286 which is defined at the side thereof by penetrating the terminal end block 254 and which extends at rights angles with the longitudinal direction of the cylinder rod 243. The pin 255 is inserted into the pin hole 286.

The other cylinder unit 242 has a second cylinder body 288 at the center thereof which is hollow and has a pipe-shaped configuration. A second cylinder end 289, which closes an upper end opening of the second cylinder 288, is fixed to the upper end (right side in FIG. 22) of the second cylinder 288. The second cylinder end 289 is formed of a single-piece by casting and by being subjected to a cutting process. The second cylinder end 289 is circular at the periphery thereof, and extends to an upper portion thereof both of which form flat surfaces (upper and lower surfaces in FIG. 22). A fixing hole 290 is defined on the flat surface of the second cylinder end 289 to cross at right angles with an axial line of the second cylinder 288. A pair of screw holes 328 and 328 are defined in the upper end surface of the second cylinder end 289. An oil passage projection 291 protrudes from a part of the circular side surface of the second cylinder end 289 at right angles therewith. A port 292 having an L-shaped protrudes from a side surface of the oil passage projection 291, and has an opening directed downward.

A second cylinder top 293 is fixed to the lower end of the second cylinder body 288 (left side in FIG. 22) so as to close the lower end opening thereof. The second cylinder top 293 is formed as a single piece by casting, and is circular at the outer periphery thereof. A flat plate-shaped fixed piece 294 protrudes from a part of the side surface of the second cylinder top 293. A pin hole 295 is defined by penetrating the fixed piece 294 from the side surface thereof. The fixed piece 294 is to be inserted between the pair of coupling hinge plates 276 and 276, and a pin 278 is inserted into the pin hole 295. An oil passage projection 296 protrudes from the side surface of the second cylinder top 293, and a port 297 protrudes from the side surface of the oil passage projection 296 so as to form an L-shape. An opening of the port 297 is directed upward. The cylinder rod 244 is slidably inserted into a lower end opening of the second cylinder top 293, and a cubic terminal end block 260 is fixed to the lower end (left side in FIG. 220 of the cylinder rod 244. A pin hole 308 is defined by penetrating the terminal end block 260 from the side surface thereof so as to be positioned at right angles with an axial direction of the cylinder rod 244. A pin 261 is inserted into the pin hole 308.

A pressure passage 381, which is schematically denoted by a dotted line in FIG. 22, and is formed of a hard rubber or a flexible metallic pipe, is connected between the port 275 and the oil passage projection 291 for allowing oil under pressure to flow therethrough.

The spacer 262 is formed of thin sheet metal and comprises a plurality of ribs which are assembled by welding thereof. The spacer 262 is triangular viewing from the upper portion thereof. The spacer 262 has an isosceles triangle shape having two long legs. An interval member 303 is fixed to the short leg of the spacer 262 and has a substantially U shape formed by bending it at both ends in which both ends of the interval member 303 are directed upward (right side in FIG. 22). A width of the interval member 303 in its longitudinal direction is substantially the same as an inner wall of the top arm 220. Accordingly, when the spacer 262 is inserted in the top arm 220, both ends of the interval member 303 can contact the right and left inner walls of the top arm 220, thereby preventing the spacer 262 from being displaced to the right and left. A pair of coupling hinge plates 304 and 304 are spaced and fixed to the plane surface of the interval member 303 at the upper side thereof (right side in FIG. 22). Pin holes 305 and 305 are defined in side surfaces of the coupling hinge plates 304 and 304. A pipe-shaped shaft supporting cylinder 306 is fixed to an acute apex of the triangular spacer 262, and an opening of the shaft supporting cylinder 306 is positioned at right angles with a plane surface of the spacer 262. A shaft hole 307 is defined by penetrating the shaft supporting cylinder 306 for inserting a pin 263 therein.

When the stretchable unit 235 according to the second embodiment is assembled, the pair of cylinders 241 and 242 must be connected to each other. First, both side surfaces of the cylinders 241 and 242 are positioned next to each other, then the cylindrical coupling shaft 284 is inserted into the hole 290, and at the same time the fixed piece 294 is inserted into a gap between the coupling hinge plates 276 and 276. An opening 300 of a base plate 299 is inserted into a head portion of the cylindrical coupling shaft 284, which protrudes from the plane surface of the second cylinder end 289, through the fixed hole 290, and a set screw 301 is threaded into the screw hole 285 of the cylindrical coupling shaft 284 while the base plate 299 is inserted over the cylindrical coupling shaft 284. The connection block 256 is fixed to a flat side surface of the second cylinder end 289 when the set screw 301 is threaded into the screw hole 285 by way of the base plate 299. The pin 278 is inserted into the pin holes 277 and 277 and the pin hole 295, and then the coupling hinge plates 276 and 276 and the fixed piece 294 are connected by the pin 278. With such a procedure, the cylinders 241 and 242 are fixedly connected to each other, and assembled in the manner that axial lines of the cylinders 241 and 242 are parallel to each other. Since an axial line of the cylindrical coupling shaft 284 is arranged at right angles with that of the pin 278, the cylinders 241 and 242 have sufficient room to be turnable in all directions when the cylinders 241 and 242 are assembled, which makes it possible to easily insert the cylindrical coupling shaft 284 into the fixed hole 290 and possible to easily insert the pin 278 into the pin holes 277 and 277 and the pin hole 295.

When the cylinders 241 and 242 are completely assembled, the pin shafts 257 and 257 protruding from the right and left sides of the connection block 256 can be inserted into the pin holes 259 and 259 of the holding bearings 258 and 258 so that the cylinders 241 and 242 can be held by way of the connection block 256, the pin shafts 257 and 257, and the holding bearings 258 and 258. The cylinders 241 and 242 are connected swingably about the pin shafts 257 and 257 relative to the middle arm 219 so as to absorb backlash or play generated when the cylinders 241 and 242 are extended or contracted. Successively, the terminal end block 254 fixed to the upper end of the cylinder rod 243 is inserted between the rib plates 251 and 251 while the pin 255 is inserted into the pin hole 286 and pin holes (not shown) of the rib plates 251 and 251 so that the terminal end block 254 is connected to the rib plates 251 and 251 by the pin 255. The terminal end block 260 fixed to the lower end of the cylinder rod 244 is inserted into the pair of coupling hinge plates 304 and 304, then the pin 261 is inserted into the pin holes 305 and 305 and the pin hole 308, so that the coupling hinge plates 304 and 304 and the terminal end block 260 are connected. Since the terminal end block 260 and the coupling hinge plates 304 and 304 are swingably connected to one another by the pin 261, even if the cylinder rod 244 is inclined relative to the top arm 220, the terminal end block 260 and the coupling hinge plates 304 and 304 can be connected to one another with room so as to absorb such inclination. Further, the shaft supporting cylinder 306 is positioned at an opening defined at the lower side surface (not shown) of the top arm 220, and the pin 263 is inserted into the opening of the top arm 220 and the shaft hole 307, so that the shaft supporting cylinder 306 is connected to the top arm 220.

Figure 23:
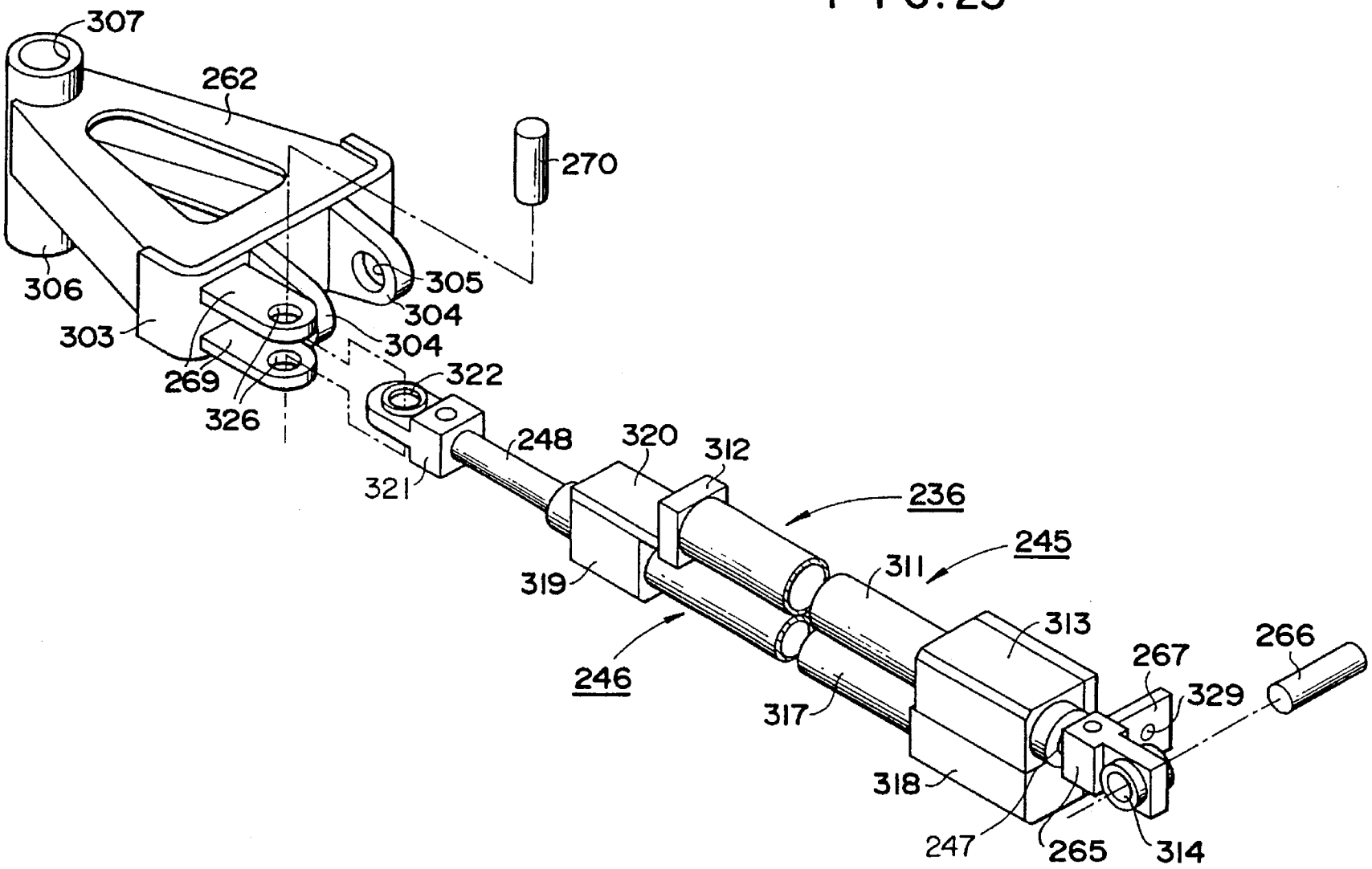
FIG. 23 is a perspective view of an external appearance of an oil supply unit used in the deep excavator according to the second embodiment of the invention.

FIG. 23 is an exploded perspective view showing components constituting the oil supply unit 236 and also showing a process of assembling the stretchable unit 235.

The oil supply unit 236 comprises a pair of cylinders or pipes 245 and 246 which are assembled such that axial lines thereof are parallel to each other. The cylinder pipe 245 includes a third cylinder body 311 at the center thereof, wherein third cylinder body 311 is hollow and is pipe-shaped. A plane plate-shaped cylinder end 312 is brought into contact with the lower end (left end in FIG. 23) of the third cylinder body 311, so that the latter is closed by the former. A rectangular parallelepiped fixed block 313 is inserted into an upper outer periphery (right side in FIG. 23) of the third cylinder body 311, and an upper end of the third cylinder body 311 protrudes from the upper surface (right side in FIG. 23) of the fixed block 313. A sliding pipe 247 is slidably inserted into the upper end opening of the third cylinder body 311, and a cubic terminal block 265 is fixed to the upper end of the sliding pipe 247. A pin hole 314 is defined in the side surface of the terminal block 265 and an axial line of the pin hole 314 is positioned at right angles with a longitudinal direction of the terminal block 265.

A fourth hollow and pipe-shaped cylinder body 317 is provided at the center of the cylinder pipe 246. A rectangular cylinder end 318 is coupled with an upper end (right side in FIG. 23) of the fourth cylinder body 317, and an upper end opening of the fourth cylinder body 317 is closed by the cylinder end 318. The cylinder end 318 is substantially the same as the fixed block 313 in shape. When the fixed block 313 is brought into contact with the side surface of the cylinder end 318, they are integrally coupled with each other. The fixed channel 267, which is formed by bending a sheet plate in an L shape, is fixed to one side surface (back side in FIG. 23) of the coupled fixed block 313 and cylinder end 318. A pair of openings 329 and 329 are defined in the protruding piece of the fixed channel 267 through which the screw 271 (FIG. 21) is inserted. A rectangular parallelepiped fixed block 319 is inserted in the fourth cylinder body 317 at the lower end thereof (left side in FIG. 23), and an end of a fixed piece 320 is fixed to a lower surface of the cylinder end 312.

In such manner, the third cylinder body 311 and the upper end of the fourth cylinder body 317 are connected to each other by the fixed block 313 and the cylinder end 318, while the cylinder body 311 and the lower end of the fourth cylinder body 317 are connected to each other by the cylinder end 312, the fixed block 319 and the fixed piece 320, so that the third cylinder body 311 and the fourth cylinder body 317 are connected to each other so as to be integrated with each other.

The sliding pipe 248 is slidably inserted from the lower end opening of the fourth cylinder body 317, and a cubic terminal block 321 is connected to the lower end of the sliding pipe 248. The lower end opening of the sliding pipe 248 is closed by the terminal block 321. A pin hole 322 is defined in the side surface of the terminal block 321 and an axial line of the pin hole 322 is positioned at right angles with that of the sliding pipe 248.

A pair of coupling hinge plates 269 and 269 are spaced apart from each other and are fixed to the upper surface (right side surface in FIG. 23) of the interval member 303 fixed to the spacer 262 at a position displaced to one side thereof (i.e., this position avoids the coupling hinge plates 304 and 304 fixed to the center thereof). Pin holes 326 and 326 are defined in the coupling hinge plates 269 and 269. Axial lines of the pin holes 305 and 305 are arranged to be positioned at right angles with those of the pin holes 326 and 326.

To connect the assembled oil supply unit 236 to the stretchable unit 235 and to the spacer 262, first the side surface of the fixed channel 267 is brought into contact with the upper end surface (right side in FIG. 22) of the second cylinder end 289 shown in FIG. 22, secondly the screw holes 328 and 328 defined in the upper end of the second cylinder end 289 is allowed to be flush with the openings 329 and 329 defined in the fixed channel 267. When the screws 271 are threaded into the screw holes 328 and 328 from the openings 329 and 329, the fixed channel 267 is fixed to the second cylinder end 289. Successively, the terminal block 265 fixed to the upper end of the sliding pipe 247 is positioned between the rib plates 251 and 252 so as to allow the pin hole (not shown) defined in the rib plates 251 and 252 to be flush with the pin hole 314. Thereafter, a pin 266 is inserted from the side surface of the rib plate 252 so as to connect the terminal block 265 to the rib plates 251 and 252. The lower end of the terminal block 321 is inserted into a gap between a pair of coupling hinge plates 325 and 325 so that pin hole 322 is aligned with the pin holes 326 and 326, then a pin 270 is inserted from the side surface of the coupling hinges 269 and 269, so that the terminal end block 260 is connected to the coupling hinges 325 and 325 by the pin 270.

Figure 24:
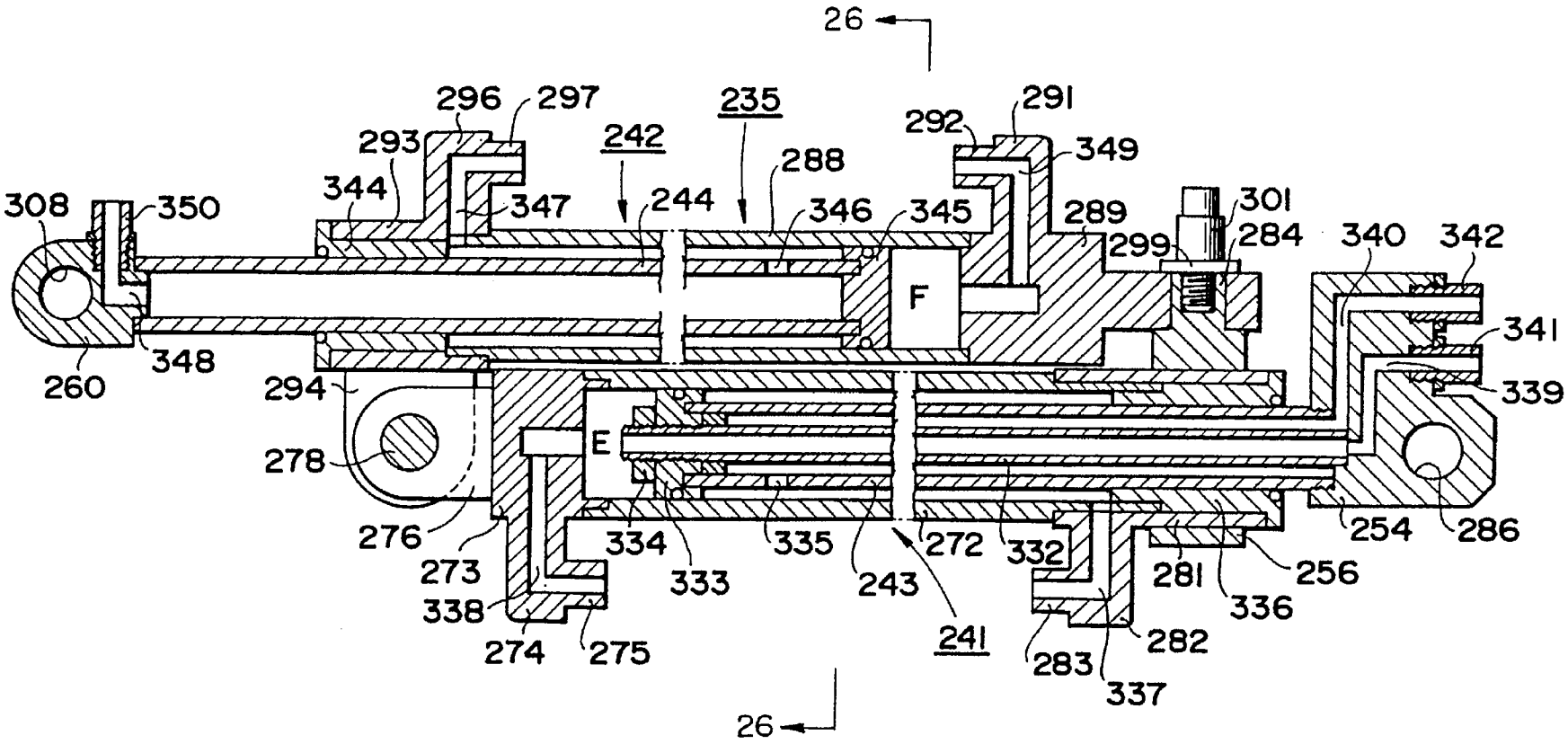
FIG. 24 is a longitudinal cross-sectional view showing an internal structure of the stretchable unit of FIG. 22.

FIG. 24 is a longitudinal cross-sectional view showing an internal structure of the assembled stretchable unit 235 which is cut in the longitudinal direction at the center thereof.

A cylinder end 273 is brought into contact with and fixed to the lower end opening (left side in FIG. 24) of the cylinder body 272, so that the latter is closed by the former. An oil passage 338 is bored into the inner portion of the cylinder end 273 for allowing the oil under pressure to flow from the inner space of the cylinder body 272 to a port 275. A piston 333 slides airtightly inside the cylinder body 272 and divides the inner space of the cylinder body 272 into two sections. A lower end (left end in FIG. 24) of the cylinder rod 243 is coupled with the piston 333. An inner pipe 332 is inserted coaxially into the cylinder rod 243 in the longitudinal direction thereof. The inner pipe 332 has an outer diameter which is less than the inner diameter of the cylinder rod 243 and has a length which is slightly larger than the cylinder rod 243. The lower end (left end in FIG. 24) of the inner pipe 332 penetrates the center of the piston 333, and a nut 334 is threaded onto the lower end of the inner pipe 332 so that the inner pipe 332 is fixedly coupled with the piston 333. The lower end opening of the inner pipe 332 communicates with a space E, which is partitioned by the piston 333 and positioned at the left in FIG. 24. The inner space of the cylinder rod 243 is closed by the piston 333.

A lower end of a cylindrical coupling 336 is engaged into an upper end opening of the cylinder body 272. The cylindrical coupling 336 has an inner diameter which is substantially the same as an outer diameter of the cylinder rod 243 so that the cylinder rod 243 can airtightly engage the cylindrical coupling 336. That is, the upper end of the cylinder body 272 is airtightly closed by the cylindrical coupling 336 and the cylinder rod 243 can airtightly extend through the upper end opening of the cylindrical coupling 336. The cylinder top 281 is pressed onto the upper portion of the cylinder body 272 so as to surround the circumference of the cylindrical coupling 336 and reinforces the upper portion of the cylinder body 272. An oil passage 337 is bored into the inner portion of the cylinder top 281 for allowing oil under pressure to flow from a ring-shaped space between the inner wall of the cylinder body 272 and the outer wall of the cylinder rod 243 toward a port 283.

The cubic terminal end block 254 is fixed to the cylinder rod 243 and the upper end (right side in FIG. 24) of the inner pipe 332. The cylinder rod 243 and the upper end opening of the inner pipe 332 are closed by the terminal end block 254. Oil passages 339 and 340 are independently bored into the inner portion of the terminal end block 254. The inner space of the inner pipe 332 communicates with one end of the oil passage 339 while a ring-shaped space defined in a gap between an outer peripheral of the inner pipe 332 and the inner peripheral of the cylinder rod 243 communicates with one end of the oil passage 340. The outer end of the oil passage 339 communicates with a port 341 protruding from the side surface of the terminal end block 254 while the outer end of the oil passage 340 communicates with a port 342 protruding from the side surfaces of the terminal end block 254. A port 335 is defined at the side surface of the lower portion (left side in FIG. 24) of the cylinder rod 243 for communicating with the inner and outer peripheries of the cylinder rod 243 so as to allow oil under pressure to flow therethrough.

The cubic second cylinder end 289 is brought into contact with the upper end opening (right side in FIG. 24) of the second cylinder 288, whereby the upper end of the latter is closed by the former. An oil passage 349 is defined in the inner portion of the second cylinder end 289 for allowing the oil under pressure into the inner space of the second cylinder 288 from the port 292. A piston 345 is airtightly slidable along the inner peripheral of the second cylinder 288. A right side pressure chamber F is defined in the inner space of the second cylinder 288 by the piston 345 (right side in FIG. 24). A side surface of the piston 345 is coupled with the upper end of the cylinder rod 244 which is inserted into the second cylinder 288, wherein the upper end of the cylinder rod 244 is closed by the piston 345.

A cylindrical coupling 344, which has an inner diameter the same as the outer diameter of the cylinder rod 244, is coupled with the lower end (left side in FIG. 24) opening of the second cylinder 288, wherein the cylinder rod 244 can be held airtightly slidable along the cylinder rod 244. That is, the lower end opening of the second cylinder 288 is airtightly closed by the coupling 344 and the cylinder rod 244, so that the cylinder rod 244 is airtightly extended from or contracted into the lower end opening of the coupling 344. The second cylinder top 293 is engaged so as to surround the lower portion of the second cylinder 288 and the circumference of the coupling 344, so that the latter is reinforced by the former. An oil passage 347 is bored into the inner portion of the second cylinder top 293 so as to allow the oil under pressure from the ring-shaped space between the inner wall of the second cylinder 288 and the outer wall of the cylinder rod 244 to flow to the port 297.

The cubic terminal end block 260 is fixed to the lower end (left side in FIG. 24) of the cylinder rod 244, so that the lower end of cylinder rod 244 is closed by the block 260. An oil passage 348 is defined into the inner portion of the terminal end block 260 so as to communicate with the inner space of the cylinder rod 244 while the other end of the oil passage 348 communicates with a port 350 protruding from the side surface of the terminal end block 260. A port 346 is defined in the side surface of the upper portion (right side in FIG. 24) of the cylinder rod 244 for allowing the oil under pressure between the inner and outer sides of the cylinder rod 244.

Figure 25:
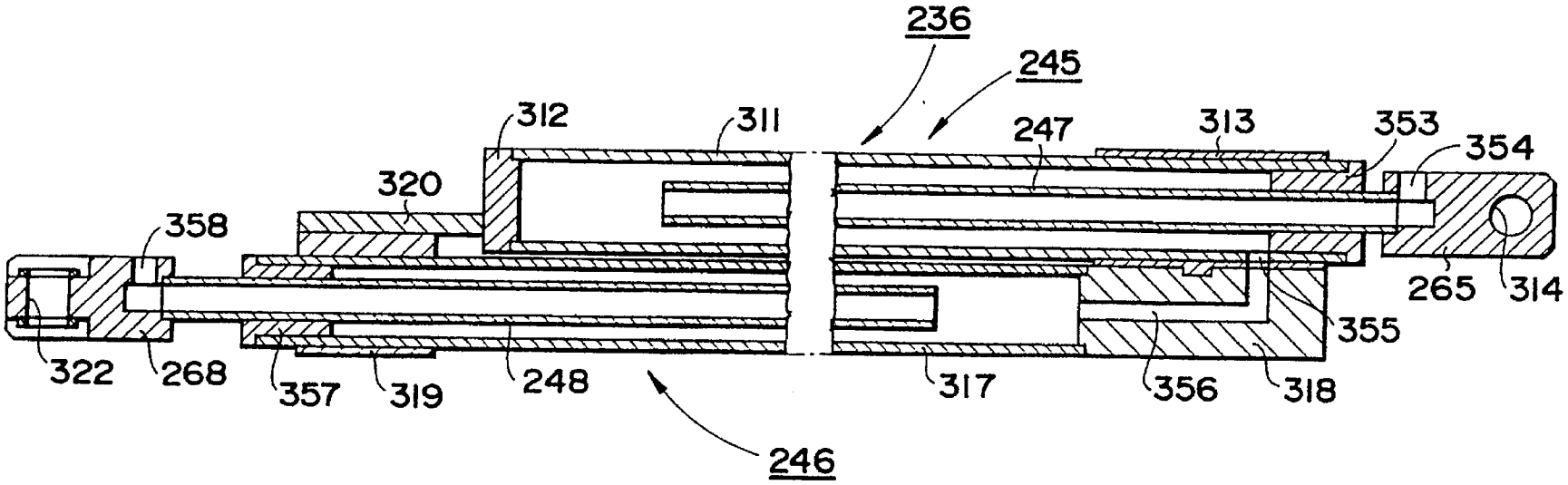
FIG. 25 is a longitudinal cross-sectional view showing an internal structure of the oil supply unit of FIG. 23.

FIG. 25 is a longitudinal cross-sectional view showing an internal structure of the assembled oil supply unit 236 which is cut in the longitudinal direction at the center thereof.

As mentioned above, the lower end (left side in FIG. 25) of the cylinder body 311 constituting the cylinder pipe 245 is closed by the cylinder end 312. A cylindrical coupling 353 having an inner diameter which is the same as the outer diameter of the sliding pipe 247 is inserted into the upper end opening of the cylinder body 311. The sliding pipe 247 is airtightly slidably inserted into the central opening of the coupling 353. The sliding pipe 247 is pipe-shaped and opened at the upper and lower ends thereof. Even if the sliding pipe 247 is extended and contracted inside the cylinder body 311, the inner space of the cylinder body 311 always communicates with the lower (leftward) end of the sliding pipe 247. The cubic fixed block 313, having a central opening inner diameter which is the same as the outer diameter of the cylinder body 311, is fixed to an upper outer periphery of the cylinder body 311, so that the upper portion of the cylinder body 311 is reinforced by the fixed block 313. The terminal block 265 is fixed to the upper end (right side in FIG. 24) of the sliding pipe 247 so that the upper end opening of the sliding pipe 247 is closed by the terminal block 265. An oil passage 354 is bored into the side surface of the terminal block 265.

The cubic cylinder end 318 is fixed to an upper end of the fourth cylinder body 317 constituting the cylinder pipe 246 so that the upper end opening of the fourth cylinder body 317 is closed by the cylinder end 318. The side surface of the cylinder end 318 is brought into contact with and is fixed to the side surface of the fixed block 313, and the cylinder end 318 is assembled with the fixed block 313 so as to be integrated with each other. An oil passage 356 is bored into the inner portion of the cylinder end 318 so as to communicate with the inner space of the fourth cylinder body 317. A port 355 is defined in the upper side surface of the cylinder body 311 and the side surface of the fixed block 313 so as to communicate with the inner and outer sides of the cylinder body 311. The terminal end of the oil passage 356 communicates with the port 355. That is, the inner space of the cylinder body 311 communicates with that of the fourth cylinder body 317 by way of the oil passage 356.

The cubic fixed block 319, having an inner diameter which is the same as the outer diameter of the fourth cylinder body 317, is inserted along and fixed to the lower outer periphery of the fourth cylinder body 317. The fixed piece 320 formed of a plate sheet, etc. is fixed to the side surface of the fixed block 319 and the lower surface of the cylinder end 312 is coupled with one end of the fixed piece 320. Accordingly, an integral structure is formed by the cylinder end 312, the fixed block 319 and a fixed piece 320, whereby the lower end of the cylinder body 311 is coupled with that of the fourth cylinder body 317. The sliding pipe 248 is engaged in the lower end (left side in FIG. 25) opening of the fourth cylinder body 317, and the sliding pipe 248 is slidably inserted into the opening of a cylindrical coupling 357 which is mounted on the body 317. The sliding pipe 248 is opened at the upper and lower ends thereof and is pipe-shaped. Even if the sliding pipe 248 is slidable relative to the coupling 357, the inner space of the fourth cylinder body 317 always communicates with the upper end opening of the sliding pipe 248. The cubic terminal block 321 is coupled with the lower end (left side in FIG. 25) opening of the sliding pipe 248 so that the former closes the latter. Further, an oil passage 358 is defined in the side surface of the terminal block 321 for communicating with the inner space of the sliding pipe 248.

Figure 26:
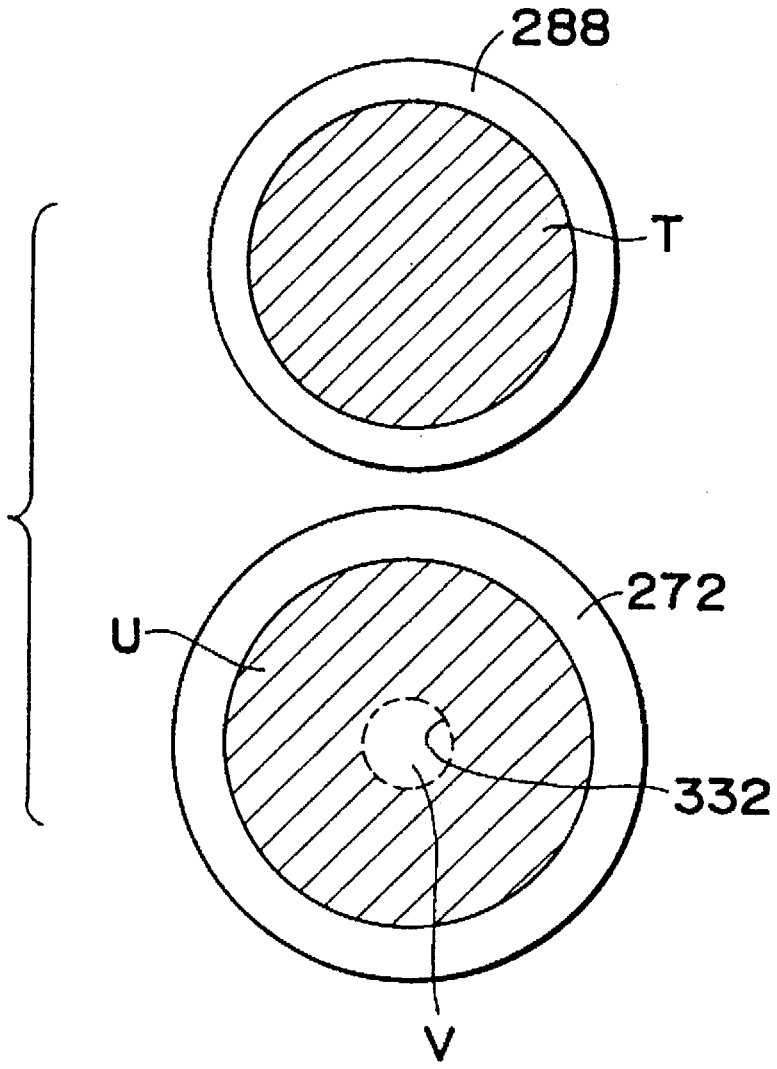
FIG. 26 is a side cross-sectional view showing pressure application cross-sectional areas of the oil supply unit as taken along line 26—26 in FIG. 24.

FIG. 26 shows the relation between the shape of the cylinder body 272 constituting the stretchable unit 235 and that of the second cylinder 288. More in detail, FIG. 26 shows the cross-sectional relations between the pressure chambers E and F.

Supposing that a cross-sectional area of the inner portion of the second cylinder 288 is T, the cross-sectional area T is equal to a cross-sectional area of the piston 345 which slides inside the second cylinder 288. Supposing that a cross-sectional area of the inner portion of the cylinder body 272 is U, the cross-sectional area U is equal to a cross-sectional area of the piston 333 which slides inside the cylinder body 272. Further, supposing that a cross-sectional area of the inner diameter of the inner pipe 332 positioned at the center of the cylinder body 272 is V. The area (U−V) is equal to an effective pressure cross-sectional area to which the piston 333 actually operates in the pressure chamber E of the cylinder body 272. In such a setting of the cross-sectional areas, inner diameters of the second cylinder 288, the cylinder body 272 and the inner pipe 332 are set to have the following area relationship which is expressed as:

$$T=(U-V)$$

Figure 27:
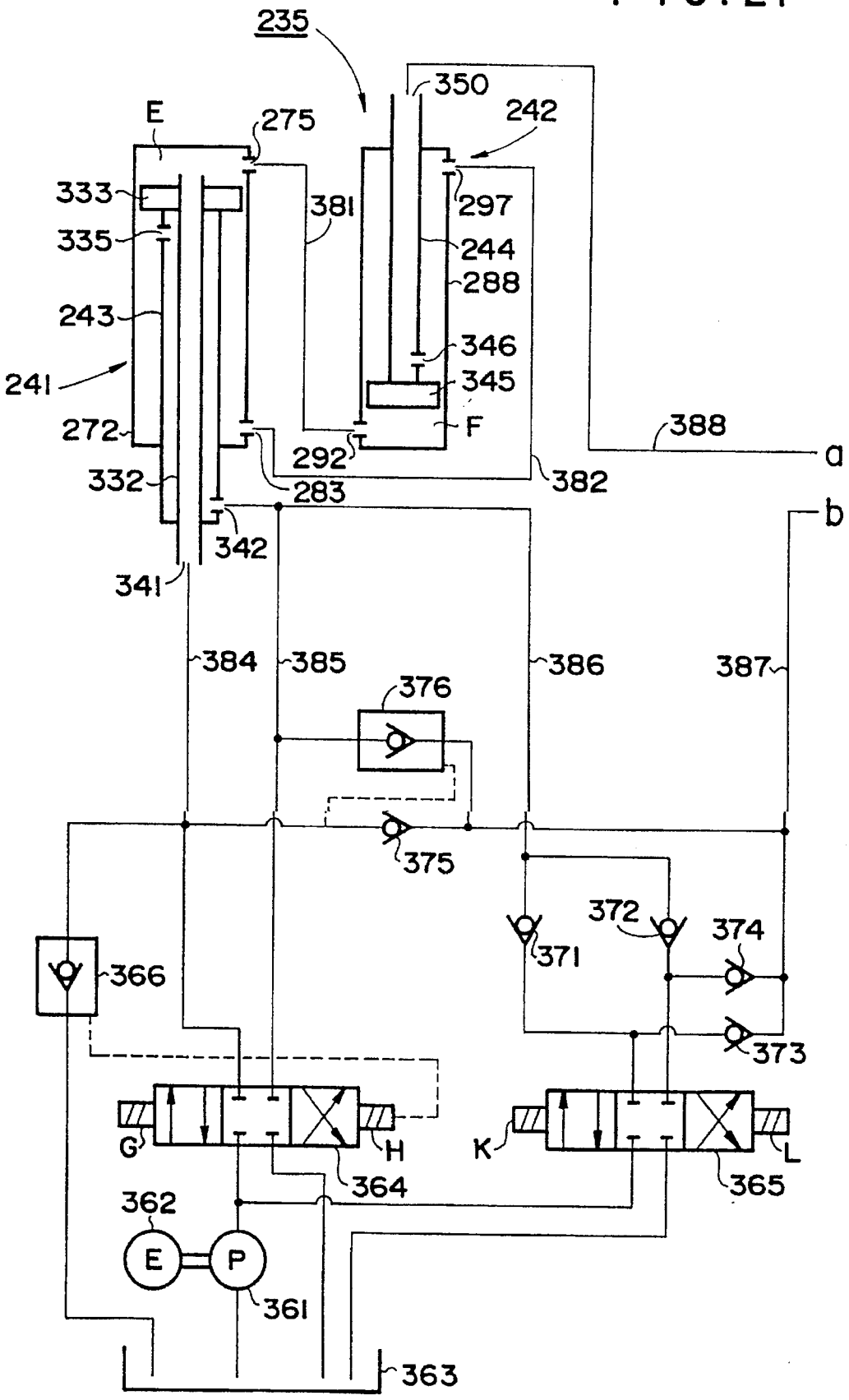
FIG. 27 is a diagrammatic view of a hydraulic system for supplying oil under pressure to the working unit according to the second embodiment of the invention.
Figure 28:
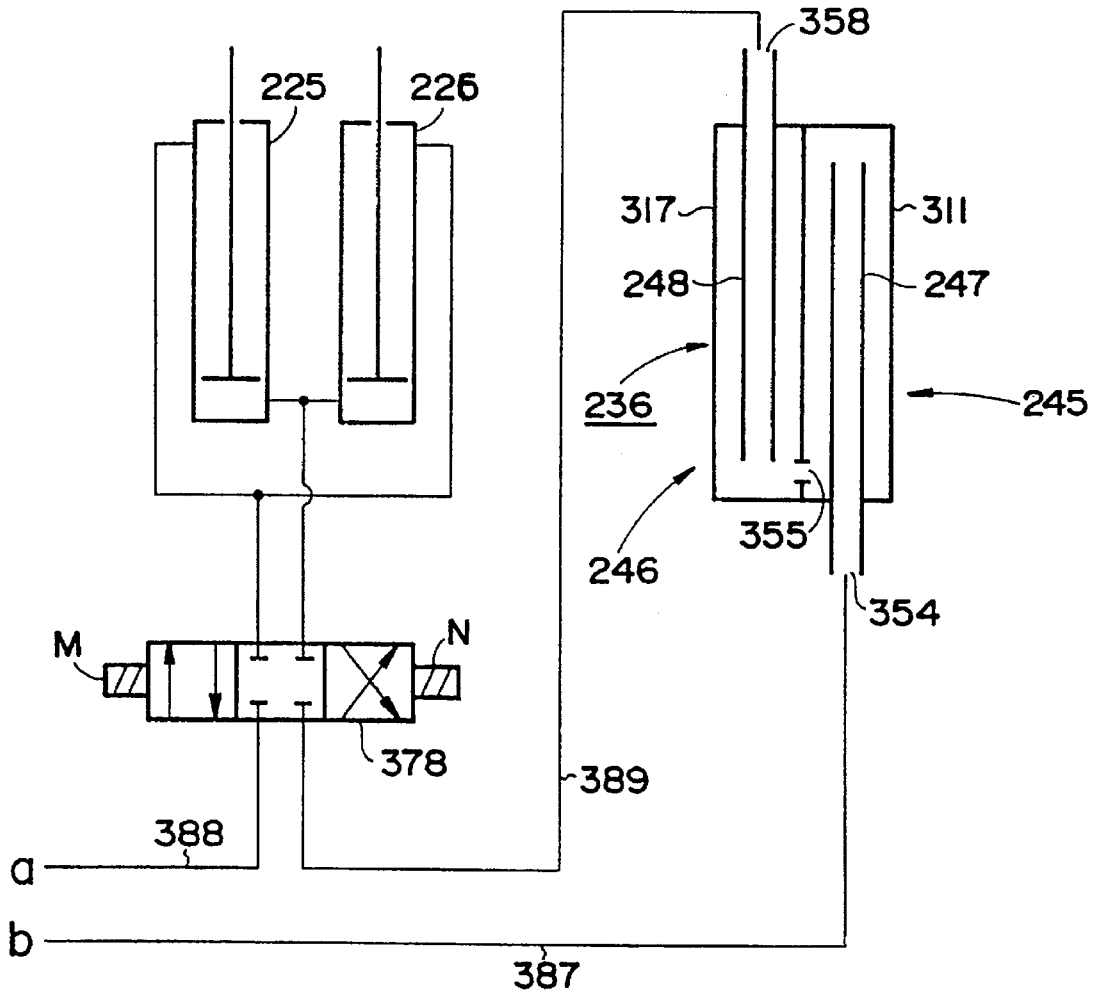
FIG. 28 is a diagrammatic view of a hydraulic system for supplying oil under pressure to the working unit according to the second embodiment of the invention.

FIGS. 27 and 28 respectively show a control mechanism of the hydraulic circuit for the second embodiment. The hydraulic circuit shown in FIGS. 27 and 28 is the integrated circuit wherein passages denoted by a and b in FIG. 27 are respectively connected to passages a and b in FIG. 28.

The chassis of the excavator accommodates therein an engine 362, and an oil pump 361 as an oil pressure generating source, wherein the oil pump 361 is driven by the engine 362 so that the oil pump 361 sucks hydraulic oil from the oil tank 363 communicating with the suction side of the oil pump 361, and increases the oil to a given pressure for discharge from a discharge side of the pump 361. Electromagnetic valves 364 and 365 serving as directional control valves are connected to the discharge side of the oil pump 361 and are positioned in parallel with each other. The electromagnetic valves 364 and 365 can be switched to three stages or positions, i.e., a "neutral directional position or side", a "normal directional position or side", and a "reverse directional position or side" in response to electric signals. The returning side of the electromagnetic valves 364 and 365 communicates with the oil tank 363. An output of the electromagnetic valve 364 is connected to the port 341 by way of a pressure passage or conduit 384 and the other output of the electromagnetic valve 364 is connected to the port 342 by way of the pressure passage or conduit 385. An output of the electromagnetic valve 365 is connected to check valves 371 and 373, wherein control directions of the check valves 371 and 373 are oppositely directed. The other output of the electromagnetic valve 365 is connected to check valves 372 and 374, wherein control directions of the check valves 372 and 374 are oppositely directed. Control directions of the check valves 371 and 372 are directed in the same direction, while control directions of the check valves 373 and 374 are also directed in the same direction. The control directions of the check valves 371 and 372 and the check valves 372 and 374 are oppositely directed.

The port 342 is connected to the check valves 371 and 372 by way of a pressure passage 386, while the oil port 354 (FIG. 28) is connected to the check valves 373 and 374 by way of the pressure passage 387. A pilot check valve 366 is connected between the output of the electromagnetic valve 364 and the pressure passage 384, wherein a free flow side of the pilot check valve 366 connects to the oil tank 363, and the pressure passage 384 is connected to a pilot signal port of the pilot check valve 366. An opposite flow control side of a check valve 375 is connected between the output of the electromagnetic valve 364 and the pressure passage 384, and the free flow side of the check valve 375 is connected to the pressure passage 387. Further, an opposite flow control side of the pilot check valve 376 is connected between the electromagnetic valve 364 and a pressure passage 385. A free flow side of the pilot check valve 376 is connected to the pressure passage 387. The pressure passage 384 is connected to a pilot signal port of the pilot check valve 376.

The ports 275 and 292 are connected to each other by the pressure passage 381 in the stretchable unit 235, and the ports 283 and port 297 are connected to each other by a communication pipe 382. A passage 388 is connected between electromagnetic valve 378 and the port 350 defined in the lower end of the cylinder rod 244 of the stretchable unit 235, and a pressure passage 389 connects the other end of the electromagnetic valve 378 to the oil passage 358 provided at the terminal end of the sliding pipe 248 in the oil supply unit 236. The electromagnetic valve 378 can be switched to three positions, i.e., a "middle side", a "normal position", and a "reverse position" in response to electric signals. The hydraulic cylinders 225 and 226 are connected to the output side of the electromagnetic valve 378 in parallel with each other. The electromagnetic valves 365 and 378 always operate at the same time. A control signal is supplied to an electromagnetic coil K at the normal position of the electromagnetic valve 365 and an electromagnetic coil M at the normal positions of the electromagnetic valve 378 at the same time. A control signal is supplied to an electromagnetic coil L at the reverse position of the electromagnetic valve 365 and an electromagnetic coil N at the reverse position of the electromagnetic valve 378 at the same time. However, the control signal cannot be supplied at the same time to the electromagnetic coil K at the normal position of the electromagnetic valve 365 and to the electromagnetic coil L at the reverse position of the electromagnetic valve 365. Likewise, the control signal cannot be supplied at the same time to the electromagnetic coil M at the normal position of the electromagnetic valve 365 and to the electromagnetic coil N at the reverse position of the electromagnetic valve 365.

The operation is the second embodiment will be now described. The operation for excavating the earth to form the hole having a depth which is long relative to its diameter using the deep excavator of the present invention will be explained in the order of sequence as shown in FIG. 29.

Oil under pressure service as a driving source must be supplied to hydraulic components located in each portion of the deep excavator so as to operate the deep excavator to perform its function. Accordingly, the engine 362 accommodated in the turntable 213 is driven so as to drive the oil pump 361 to suck the oil from the oil tank 363 and pressurize the oil under appropriate pressure so as to supply the oil to each of the hydraulic components. The oil pressurized by the oil pump 361 is supplied to hydraulic cylinders and hydraulic motors provided in the chassis 211 and the fixed block 313, not shown, in the hydraulic circuit in FIGS. 27 and 28 (circuit arrangements of the hydraulic components which are not directly related to the present invention are omitted in FIGS. 27 and 28.)

Oil is pressurized by the oil pump 361 and the supply and stop of the supply of the oil under pressure is controlled by an operating mechanism disposed at the periphery of the operating room on the turntable 213. It is possible to change the inclination angle between the boom 214 and the stretchable arm arrangement 228 by swinging the boom 214 and the stretchable arm arrangement 228, when appropriate oil under pressure is supplied to the hydraulic cylinders 215 and 218. That is, the boom 214 can be swung forward or backward relative to the turntable 213 by extending or contracting the hydraulic cylinders 215 and 218 so as to change the inclination angle of the boom 214. When the hydraulic cylinder 218 is extended or contracted, the folder 229 is inclined about the pin 217, and the base arm 216 fixed to the folder 229 can be swung forward and backward relative to the boom 214 so as to change the inclination angle of the base arm 216. In such a manner, it is possible to control the inclination angle and the raising height of the base arm 216 by appropriately extending or contracting the hydraulic cylinders 215 and 218. The control of the base arm 216 also serves as the control of the stretchable arm arrangement 228. As mentioned above, when the hydraulic cylinders 215 and 218 are operated at the same time or alternately, the stretchable arm arrangement 228 can be changed from a state where the stretchable arm arrangement 228 is raised high above the ground while being inclined as shown in solid lines in FIG. 29 to a state where the stretchable arm arrangement 228 is inserted into the deep hollow W while it is hung perpendicularly relative to the chassis 211. The operation of the change of the inclination angle and the raising position of the stretchable arm arrangement 228 is the same as the operating procedure which is well-known.

Figure 29:
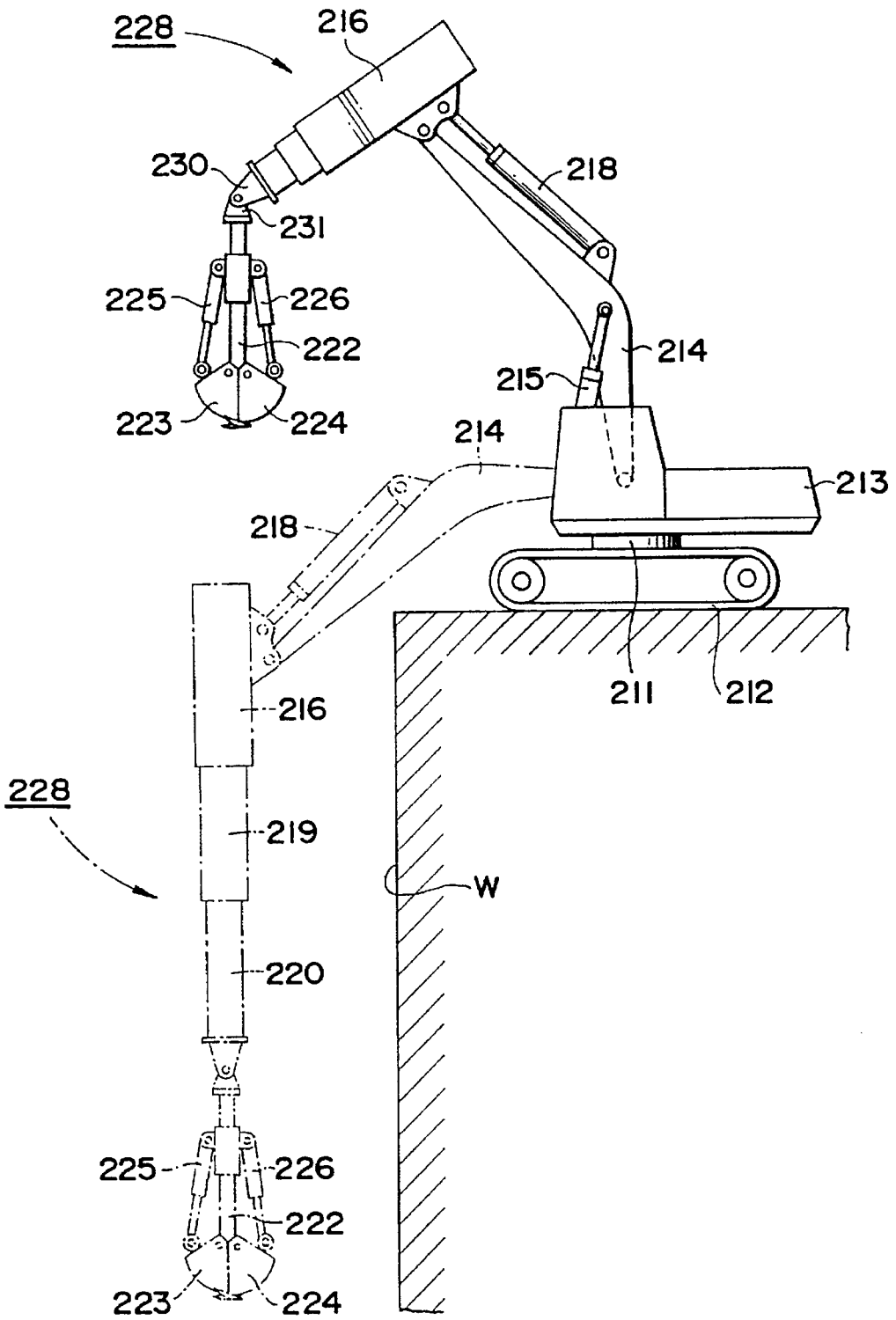
FIG. 29 is a view showing an operation of the deep excavator according to the second embodiment of the invention.

The deep excavator as shown in solid lines in FIGS. 16 and 29 is in a state where the length of the stretchable arm arrangement 228 is contracted to be the minimum. In such a contracted state, the middle arm 219 is accommodated in the base arm 216 and the top arm 220 is accommodated in the middle arm 219. When the stretchable arm arrangement 228 in such a state is inserted into the upper part of the deep hole W, then the shell buckets 223 and 224 are lowered as shown in broken lines in FIG. 29 so as to hold the earth and sand. In order to extend the stretchable arm arrangement 228, the oil under pressure is supplied to the stretchable unit 235 accommodated inside the stretchable arm arrangement 228 so as to operate the stretchable unit 235, so that the middle arm 219 is pulled out from the base arm 216 and the top arm 220 is pulled out from the middle arm 219.

The extending operation of the stretchable arm arrangement 228 starts when the control signal is supplied to an electromagnetic coil G of the electromagnetic valve 364 so as to switch the electromagnetic valve 364 to the "normal position". The oil under pressure discharged from the oil pump 361 passes through the electromagnetic valve 364, then enters the port 341 by way of the pressure passage 384, and successively passes through the oil passage 339 as shown in FIG. 24. Thereafter the oil under pressure flows inside the inner pipe 332 and enters the pressure chamber E of the cylinder body 272 from the lower end opening (left end in FIG. 24) of the inner pipe 332. The pressure chamber E is the space of the cylinder body 272 which is partitioned by the piston 333. When the pressure chamber E is expanded upon reception of the oil under pressure, the operating force is transmitted to the piston 333. The operating force is generated in the piston 333 corresponding to the effective operating cross-sectional area, so that the piston 333 is slidable rightward in the cylinder body 272 in FIG. 24. When the piston 333 slides rightward, the cylinder rod 243 and the inner pipe 332 coupled to the piston 333 are pushed rightward, so that the cylinder rod 243 slides in the cylindrical coupling 336 while airtightly keeping contact with the inner peripheral surface of the cylindrical coupling 336, and the cylinder rod 243 is pushed out from the upper end surface (right side surface in FIG. 24) of the cylindrical coupling 336.

In such a manner, the cylinder rod 243 is pushed out from the hydraulic cylinder unit 241 so that the distance between the terminal end block 254 fixed to the upper end of the cylinder rod 243 and the cylinder end 273 fixed to the lower end of the cylinder body 272 is increased. The connection block 256 is fixed to the cylinder body 272 as shown in FIGS. 19 through 22, and it is coupled with the middle arm 219 by way of the pin shafts 257 and 257 and the holding bearings 258 and 258. The terminal end block 254 is coupled with the base arm 216 by the pin 255 as shown in FIGS. 19 and 20. Accordingly, when the distance between the connection block 256 which moves together with the cylinder body 272 and the terminal end block 254 is increased, the base arm 216 is pulled out from the middle arm 219 so that the middle arm 219 slides leftward and rightward in FIGS. 19 and 20.

A part of the oil under pressure which entered the pressure chamber E through the lower end opening of the inner pipe 332 also enters the oil passage 338 bored into the cylinder end 273, so that it flows through the pressure passage 381 from the port 275 and then passes through the port 292 into the pressure chamber F inside the second cylinder 288. When the oil under pressure entering the pressure chamber F is expanded, the operating force is applied to the piston 345. An operating force corresponding to the effective operating cross-sectional area is generated at the right surface of the piston 345 in FIG. 24, so that the piston 345 is pushed leftward inside the second cylinder 288. When the piston 345 slides leftward in FIG. 24, the cylinder rod 244 is also moved leftward. Since outer periphery of the cylinder rod 244 is brought into airtight contact with the inner peripheral surface of the coupling 344 fixed to the lower end of the second cylinder 288, the cylinder rod 244 is moved leftward while sliding along the coupling 344.

As shown in FIGS. 19, 20 and 22, the second cylinder end 289 is fixed to the upper end of the second cylinder 288, and the second cylinder end 289 is coupled with the connection block 256, while the fixed piece 294 protrudes from the lower end of the second cylinder 288, and it is coupled with the coupling hinge plates 276 and 276 by the pin 278. The second cylinder 288 is coupled with the other cylinder body 272 at the upper and lower ends thereof, so that the second cylinder 288 is coupled with the middle arm 219. The terminal end block 260 is fixed to the lower end of the cylinder rod 244, and it is coupled with the coupling hinge plates 304 and 304 of the spacer 262 by the pin 261 as shown in FIGS. 19, 20 and 22. Further, since the spacer 262 is coupled with the lower end of the top arm 220 by the pin 263, the terminal end block 260 is coupled with the top arm 220. With such arrangement, when the oil under pressure is expanded in the pressure chamber F inside the second cylinder 288, the cylinder rod 244 is pushed out leftward from the coupling 344 by the piston 345 in FIG. 24 so as to increase the distance between the second cylinder end 289 and the terminal end block 260. As the result, the top arm 220 is pulled out from the middle arm 219.

With a series of simultaneous operations, when the electromagnetic valve 364 is switched to the "normal position", the cylinder rod 243 is pushed out from the cylinder body 272 by the oil under pressure supplied to the port 341, and the cylinder rod 244 is pushed out from the second cylinder 288, so that the cylinder rods 243 and 244 are operated simultaneously. As shown in FIG. 24, the extending operation of the cylinder rod 243 is opposite to that of the cylinder rod 244. The middle arm 219 is pulled out from the base arm 216 and the top arm 220 is pulled out from the middle arm 219, while the middle arm 219 and the top arm 220 slide at the same time and the sliding speeds thereof are synchronized with each other. That is, the speed of the middle arm 219 sliding along the base arm 216 is the same as the speed of the top arm 220 sliding along the middle arm 219.

The reason why the sliding speed of the top arm 220 is the same as that of the middle arm 219 will be described next. As shown in FIG. 26, the effective pressure application and the cross-sectional area of the pressure chamber E inside the second cylinder 288 is expressed as (U–V), namely the cross-sectional area obtained subtracting the pressure application cross-sectional area V of the inner pipe 332 from the pressure application cross-sectional area U of the inner diameter of the cylinder body 272. The product of the effective pressure application cross-sectional area (U–V) and the pressure of the oil under pressure is equal to the operating force which acts on the piston 333. The piston 333 is slidable inside the cylinder body 272 due to the effective pressure application cross-sectional area (U–V). The product of an effective pressure application cross-sectional area T and the pressure of the oil under pressure is equal to the operation force which acts on the piston 345. The effective pressure application cross-sectional area T is set to be equal to the cross-sectional area of the effective pressure application cross-sectional area (U–V). Accordingly, if the oil under pressure having the same pressure is supplied to the pressure chambers E and F, the equal operating force is generated in the pistons 333 and 345 so that the cylinder rods 243 and 244 are pushed out at the same sliding speed. Accordingly, the speed at which the piston 333 slides inside the cylinder body 272 is the same as the speed at which the piston 345 slides inside the second cylinder 288, so that the moving speed of the cylinder rod 243 is allowed to be synchronized that of the cylinder rod 244.

When the oil under pressure is supplied to the port 341 in FIG. 27, the piston 333 slides rightward inside the cylinder body 272 in FIG. 24, and at the same time the oil under pressure discharged from the port 275 passes through pressure passage 381, then enters the pressure chamber F through the port 292, so that the piston 345 slides leftward in the second cylinder 288 in FIG. 24. When the piston 333 slides rightward in the cylinder body 272, the oil under pressure remaining in the right-hand space of the piston 333 inside the cylinder body 272 is compressed, but the oil under the piston 333 cannot move if the oil under pressure does not escape from the right-hand space of the piston 333 inside the cylinder body 272. However, the ring-shaped space formed between the inner side of the cylinder body 272 and the outside of the cylinder rod 243 communicates with the inner space of the cylinder rod 243 through the port 335 defined in the lower portion of the cylinder body 272. Accordingly, when the piston 333 slides rightward in FIG. 24, the oil under pressure remaining in the ring-shaped space formed between the inner side of the cylinder body 272 and the outside of the cylinder rod 243 passes through the stretchable unit 235, then enters the cylinder rod 243, and thereafter flows through the ring-shaped space formed by the inner periphery of the cylinder rod 243 and that of the inner pipe 332. The thus flowed oil under pressure enters the oil passage 340 bored in the terminal end block 254, then is discharged from the port 342, thereafter passes through the pressure passage 385 and the electromagnetic valve 364, and finally it is returned to the oil tank 363.

When the piston 345 slides leftward inside the second cylinder 288 in FIG. 24, the oil under pressure remaining in the left-hand space of the piston 345 inside the second cylinder 288 is compressed. However, the oil under the piston 335 cannot move if the oil under pressure does not escape from the left-hand space of the piston 345 inside the cylinder body 288. However, since the ring-shaped space formed between the inner side of the cylinder body 288 and the outside of the cylinder rod 244 communicates with the oil passage 347, the oil under pressure remaining in the left side of the second cylinder 288 is pushed out from the oil passage 347 when the piston 345 slides. The oil under pressure allowed to flow in the oil passage 347 flows further through the port 297, then the communication pipe 382, the port 283 and the oil passage 337, successively enters the cylinder body 272 and finally flows inside the cylinder rod 243 through the port 335. Thereafter, the oil under pressure flows in the same flow passage as mentioned above, and returns to the oil tank 363 where it is collected.

When the flow passage for the oil under pressure is formed as mentioned above, the oil under pressure remaining in the left-hand space of the piston 345 inside the second cylinder 288 in FIG. 24. enters the inside space (right side of the piston 333 in FIG. 24). The thus entered oil under pressure is mixed with the oil under pressure remaining in the right-hand space of the piston 333, and the mixed oil under pressure is discharged outside from the port 342. Then, the mixed oil under pressure passes through the electromagnetic valve 364 which is switched to the "normal position", and then it is collected by the oil tank 363.

When the electromagnetic valve 364 is switched to the "normal side", the oil under pressure discharged from the oil pump 361 is supplied to the stretchable unit 235. The cylinder rod 243 is pushed out from the cylinder body 272 due to the oil under pressure, so that the interval between the base arm 216 and the middle arm 219 is increased while the cylinder rod 244 is pushed out from the second cylinder 288 so that the distance between the middle arm 219 and the top arm 220 is increased. With such an interlocking operation of each component of the stretchable unit 235, the stretchable arm arrangement 228 is extended. Since the oil supply unit 236 is coupled with the side surface of the stretchable unit 235, the oil supply unit 236 is forced to be changed in its entire length at the same time when the stretchable unit 235 is operated.

Since the fixed channel 267 on the oil supply unit 236 is coupled with the cylinder end 289 of the cylinder 242 as shown in FIGS. 19, 20 and 23, the fixed block 313, the cylinder end 318 and the cylinder bodies 311 and 317 which are respectively fixed by the fixed channel 267 are coupled with the middle arm 219 by way of the cylinder 242. The terminal block 265 fixed to the upper end of the sliding pipe 247 is coupled with the rib plates 251 and 252 by the pin 266 as shown in FIGS. 19, 20 and 23, and the rib plates 251 and 252 are fixed to the base arm 216. Accordingly, the sliding pipe 247 is coupled with the base arm 216. With such an arrangement, when the cylinder rod 243 in the stretchable unit 235 is pushed out from the cylinder body 272 so that the middle arm 219 is pulled out from the base arm 216, the sliding pipe 247 is simultaneously pushed out from the cylinder body 311 since the terminal block 265 is coupled with the base arm 216 and the cylinder body 311 is coupled with the middle arm 219. The pushing speed of the sliding pipe 247 out from the cylinder body 311 becomes the same as that of the cylinder rod 243 out from the cylinder body 272 so that the sliding pipe 247 is synchronous with the cylinder rod 243. When the sliding pipe 247 is pushed, out from the cylinder body 311, the inner periphery of the coupling 353 fixed to the cylinder body 311 is airtightly brought into contact with the outer periphery of the sliding pipe 247 so that the oil under pressure accommodated in the cylinder body 311 does not leak outside but remains accommodated therein even if the sliding pipe 247 slides relative to the coupling 353.

The terminal block 268 fixed to the tip end of the sliding pipe 248 is coupled with the spacer 262 by the pin 270 by way of the coupling hinge plates 269 and 269 as shown in FIGS. 19, 20 and 23, and the spacer 262 is coupled with the top arm 220 by the pin 263. With such an arrangement, when the cylinder rod 244 in the stretchable unit 235 is pushed out from the second cylinder 288, the top arm 220 is pulled out by the cylinder rod 244 by way of the terminal end block 260 and the spacer 262 so that the top arm 220 is pulled out from the middle arm 219. Since the terminal block 321 is coupled with the coupling hinge plates 269 and 269 of the spacer 262 by the pin 270, when the top arm 220 is pulled out from the middle arm 219, the terminal block 321 is pushed outward by the spacer 262 so that the sliding pipe 248 coupled with the terminal block 321 is pushed out from the fourth cylinder body 317. The pushing speed of the sliding pipe 248 out from the fourth cylinder body 317 becomes the same as that of the cylinder rod 244 out from the second cylinder 288 so that the sliding pipe 248 is synchronous with the cylinder rod 244. When the sliding pipe 248 is pushed out from the fourth cylinder body 317, the inner periphery of the coupling 357 fixed to the lower end of the fourth cylinder body 317 is airtightly brought into contact with the outer periphery of the sliding pipe 248, so that the oil under pressure accommodated inside the fourth cylinder body 317 does not leak outside and remains accommodated therein even if the sliding pipe 248 slides relative to the coupling 357.

When the cylinder rod 243 is pushed out leftward from the cylinder body 272 and the cylinder rod 244 is pushed out rightward from the second cylinder 288, the sliding pipe 247 is pushed out from the cylinder body 311 and the sliding pipe 248 is pushed out from the fourth cylinder body 317. Even if the sliding pipes 247 and 248 slide relative to the cylinder bodies 311 and 317, which store the oil under pressure therein, the sliding pipes 247 and 248 are brought into contact with the couplings 353 and 357, whereby the distance between the terminal blocks 265 and 321 can be increased while keeping the airtightness therebetween without leaking the stored oil under pressure outside the cylinder bodies 311 and 317. In extending operations of the oil passages 347 and 348 of the oil supply unit 236, the oil under pressure is not supplied to the inner portion of the cylinder bodies 311 and 317 (the electromagnetic valve 365 is set to "neutral position") so that the oil under pressure does not flow between the outer and inner portions of the cylinder bodies 311 and 317, and hence the sliding pipes 247 and 248 are merely pushed out from the cylinder bodies 311 and 317 in the longitudinal directions thereof, which does not generate any pressuring operating force.

When the sliding pipe 247 is pushed out from the cylinder body 311 and the sliding pipe 248 is pushed down from the fourth cylinder body 317, the inner portions of the cylinder bodies 311 and 317 are negatively pressurized. This is caused by the fact that when the sliding pipes 247 and 248 are pushed out from the cylinder bodies 311 and 317, the capacities of the cylinder bodies 311 and 317 are reduced by the volumes of the pushed sliding pipes 247 and 248 (the oil under pressure remaining in the cylinder bodies 311 and 317 does not flow between inside and outside when the oil supply unit 236 is pushed out from the stretchable unit 235). As mentioned, when the inner spaces of the cylinder bodies 311 and 317 are negatively pressurized due to the pushing of the sliding pipes 247 and 248 out from the cylinder bodies 311 and 317, load for pushing out from the cylinder bodies 311 and 317 is applied, so that the stretchable unit 235 does not drive the oil supply unit 236 smoothly.

The check valve 376 is provided in the hydraulic circuit to prevent such a vacuum state, i.e., a negative pressurized state. With the provision of the check valve 376, the sliding pipes 247 and 248 are respectively pushed out from the cylinder bodies 311 and 317, and the oil under pressure corresponding to the capacities of the pushed oil passage 347 and oil passage 348 are supplied to prevent the generation of the vacuum state.

When the electromagnetic valve 364 is switched to the "normal position", the oil under pressure discharged from the pump 361 enters the pressure passage 384, and is also supplied to the check valve 375. However, since the check valve 375 is oppositely directed, the oil under pressure does not flow into the pressure passage 387. Since the pilot signal is issued to the check valve 376, the check valve 376 is opened by the oil under pressure from the pressure passage 384. As a result, the pressure passage 385 communicates with the pressure passage 387 by way of the opened check valve 376. Since the oil under pressure remaining inside the cylinder rod 243 which flows out from the port 342 flows into the pressure passage 385, a part of the oil under pressure passes through the check valve 376 and enters the pressure passage 387. The oil under pressure enters the pressure passage 387 moves inside the sliding pipe 247 through the oil passage 354, and further flows inside the cylinder body 311 from the tip end of the sliding pipe 247. Further, the oil under pressure passes through the port 355 and the oil passage 356, then enters the inner space of the fourth cylinder body 317 so that the oil under pressure which is lacking inside the cylinder bodies 311 and 317 is introduced into the cylinder bodies 311 and 317. In such a manner, even if negative pressure is generated in the cylinder bodies 311 and 317, the oil under pressure which automatically lacks in the cylinder bodies 311 and 317 because of the opening of the check valve 376 is introduced into the cylinder bodies 311 and 317 so as to prevent the generation of negative pressure in advance.

When the electromagnetic valve 364 is switched to the "normal position", the oil under pressure is supplied from the hydraulic pump 361 to the stretchable unit 235 so as to extend the stretchable unit 235 so that the middle arm 219 is pulled out from the base arm 216 and the top arm 220 is pulled out from the middle arm 219, and hence the entire length of the stretchable arm assembly 228 is extended. However, when the shell buckets 23 and 24, which are hung from the tip end of the top arm 220, reach the bottom of the deep hole W as shown by the dotted lines in FIG. 29, the extending operation of the stretchable arm assembly 228 must be stopped. This operation can be performed by returning or switching the electromagnetic valve 364 from the "normal position" to the "neutral position" so as to stop the supply of the oil under pressure from the hydraulic pump 361 to the port 341. Since the oil under pressure already supplied to the stretchable unit 235 is stored in the pressure chamber E of the cylinder body 272 and the pressure chamber F of the second cylinder 288, and the hydraulic circuit is closed in that state, the cylinder rods 243 and 244 stop while they are extended from the cylinder bodies 272 and 278, so that the stretchable arm assembly 228 remains extended.

In such a manner when the shell buckets 23 and 24 reach the bottom of the deep hole W, the hydraulic cylinders 25 and 26 are successively contracted to thereby open the shell buckets 23 and 24 coupled thereto so as to hold the earth or sand by the shell buckets 23 and 24.

In order to operate (i.e. open) the shell buckets 23 and 24 by contracting the hydraulic cylinders 25 and 26, the electromagnetic valve 364 remains in the "neutral position" so as to simultaneously supply a control signal to the electromagnetic coils K and M of the directional control valves 365 and 378 so as to switch the directional control valves 365 and 378 to the "normal position" at the same time. Accordingly, the oil under pressure discharged from the hydraulic pump 361 passes through the electromagnetic valve 365, then flows into the check valve 371 and the pressure passage 386, and then is supplied to the port 342. The oil under pressure supplied to the port 342 passes through the oil passage 340 as shown in FIG. 24, and flows into a ring-shaped space defined between the inner side of the cylinder body 272 and the outer side of the cylinder rod 243, successively flows from the oil passage 337 and the port 283, and finally flows into the port 297 by way of the communication pipe 382. The oil under pressure flowed into the port 297 passes through the oil passage 347 as shown in FIG. 24, then flows into a ring-shaped space defined between the inner side of the cylinder body 288 and the outer side of the cylinder rod 244, and successively flows into the cylinder rod 244 through the port 346. Then, the oil under pressure flows into the inner space of the cylinder rod 244, and passes through the oil passage 348, thereafter flows outside the cylinder rod 244 through the port 350. With such a flow passage, the oil under pressure is circulated inside the stretchable unit 235 so as to supply the oil under pressure to the port 350 adjacent to the tip end of the top arm 220.

The oil under pressure reaching the port 350 flows into the pressure passage 388 as shown in FIGS. 27 and 28, and passes through the electromagnetic valve 378 which is switched to the "normal position", and enters the discharge chambers of the hydraulic cylinders 225 and 226. Accordingly, the cylinder rods of the hydraulic cylinders 225 and 226 are pushed into the hydraulic cylinders 225 and 226, so that the entire length of the hydraulic cylinders 225 and 226 are reduced so that the shell buckets 223 and 224, which are respectively supported by a lower portion of a hanging shaft 222, are turned to open the lower portions thereof. The state where the shell buckets 223 and 224 are opened is illustrated in FIG. 16. Accompanied by the contraction of the cylinder rods of the hydraulic cylinders 225 and 226, the oil under pressure inside the pressure chambers of the hydraulic cylinders 225 and 226 is discharged when the pistons are moved. The discharged oil under pressure passes through the electromagnetic valve 378, which is switched to the "normal position", and flows into the pressure passage 389 and further flows into the oil passage 358.

The oil under pressure thus enters the oil passage 358 and flows inside the sliding pipe 248 as shown in FIG. 25, and is discharged inside the fourth cylinder body 317 from the upper end right side of the sliding pipe 248. The oil under pressure flowed into the fourth cylinder body 317 passes through the oil passage 356 and port 355, then flows inside the neighboring cylinder body 311, and further enters the sliding pipe 247 through the lower end opening (left side in FIG. 25) of the sliding pipe 247. Successively, the oil under pressure flows into the sliding pipe 247 and is discharged outside through the terminal end block 254. The oil under pressure discharged from the oil passage 354 flows into the pressure passage 387, then passes through a check valve 374, thereafter it is collected by the oil tank 363 by way of the electromagnetic valve 365. Since the normal pressure from the hydraulic pump 361 is applied to the "reverse position" of check valve 373, the check valve 373 is not opened but the check valve 374 alone is opened by the oil under pressure from the pressure passage 387. Likewise, the oil under pressure does not flow into check valve 375 and it is not opened since the electromagnetic valve 364 is in the "neutral position".

With such a circulation of the oil under pressure, the electromagnetic valves 365 and 378 are respectively switched to the "normal position", the oil under pressure accommodated inside the turntable 213 is supplied to the hydraulic cylinders 225 and 226. The thus supplied oil under pressure brings about operation forces to contract the hydraulic cylinders 225 and 226 and open the shell buckets 223 and 224. The oil under pressure returned from the hydraulic cylinders 225 and 226 flows inside the oil supply unit 236, then passes through the check valve 374 through the pressure passage 387, then also passes through the electromagnetic valve 365, and is finally collected by the oil tank 363.

As mentioned above, when the hydraulic cylinders 225 and 226 are respectively contracted, the pair of shell buckets 223 and 224 are opened to the left and right. In order to maintain the state where the shell buckets 223 and 224 remain opened, the supply of the control signal to the electromagnetic coil K of the electromagnetic valve 365 and the electromagnetic coil M of the electromagnetic valve 378 is stopped, and the electromagnetic valves 365 and 378 are switched to the "neutral position". As a result, the discharge chambers of the hydraulic cylinders 225 and 226 are filled by the oil under pressure, so that the hydraulic cylinders 225 and 226 remain contracted. As a result, the shell buckets 223 and 224 are allowed to stop their operations while they remain directed downward.

In such a series of flow of the oil under pressure, the hydraulic cylinders 225 and 226 are contracted so that the lower portions of the shell buckets 223 and 224 are opened so that the earth or sand can be taken inside the inner space of the shell buckets 223 and 224. However, a large quantity of earth or sand cannot be taken into the shell buckets 223 and 224 by merely opening the lower portions thereof. Accordingly, it is necessary to push down the shell buckets 223 and 224 much deeper so as to take a large quantity of the earth or sand in the shell buckets 223 and 224.

In such an operation, the thus opened shell buckets 223 and 224 remain opened, and the hydraulic cylinders 215 and 218 are operated to push down the boom 214 while the stretchable arm assembly 228 remains extended downward as shown by broken lines in FIG. 29. Although the pushing-down force is applied to the stretchable arm arrangement 228 which remains stretched, the electromagnetic valve 364 is stopped in the "neutral position" in FIG. 27 so that the hydraulic fluid passage in the hydraulic circuit is closed, and the cylinder rod 243 and 244 remain extended from the cylinder bodies 272 and 288. The pushing-down force by the boom 214 is applied to the stretchable arm arrangement 228 as it brings about the operating force to press the shell buckets 223 and 224 against the deep hole W. The opened shell buckets 223 and 224 thus bite into the bottom so as to take a large quantity of earth or sand thereinto.

If the hydraulic cylinders 215 and 218 are operated to push down the boom 214 during a given period of time, the supply of the oil under pressure to the hydraulic cylinders 215 and 218 is stopped so as to complete the biting operation of the shell buckets 223 and 224 at the bottom of the deep hole W. Successively, the shell buckets 223 and 224 are closed so as to hold the earth or sand.

The control signal is supplied to the electromagnetic coil L of the electromagnetic valve 365 and the electromagnetic coil M of the electromagnetic valve 378 at the same time, whereby the electromagnetic valves 365 and 378 are respectively switched from the "neutral position" to the "reverse position". Then, the oil under pressure discharged from the hydraulic pump 361 passes through the electromagnetic valve 365 and the check valve 372, then enters the port 342 through the pressure passage 386. At this time, since the check valve 374 is directed to the "reverse position", the oil under pressure from the electromagnetic valve 365 does not enter the pressure passage 387. The oil under pressure entering the port 342 flows into the port 335 as mentioned above, then flows outside through the port 350. The oil under pressure from the port 350 is supplied to the electromagnetic valve 378 by way of the pressure passage 388, but it enters the space of the pressure chambers of the hydraulic cylinders 225 and 226 since the electromagnetic valve 378 is switched to the "reverse position", so as to operate to extend the cylinder rods of hydraulic cylinders 225 and 226. When the cylinder rods of the hydraulic cylinders 225 and 226 are extended, the shell buckets 223 and 224 coupled to the cylinder rods are turned about the hanging shaft 222 so that the lower portions of the shell buckets 223 and 224 are closed. When the tip ends of the shell buckets 223 and 224 are engaged with each other, the opening defined between the lower portions thereof is closed so that the earth or sand at the bottom of the deep hole W can be held by the shell buckets 223 and 224.

When the hydraulic cylinders 225 and 226 are extended, the oil under pressure remaining in the hydraulic cylinders 225 and 226 is discharged by the operation of the piston, and flows into the electromagnetic valve 378. The oil under pressure passed through electromagnetic valve 378 flows into the pressure passage 389 and further flows in the oil passage 358. The oil under pressure flowed into the oil passage 358 circulates inside the oil supply unit 236, then passes through the pressure passage 387, check valve 373 and the electromagnetic valve 365, then is collected by the oil tank 363. The route and the direction through which the oil under pressure flows are the same as those when the hydraulic cylinders 225 and 226 are contracted, that is, they equal the circulating circuit where the oil under pressure supplied to the electromagnetic valve 378 is input to the pressure passage 386 and returns from the pressure passage 387. However in this case, the direction where the electromagnetic valve 378 connected to the hydraulic cylinders 225 and 226 is switched is opposite to the previous case, the flow passage of the oil under pressure supplied to the hydraulic cylinders 225 and 226 is opposite to that in the previous case, so that the hydraulic cylinders 225 and 226 are respectively extended.

If the electromagnetic valves 365 and 378 are switched to "reverse position" so as to close the lower portions of the shell buckets 223 and 224 during a given time, the extending operation of the cylinder rods of the hydraulic cylinders 225 and 226 must be stopped. In this operation, the supply of the control signals to the electromagnetic coil L of the electromagnetic valve 365 and electromagnetic coil M of the electromagnetic valve 378 is stopped, then the electromagnetic valve 365 and 378 are returned, i.e. switched to the "neutral position", and finally the supply of the oil under pressure discharge from the hydraulic pump 361 is stopped. Even if the supply of the oil under pressure to the hydraulic cylinders 225 and 226 is stopped, the hydraulic cylinders 225 and 226 remain extended since the oil under pressure is sealed inside the hydraulic cylinders 225 and 226, so that the teeth of the shell buckets 223 and 224 are engaged with one another to remain holding the earth or sand.

To pull the shell buckets 223 and 224 holding the earth or sand therein upward from the deep hole W, the stretchable arm assembly 228 must be contracted. In the contracting operation of the stretchable arm assembly 228, the stretchable unit 235 is operated so as to contract the middle arm 219 into the base arm 216, and contract the top arm 220 into the middle arm 219.

To start the contracting operation, the control signal is supplied to electromagnetic coil H of the electromagnetic valve 364 and the oil under pressure discharged from the hydraulic pump 361 is supplied to the pressure passage 385. As a result, the oil under pressure passed through the electromagnetic valve 364, passes through the pressure passage 385, then enters port 342, successively passes through the oil passage 340, thereafter flows into the ring-shaped space between the inner periphery of the cylinder rod 243 and the outer periphery of the inner pipe 332, and then passes through the port 335, and finally flows into the inner periphery of the cylinder body 272. When the oil under pressure enters the ring-shaped space between the outer periphery of the inner pipe 332 and the inner periphery of the cylinder body 272, it expands this space so as to push the piston 333 leftward in FIG. 24 and slide the piston 333 leftward inside the cylinder body 272. When the piston 333 is moved, the cylinder rod 243 and inner pipe 332 are simultaneously pushed into the cylinder body 272 in FIG. 24. Accordingly, the distance between the terminal end block 254 fixed to the upper end (right side in FIG. 24) of the cylinder rod 243 and the connection block 256 is reduced so that the middle arm 219 is pulled into the base arm 216 (because the terminal end block 254 is coupled to the base arm 216 by the pin 255 and the connection block 256 is coupled to the middle arm 219 by way of the holding bearings 258 and 258 as shown in FIGS. 19 and 20). At this time since the outer periphery of the cylinder rod 243 airtightly slides on the inner periphery of the cylindrical coupling 336, the oil under pressure inside the cylinder body 272 does not leak outside.

The oil under pressure flowed into the cylinder body 272 flows into the ring-shaped space between the inner periphery of the cylinder body 272 and the outer periphery of the cylinder rod 243, then passes through the oil passage 337, and is discharged from the port 283. The oil discharged from the port 283 flows into the communication pipe 382 and is supplied to the port 297, then passes through the oil passage 347, and finally enters the ring-shaped space between the inner periphery of the second cylinder 288 and the outer periphery of the cylinder rod 244. At the same time, a part of the oil under pressure enters the cylinder rod 244 through the port 346, and the oil under pressure is expanded inside the second cylinder 288 so as to push the piston 345 rightward in FIG. 24 so that the cylinder rod 244 is also pushed into the second cylinder 288. Accordingly, the distance between the terminal end block 260 fixed to the lower end (left side in FIG. 24) and the second cylinder end 289 is reduced so that the top arm 220 is pulled into the middle arm 219 (as shown in FIGS. 19 and 20, the terminal end block 260 is coupled to the top arm 220 by the pin 261, the spacer 262, the pin 263, and the second cylinder end 289 is coupled to the middle arm 219 by the connection block 256 and the holding bearings 258 and 258).

At this time, since the outer periphery of the cylinder rod 244 airtightly slides on the inner periphery of the coupling 344, the oil under pressure inside the second cylinder 288 does not flow outside. Also at this time, the electromagnetic valve 378 remains in the "neutral position" so that the oil under pressure cannot flow through port 350 into the pressure passage 388.

In such a manner, the cylinder rod 243 is pushed into the cylinder body 272, and the cylinder rod 242 is simultaneously pushed into the second cylinder 288. Since the cylinders 241 and 242 are coupled to the middle arm 219, when the cylinder rod 243 is pushed inside the cylinder body 272, the middle arm 219 is pulled into the base arm 216 since the terminal end block 254 is coupled to the base arm 216. Likewise, when the cylinder rod 244 is pushed into the second cylinder 288, the top arm 220 is pulled into the middle arm 219. The length of the stretchable arm arrangement 228 is thus reduced.

When the piston 333 slides leftward in FIG. 24, the oil under pressure remaining in the pressure chamber E is compressed, and the thus compressed oil flows into the inner pipe 332, then passes through the oil passage 339 and the port 341, then flows toward the pressure passage 384. Likewise, when the piston 345 slides rightward in FIG. 24, the oil under pressure remaining in the pressure chamber F is compressed, and the thus compressed oil under pressure flows into the oil passage 349, the port 292 and the pressure passage 381, then is moved to the pressure chamber E by way of the port 275 and the oil passage 338. The oil thus entered into the pressure chamber E is mixed with that which remains previously, and the mixed oil under pressure then flows through inner pipe 332 toward the pressure passage 384 in the same oil manner as described above. The oil under pressure flowed out from the stretchable unit 235 passes through the electromagnetic valve 364 which is switched to the "reverse position" and is collected by the oil tank 363. However, since oil under pressure is being supplied to the pressure passage 385, a part of the oil under pressure is input to the pilot check valve 366 as a pilot signal, so that the pilot check valve 366 is opened. Accordingly, the oil which flows out from the stretchable unit 235 and flows into the pressure passage 384 then passes through the opened pilot check valve 366 and is thereafter collected by the oil tank 363. This is caused by the fact that the returned oil does not pass through the electromagnetic valve 364 but passes through the pilot check valve 366 having less fluid resistance so that it can be quickly returned so as to expedite the contracting operation of the arm arrangement 228.

As mentioned with reference to FIGS. 19, 20 and 24, the cylinder rod 243 is pushed into the cylinder body 272 and the cylinder rod 244 is pushed into the second cylinder 288 so that the entire length of the stretchable unit 235 is reduced. The oil supply unit 236 is also reduced in its entire length following the reduction of the entire length of the stretchable unit 235.

That is, the main bodies of the cylinder bodies 311 and 317 in the oil supply unit 236 are respectively fixed to the second cylinder end 289 of the stretchable unit 235 by way of the fixed block 313 and the cylinder end 318. Since the second cylinder end 289 is coupled to the middle arm 219 by way of the cylindrical coupling shaft 284 and the connection block 256, the main bodies of the cylinder bodies 311 and 317 are respectively coupled to the middle arm 219. The terminal block 265 fixed to the upper end (right side in FIG. 25) of the sliding pipe 247 is coupled to the base arm 216 by way of the pin 266, rib plates 251 and 252 while the terminal block 268 fixed to the lower end (left side in FIG. 25) of the sliding pipe 247 is coupled to the top arm 220 by way of the pin 270, the spacer 262 and the pin 263. Accordingly, when the cylinder rod 243 is pushed into the cylinder body 272 so that the middle arm 219 is pulled into the base arm 216, the sliding pipe 247 is pushed into the cylinder body 311 accompanied by the aforementioned operation. When the cylinder rod 244 is pushed into the second cylinder 288 so that the top arm 220 is pulled into the middle arm 219, the sliding pipe 248 is pushed into the fourth cylinder body 317 accompanied by the aforementioned operation. As a result, the length of the oil supply unit 236 in the lateral direction in FIG. 25 is reduced, so that the contracting or reducing speed thereof is synchronous with that of the stretchable unit 235.

When the sliding pipe 247 slides relative to the cylinder body 272, the inner periphery of the coupling 353 is airtightly brought into contact with the outer periphery of the sliding pipe 247, the oil under pressure remaining inside the cylinder body 311 does not leak outside. Further, when the sliding pipe 248 slides relative to the second cylinder 288, since the inner periphery of the coupling 357 is airtightly brought into contact with the outer periphery of the sliding pipe 248, the oil under pressure remaining inside the fourth cylinder body 317 does not leak outside. In this case, the oil under pressure does not flow in view of pressure at the time of pushing operation of the sliding pipe 247 into the cylinder body 311 and at the time of pushing operation of the sliding pipe 248 into the fourth cylinder body 317, so that the sliding pipes 247 and 248 can smoothly slide.

Since the sliding pipes 247 and 248 have their thickness, when they are pushed into the cylinder bodies 311 and 317, the oil under pressure corresponding to the capacities of such a thickness is increased, and the increased oil under pressure is discharged from the oil passage 354 to the oil supply unit 236. The oil under pressure discharged from the oil passage 354 flows into the pressure passage 387, then passes through the check valve 375 and the pilot check valve 366, then is collected by the oil tank 363.

When the electromagnetic valves 364 is switched on the "reverse position" so as to supply the oil under pressure to the stretchable unit 235, the arm arrangement 228 is contracted so that the middle arm 219 is pulled into the base arm 216 and the top arm 220 is pulled into the middle arm 219, thereby gradually reducing the entire length of the arm arrangement 228.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An oil supply mechanism in a deep excavator comprising a chassis, a turntable disposed on the chassis, a boom which is pivotally supported on the turntable and is vertically swingable, a stretchable arm arrangement which is mounted on the boom and is stretchable in the longitudinal direction and comprises a base arm, a middle arm and a top arm, and buckets which are movably attached to the top arm for excavating and holding earth or sand, the oil supply mechanism comprising:

first and second oil supply units provided in the middle arm;

first and second hollow oil supply pipes airtightly and slidably disposed in each of the first and second oil supply units, the first and second oil supply pipes moving out from the first and second oil supply units in opposite directions; and one end of each of the first oil supply pipes of the first and second oil supply units being coupled with the base arm, and one end of each of the second oil supply pipes of the first and second oil supply units being coupled with the top arm;

inner spaces of the first oil supply pipes being connected to a hydraulic generating source provided in the chassis, and inner spaces of the second oil supply pipes being connected to a hydraulic driving mechanism for the buckets;

whereby oil under pressure is supplied from the chassis inside the first oil supply pipes and passes through the first and second oil supply units, and then passes through the second oil supply pipes and is supplied to the hydraulic driving mechanism of the buckets.

2. An oil supply mechanism in a deep excavator comprising a chassis, a turntable disposed on the chassis, a boom which is pivotally supported on the turntable and is vertically swingable, a stretchable arm arrangement which is mounted on the boom and is stretchable in the longitudinal direction and comprises a base arm, a middle arm and a top arm, and buckets which are movably attached to the top arm for excavating and holding earth or sand, the oil supply mechanism comprising:

a supply unit comprising a pair of oil supply cylinder units which are hollow and arranged in parallel with each other and first and second oil supply rods which are each airtightly slidable inside a respective one of the cylinder units;

the pair of oil supply cylinder units are coupled with the middle arm, and an outer end of the first oil supply rod is coupled with a base of the base arm, and an outer end of the second supply rod is coupled with a tip end of the top arm, and each oil supply cylinder unit having an inner chamber therein, the inner chambers of the pair of oil supply cylinder units having means for communicating with each other;

wherein when oil under pressure is supplied to the outer end of the first oil supply rod, the oil under pressure flows into the inner chamber of a first of the pair of oil supply cylinder units, then flows into the inner chamber of a second of the pair of oil supply cylinder units, and is then discharged from the outer end of the second supply rod.

3. An oil supply mechanism in a deep excavator comprising a chassis, a turntable disposed on the chassis, a boom which is pivotally supported on the turntable and is vertically swingable, a stretchable arm arrangement which is mounted on the boom and is stretchable in the longitudinal direction and comprises a base arm, a middle arm and a top arm, and buckets which are movably attached to the top arm for excavating and holding earth or sand, wherein the oil supply mechanism comprises:

first and second oil supply cylinder units which are hollow and arranged in parallel with each other, the first and second oil supply cylinder units each having an opening directed in opposite directions;

first and second pistons airtightly slidable inside the respective first and second oil supply cylinder units for dividing inner spaces thereof each into a pressure chamber and a discharge chamber;

first and second hollow oil supply rods respectively inserted through the openings in the first and second oil supply cylinder units, the first and second oil supply rods respectively having the first and second pistons mounted at tip ends thereof;

a first connecting passage for communicating with the discharge chamber of the first oil supply cylinder unit and the pressure chamber of the second oil supply cylinder unit;

a first communication port defined in the first oil supply rod adjacent the tip end thereof for communicating between an inner space of the first oil supply rod and the discharge chamber of the first oil supply cylinder unit;

a second communication port defined in the second oil supply rod adjacent the tip end thereof for communicating between an inner space of the second oil supply rod and the pressure chamber of the second oil supply cylinder unit;

a second connecting passage for communicating with the pressure chamber of the first oil supply cylinder unit and the discharge chamber of the second oil supply cylinder unit;

wherein the first and second oil supply cylinder units are coupled with the middle arm, an other end of the first oil supply rod distal the tip end thereof is coupled with a base of the base arm, and an other end of the second supply rod distal the tip end thereof is coupled with a tip end of the top arm; and wherein when oil under pressure is supplied through the other end of the first oil supply rod, the oil under pressure flows from the first communication port to the discharge chamber of the first oil supply cylinder unit, then flows into the pressure chamber of the second oil supply cylinder unit through the first connecting passage, then further flows into the second supply rod through the second communication port, and is successively discharged from the other end of the second supply rod.

4. An oil supply mechanism according to claim 3, further comprising:

third and fourth oil supply cylinder units which are hollow and arranged in parallel with each other, the third and fourth oil supply cylinder units each having an opening, the openings in said third and fourth oil supply cylinder units being directed in opposite directions;

third and fourth pistons airtightly slidable inside the respective third and fourth oil supply cylinder units for dividing inner spaces thereof each into a pressure chamber and a discharge chamber;

a hollow third oil supply rod inserted through the opening of the third oil supply cylinder unit, the third oil supply rod having the third piston mounted at a tip end thereof;

a hollow fourth oil supply rod inserted through the opening of the fourth oil supply cylinder unit, the fourth oil supply rod having the fourth piston mounted at a tip end thereof;

a third connecting passage for communicating with the discharge chamber of the third oil supply cylinder unit and the pressure chamber of the fourth oil supply cylinder unit;

a third communication port defined in the third oil supply rod adjacent to the tip end thereof for communicating between an inner space of the third oil supply rod and the discharge chamber of the third oil supply cylinder unit;

a fourth communication port defined in the fourth oil supply rod adjacent to the tip end thereof for communicating between an inner space of the fourth oil supply rod and the pressure chamber of the fourth oil supply cylinder unit;

said second connecting passage communicating with the pressure chamber of the first oil supply cylinder unit, the discharge chamber of the second oil supply cylinder unit, and the discharge chamber of the fourth oil supply cylinder unit;

wherein the third and fourth oil supply cylinder units are coupled with the middle arm, an other end of the third oil supply rod distal the tip end thereof is coupled with the base of the base arm, and an other end of the fourth supply rod distal the tip end thereof is coupled with the tip end of the top arm; and wherein the oil under pressure discharged from the other end of the second oil supply rod is returned through the fourth communication port at the other end of the fourth oil supply rod, the oil under pressure flows into the pressure chamber of the fourth oil supply cylinder unit through the fourth communication port, then flows into the discharge chamber of the third oil supply cylinder unit through the third connecting passage, further flows into the third oil support rod through the third communication port, so as to collect the oil under pressure from the other end of the third oil supply rod.

5. An oil supply mechanism according to claim 4, wherein a pressure application cross-sectional area of the discharge chamber of the first oil supply cylinder unit is equal to that of the pressure chamber of the second oil supply cylinder unit while a pressure application cross-sectional area of the discharge chamber of the third pressure supply cylinder unit is equal to that of the pressure chamber of the fourth oil supply cylinder unit.

6. An oil supply mechanism according to claim 5, wherein a sum of a pressure application cross-sectional area of the discharge chamber of the second oil supply cylinder unit and the discharge chamber of the fourth oil supply cylinder unit is equal to a pressure application cross-sectional area of the pressure chamber of the first oil supply cylinder unit.

7. An oil supply mechanism in a deep excavator comprising a chassis, a turntable disposed on the chassis, a boom which is pivotally supported on the turntable and is vertically swingable, a hydraulic generating source on the chassis, a stretchable arm arrangement which is mounted on the boom and is stretchable in the longitudinal direction and comprises a base arm, a middle arm and a top arm, and buckets which are movably attached to the top arm for excavating and holding earth or sand, a stretchable unit accommodated in the stretchable arm arrangement for extending or contracting the stretchable arm arrangement, an oil supply unit accommodated in the stretchable arm arrangement for flowing oil under pressure from a rear end to a tip end of the stretchable arm arrangement, the oil supply mechanism comprising:

the stretchable unit including first and second cylinder units coupled with the middle arm and directed in opposite directions;

the first cylinder unit including a first piston slidable in the first cylinder unit for dividing the interior thereof into a first pressure chamber and a first discharge chamber, and a hollow first cylinder rod inserted into the first cylinder unit and having a first end coupled with the first piston and a second end coupled with the base arm;

the second cylinder unit including a second piston slidable in the second cylinder unit for dividing the interior thereof into a second pressure chamber and a second discharge chamber, and a hollow second cylinder rod inserted into the second cylinder unit and having one end coupled with the second piston and an other end coupled with the top arm;

an inner pipe which is inserted into the first cylinder rod, and has one end coupled with the first piston for communicating with the first pressure chamber of the first cylinder unit and an other end coupled with the base arm, wherein the first and second pressure chambers have means for communicating with each other, wherein the first and second discharge chambers have means for communicating with each other, wherein an interior of the first cylinder rod and the first discharge chamber have means for communicating with each other, and wherein an interior of the second cylinder rod and the second discharge chamber have means for communicating with each other;

said oil supply unit comprising first and second cylinder pipes, a hollow first sliding pipe which is slidably inserted into the first cylinder pipe and has an outer end coupled with the base arm, the first sliding pipe is opened at the outer end and an other end distal the outer end, and a hollow second sliding pipe which is slidably inserted into the second cylinder pipe and has an outer end coupled with the top arm, the second sliding pipe is opened at the outer end and an other end distal the outer end, the first and second cylinder pipes having means for communicating with each other;

wherein the second end of the first cylinder rod and the other end of the inner pipe are connected to the hydraulic generating source, the outer end of the first sliding pipe is connected to the hydraulic generating source, and the other end of the second cylinder rod and the outer end of the second sliding pipe are connected to hydraulic driving mechanisms for the buckets.

8. An oil supply mechanism according to claim 7, further comprising a first directional control valve which is interposed between the second end of the first cylinder rod and the hydraulic generating source, and between the other end of the inner pipe and the hydraulic generating source for controlling supply of oil under pressure.

9. An oil supply mechanism according to claim 8, further comprising a second directional control valve which is interposed between the second end of the first cylinder rod and the hydraulic generating source, and between the outer end of the first sliding pipe and the hydraulic generating source for controlling supply of oil under pressure, and a third directional control valve which is interposed between the other end of the second cylinder rod and the hydraulic driving mechanisms, and between the outer end of the second sliding pipe and the hydraulic driving mechanism for controlling supply of oil under pressure, the second and third electromagnetic valves being synchronous with each other.

10. An oil supply mechanism in a deep excavator according to claim 7, further comprising a first check valve which is interposed between the second end of the first cylinder rod and the hydraulic generating source, and a second check valve which is interposed between the outer end of the first sliding pipe and the hydraulic generating source so as to supply oil under pressured from the hydraulic generating source and collecting the supplied oil under pressure from the first sliding pipe.

11. An oil supply mechanism according to claim 7, further comprising a first pilot check valve which is interposed between the second end of the first cylinder rod and the outer end of the first sliding pipe for allowing the oil under pressure to flow from the outer end of the sliding pipe to the second end of the first cylinder rod, and a pilot signal issued to the first pilot check valve for opening the first pilot check valve for preventing a negative pressure state in the oil supply unit.

12. An oil supply mechanism according to claim 7, further comprising a second pilot check valve coupled with the other end of the inner pipe for restraining the oil under pressure from being allowed to directly flow to an oil tank of the hydraulic generating source, and a pilot signal issued to the second pilot check valve for opening the second pilot check valve for allowing a direct return of the oil to the oil tank of the hydraulic generating source.

* * * * *